US006542705B2

(12) United States Patent
Fujita et al.

(10) Patent No.: US 6,542,705 B2
(45) Date of Patent: Apr. 1, 2003

(54) ELECTROPHOTOGRAPHIC HEATING APPARATUS, SYSTEM, AND METHOD

(75) Inventors: Takashi Fujita, Tokyo (JP); Hirokazu Ikenoue, Tokyo (JP); Atsushi Nakafuji, Kanagawa (JP); Kazuhito Kishi, Kanagawa (JP); Eriko Chiba, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 09/966,075

(22) Filed: Oct. 1, 2001

(65) Prior Publication Data

US 2002/0043523 A1 Apr. 18, 2002

(30) Foreign Application Priority Data

| | | |
|---|---|---|
| Sep. 29, 2000 | (JP) | 2000-298732 |
| Sep. 29, 2000 | (JP) | 2000-298742 |
| Oct. 4, 2000 | (JP) | 2000-304718 |
| Mar. 28, 2001 | (JP) | 2001-091553 |
| Mar. 28, 2001 | (JP) | 2001-092164 |
| Mar. 29, 2001 | (JP) | 2001-095320 |
| Sep. 13, 2001 | (JP) | 2001-277843 |

(51) Int. Cl.[7] ..... G03G 15/20; G03G 15/00

(52) U.S. Cl. ..... 399/69; 399/88; 219/216; 307/48

(58) Field of Search ..... 399/69, 70, 82, 399/108; 219/216, 470, 497; 307/44, 48, 59, 66, 87, 29

(56) References Cited

U.S. PATENT DOCUMENTS

| | | | | |
|---|---|---|---|---|
| 5,854,465 A | | 12/1998 | Kishi et al. | |
| 5,923,930 A | | 7/1999 | Tsukamoto et al. | |
| 6,055,390 A | | 4/2000 | Kurotaka et al. | |
| 6,078,766 A | | 6/2000 | Kurotaka | |
| 6,085,059 A | * | 7/2000 | Haneda et al. | 399/333 |
| 6,088,558 A | | 7/2000 | Yamada et al. | |
| 6,108,906 A | | 8/2000 | Fujita et al. | |
| 6,115,576 A | | 9/2000 | Nakano et al. | |
| 6,122,479 A | | 9/2000 | Fujita et al. | |
| 6,144,832 A | | 11/2000 | Nimura et al. | |
| 6,198,888 B1 | | 3/2001 | Kurotaka et al. | |
| 6,243,559 B1 | | 6/2001 | Kurotaka et al. | |
| 6,262,787 B1 | | 7/2001 | Kamoi et al. | |
| 6,295,435 B1 | | 9/2001 | Shinohara et al. | |
| 6,347,212 B1 | | 2/2002 | Kosugi et al. | |
| 6,366,751 B1 | | 4/2002 | Shakuto et al. | |

FOREIGN PATENT DOCUMENTS

| | | | |
|---|---|---|---|
| JP | 58-54367 A | * | 3/1983 |
| JP | 7-41023 Y2 | | 11/1989 |
| JP | 3-5779 A | * | 1/1991 |
| JP | 7-199739 A | * | 8/1995 |
| JP | 10-282821 | | 10/1998 |
| JP | 2000-098799 | | 4/2000 |
| JP | 2000-315567 A | * | 11/2000 |

* cited by examiner

*Primary Examiner*—Joan Pendegrass
(74) *Attorney, Agent, or Firm*—Oblon, Spivak, McClelland, Maier & Neustadt, P.C.

(57) ABSTRACT

A heating device of the present invention includes a main power source and an auxiliary power source implemented by a chargeable capacitor. A heater is made up of a main heating element that heats when supplied with power from the main power source and an auxiliary heating element that heat when supplied with power from the auxiliary power source. A charger charges the capacitor of the auxiliary power source when supplied with power from the main power source. A switch selectively causes the auxiliary power source to be charged or to feed power to the auxiliary heating element. A controller adjusts the power to be fed from the auxiliary power source to the auxiliary heating element.

81 Claims, 32 Drawing Sheets

*Fig. 48*

| | PROTON POLYMER BATTERY | LITHIUM ION BATTERY | Ni-Cd Ni-MH | LEAD BATTERY | ELECTRIC DOUBLE-LAYER CAPACITOR |
|---|---|---|---|---|---|
| CHARGE/DISCHARGE CYCLE | SEVERAL 10 THOUSANDS | 1000 | 500 | 500 | LIMITLESS |
| ENVIRONMENTAL SAFETY | ◎ | L1 | Cd. Ni | Pb | ◎ |
| ENERGY DENSITY (Wh/kg) | 10~20 | 100~150 | 50~80 | 20~30 | 0.5~3 |
| OUTPUT POWER DENSITY (W/kg) | 1000 | 200~600 | 200~500 | ~200 | ~2000 |
| INPUT POWER DENSITY (W/kg) | 1000 | 10~100 | 10~100 | 1~30 | ~2000 |

ELECTROPHOTOGRAPHIC HEATING APPARATUS, SYSTEM, AND METHOD

BACKGROUND OF THE INVENTION

1. Field of the Invention

The present invention relates to a heating device for heating various materials and devices and more particularly to a fixing device for fixing a toner image formed on a sheet-like recording medium by using a heating device and an image forming apparatus including the fixing device.

2. Description of the Background Art

A copier, printer, facsimile apparatus or similar electrophotographic image forming apparatus includes a fixing device for fixing a toner image formed on a paper sheet or similar sheet with heat and pressure. The fixing device usually includes a fixing member in the form of a roller or a belt and a pressing member in the form of a roller, a belt or a pad. The fixing member and pressing member cooperate to fix the toner image on the sheet being passed through a nip therebetween.

At least one of the fixing roller and pressing roller, for example, is implemented as a heat roller to be heated by a heater or heat source. A thermistor or similar temperature sensor is pressed against the heat roller via a polyimide resin film or similar protection film, sensing the surface temperature or the heat roller. For the heater, a halogen heater using a halogen lamp is used. A CPU (Central Processing Unit) controls power source from a commercially available power source to the halogen heater. At this instant, the CPU controls the power source such that the surface temperature of the heat roller remains at a preselected value in accordance with the output of the temperature sensor. A thermostat or similar safety device adjoins the surface of the hat roller and shuts off power source to the halogen heater only when the surface temperature of the heat roller rises above a preselected upper limit.

Today, energy saving is one of important issues even in the image forming art from the environment standpoint. As for the image forming apparatus, the fixing device consumes substantial energy in fixing a toner image on a sheet. It is a common practice to maintain, in a stand-by state, the heat roller at a temperature slightly lower than a fixing temperature for thereby saving energy. When the apparatus is to be used, the temperature of the heat roller is immediately raised to the fixing temperature to thereby prevent the operator from wasting time. However, even in the stand-by state, some power is fed to the fixing device, wastefully consuming energy. It has been reported that the energy consumption of the fixing device in the stand-by state amounts to about 70% to 80% of the total energy consumption of the apparatus.

In light of the above, there is an increasing demand for an implementation that reduces power supply to the fixing unit to practically zero in the stand-by sate. This, however, forces the operator to simply wait for a period of time as long as several minutes to ten and several minutes, which is necessary for the heat roller to be again heated to the fixing temperature, e.g., 180° C. or so. This is because the heat roller is usually formed of iron, aluminum or similar metal.

While the surface temperature of the heat roller should immediately be raised to the fixing temperature (within less than 10 seconds) at the time of image formation, power that can be supplied to the heat roller is limited. Further, the heat roller has a great thermal capacity and therefore needs a long warm-up time from the stand-by state. It is therefore necessary to preheat, in the stand-by state, the heat roller for thereby maintaining the surface temperature of the heat roller around a fixable temperature. Preheating consumes much energy despite that the fixing device is not operating. However, if the warm-up time is as short as 5 seconds to 10 seconds, then it is possible to obviate preheating or to preheat the heat roller only to a temperature far lower than the conventional temperature, thereby preventing the operator from wasting time.

To reduce the warm-up time, the tubular base of the heat roller is provided with wall thickness as small as 1 mm to 0.25 mm in order to reduce thermal capacity. The thin wall configuration, however, critically reduces the mechanical strength of the heat roller and causes the roller to easily collapse or deform. Moreover, the thin wall configuration is not attainable without resorting to sophisticated, precision machining technologies, resulting in an increase in cost.

The warm-up time will be reduced if much power can be fed to a heater that heats the heat roller. However, a 100 V, 15A commercial power source is usually shared by the heater, sheet conveying system, image forming section and controller included in the image forming apparatus. While greater power is used for large-scale image forming apparatuses, such apparatuses need extra work for obtaining the greater power with the commercial power source and are limited in location. A chargeable battery is capable of implementing rapid warm-up from the stand-by state without regard to the limit of the commercial power source. A chargeable battery, however, brings about a problem that if a temperature controller is disabled due to some error, then energy continuously fed to the heater at the time of warm-up causes the fixing temperature to sharply rise above an upper limit, resulting in a fire or similar dangerous occurrence.

Moreover, at the beginning and end of the supply of great current, a sharp change in current or a rush current increases a load on the member to be heated. In addition, the rush current flows even to peripheral circuits and produces noise. For this reason, power source from a large capacity, auxiliary power source should not be frequently turned on and turned off. Moreover, instantaneous supply of great power is apt to heat the subject member to an excessive degree.

Safety is another problem with a fixing device featuring an extremely short warm-up time. The temperature of a conventional fixing device of the type continuously receiving constant energy from a commercial power source continuously rises even when temperature control is disabled due to an error. If the temperature elevation is extremely sharp, then a thermostat or safety device cannot follow the temperature elevation and is apt to cause a sheet to ignite.

Various technologies for solving the problems discussed above have been proposed in the past. Japanese Patent Laid-Open Publication No. 10-10913, for example, proposes to feed, in a stand-by state, a voltage lower than a usual voltage by a preselected level to a heat roller to thereby slow down the drop of the temperature of a fixing device. Japanese Patent Laid-Open Publication No. 10-282821 proposes to charge a secondary battery or auxiliary power source in a stand-by state and feed, at the time of warm-up, feed power from both of a main power source and the auxiliary power source, thereby reducing the warm-up time.

Japanese Utility Model Laid-Open Publication No. 63-150967 discloses a fixing device including a first and a second heater respectively powered by an AC power source and a battery that is charged by charging means.

Japanese Patent Laid-Open Publication 3-5779 teaches an image forming apparatus including a fixing device including a press roller that accommodates a main heater and a subheater therein. In this apparatus, a main power source and a storage battery heat the main heater and subheater, respectively. First switching means selectively turns on or turns off the main power source. Charging means charges the storage battery. Second switching means selectively connects the storage battery to the subheater or to the charging means. Temperature sensing means senses the temperature of the press roller. Control means controls the first and second switching means in accordance with the output of the temperature sensing means. When the temperature of the press roller drops below a reference temperature relating to a fixing ability, the control means causes the storage battery to heat the subheater. When the above temperature rises above the reference temperature, the controller stops heating the subheater.

Japanese Patent Laid-Open Publication No. 3-36579 discloses a heating device for fixation including a heater that heats by being supplied with power via heater drive means. The heater drive means includes a chargeable storage battery and a charger connected to a commercial power source for charging the storage battery. The heater is made up of a main heater powered by the commercial power source and an auxiliary heater powered by the storage battery. The storage battery is selectively connected to the charger in the form of a charging circuit or to the auxiliary heater in the form of a discharging circuit. The connection that forms the discharging circuit reduces a warm-up time.

Japanese Patent Laid-Open Publication No. 2000-98799 proposes a heating device for fixation including a heater that heats by being applied with power and heater drive means for feeding power to the heater. The heater drive means includes a chargeable storage battery and a charger connected to a commercial power source for charging the storage battery. The heater includes a main and an auxiliary heater respectively powered by the commercial power source and storage battery. The storage battery is charged when the main heater is turned off.

Other technologies relating to the present invention are disclosed in e.g., Japanese Utility Model No. 7-41023, 10-232821, 2000-315567 and 2001-66926.

SUMMARY OF THE INVENTION

It is an object of the present invention to provide a heating device capable of saving power and obviating noise ascribable to a rush current and a sharp change in current when great current is supplied, a fixing device using the same, and an image forming apparatus including the fixing device.

It is another object of the present invention to provide a heating device capable of being rapidly warmed up from a stand-by state without regard to the limit of a commercial power source, a fixing device using the same, and an image forming apparatus including the fixing device.

It is still another object of the present invention to provide a heating device free from excessive temperature elevation, a fixing device using the same, and an image forming apparatus including the fixing device.

It is a further object of the present invention to provide a heating device insuring safety when temperature control is disabled.

A heating device of the present invention includes a main power source and an auxiliary power source implemented by a chargeable capacitor. A heater is made up of a main heating element that heats when supplied with power from the main power source and an auxiliary heating element that heat when supplied with power from the auxiliary power source. A charger charges the capacitor of the auxiliary power source when supplied with power from the main power source. A switch selectively causes the auxiliary power source to be charged or to feed power to the auxiliary heating element. A controller adjusts the power to be fed from the auxiliary power source to the auxiliary heating element.

A fixing device using the heating device of the present invention and an image forming apparatus including the fixing device are also disclosed.

BRIEF DESCRIPTION OF THE DRAWINGS

The above and other objects, features and advantages of the present invention will become more apparent from the following detailed description taken with the accompanying drawing in which:

FIG. 48 is a table showing the characteristic of a proton polymer battery;

DESCRIPTION OF THE PREFERRED EMBODIMENTS

Figure 1:
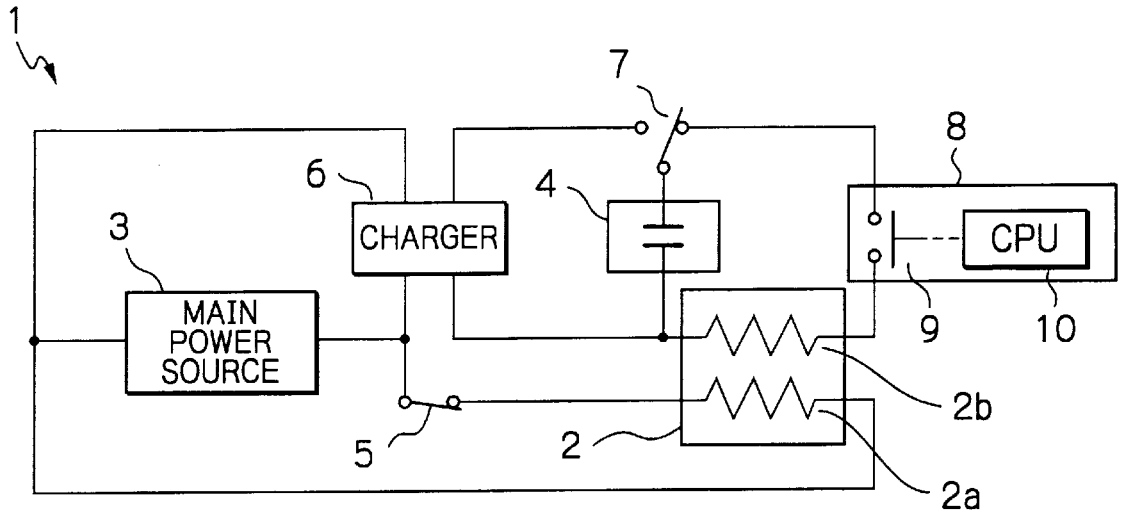
FIG. 1 is a circuit diagram showing a first embodiment of the heating device in accordance with the present invention.

Preferred embodiments of the present invention will be described hereinafter. It is to be noted that identical reference numerals used in the embodiments do not always designate identical structural elements.

First Embodiment

Referring to FIG. 1 of the drawings, a heating device embodying the present invention is shown and generally designated by the reference numeral 1. As shown, the heating device 1 includes a heater 2, a main power source 3, an auxiliary power source 4, a main switch 5, a charger 6, switch 7, and a controller 8.

The heater 2 includes a main heating element 2*a* and an auxiliary heating element 2*b* for heating a desired object. The main power source 3 and auxiliary power source 4 feed power to the main and auxiliary heating elements 2*a* and 2*b*, respectively. The main power source 3 is connected to an outlet located at a place where the heating device 1 is situated. The main power source 3 matches a voltage to the heater 2 and rectifies AC and DC. The auxiliary power source 4 includes a chargeable capacitor. For this capacitor, use may be made of, e.g., an electric double-layer capacitor developed by Nippon Chemicon Co., Ltd. or a capacitor HIPER CAPACITOR (trade name) available from NEC Corp. The double-layer capacitor has a capacity of about 2000 F sufficient for power supply for several seconds to several ten seconds while HYPER CAPACITOR has a capacity of about 80 F.

The main switch 5 selectively connects the main power source 3 to the main heating element 2*a* or disconnects the former from the latter. The charger 6 charges the auxiliary power source 4, which includes a capacitor, with power fed from the main power source 3. The switch 7 switches the charging of the auxiliary power source 4 and the power source from the auxiliary power source 4 to the auxiliary heating element 2*b*. The controller 8 includes a switch 9 and a CPU 10 and selectively ON/OFF controls power to be fed from the auxiliary power source 4 to the auxiliary heating element 2*b* under a preselected condition.

In operation, in the stand-by state, the switch 7 connects the charger 6 to the auxiliary power source 4 in order to charge the power source 4. When the main switch 5 is turned on to operate the heating device 1, the main power source 3 feeds power to the main heating element 2*a*. At the same time, the controller 8 operates the switch 7 in order to cause the auxiliary power source 4 to feed power to the auxiliary heating element 2*b*. As a result, great power is fed to the heating device 2 at a time, heating the heater 2 to a preselected temperature in a short period of time.

When a preselected period of time expires since the power supply from the auxiliary power source 4 to the auxiliary heating element 2*b*, the controller 8 disconnects the heating element 2*b* from the power source 4 via the switch 7, thereby protecting the heater 2 from overheating. More specifically, the power being fed form the auxiliary power source 4 to the auxiliary heating element 2*b* decreases little by little with the elapse of time. The above period of time is selected on the basis of the decrease in the power being fed from the auxiliary power source 4 to the auxiliary heating element 2*b*. When the power decrease to a certain degree, the controller 8 shuts off the power supply from the auxiliary power source 4 to the auxiliary heating element 2*b*, as stated above. This successfully obviates the deterioration of the parts of circuitry around the heating device 1 and electromagnetic noise otherwise occurring due to the shut-off of great power.

When the controller 8 disconnects the auxiliary heating element 2 from the auxiliary power source 4, as stated above, the power source 4 is short of charge. The controller 8 therefore connects the switch 7 to the charger 6 when the heater 2 is held at stable temperature while consuming a minimum of power. Consequently, the charger 6 charges the auxiliary power source 6 with power being fed from the main power source 3. When the heater 2 again needs great power later, both the main power source 3 and auxiliary power source 4 again feed great power to the heater 2 in combination.

The capacitor of the auxiliary power source 4 differs from a secondary battery in that it is free from chemical reactions, and therefore has the following advantages. When a conventional nickel-cadmium battery is used as an auxiliary power source, it takes several hours for the battery to be fully charged even by rapid charging. By contrast, the power source 4 using a capacitor can be fully charged in about several minutes. It follows that when the heating device 1 repeats its stand-by state and heating state for a given period of time, the power source 4 can surely feed power at the beginning of the heating state, allowing the heater 2 to rapidly reach the preselected temperature. Further, the allowable limit of repeated charging and discharged available with a nickel-cadmium battery is not greater than 500 times to 1,000 times. This kind of battery is therefore too short in life to serve as an auxiliary battery and consequently undesirable from the replacement and cost standpoint. The allowable limit of repeated charging and discharging particular to the power source 4 is great as about 10,000 times or more. Moreover, the power source 4 suffers from a minimum of deterioration ascribable to repeated charging and discharging. In addition, the power source 4 does not need almost any maintenance, which is necessary with a lead storage battery, and can therefore stably operate over a long period of time.

Figure 2:
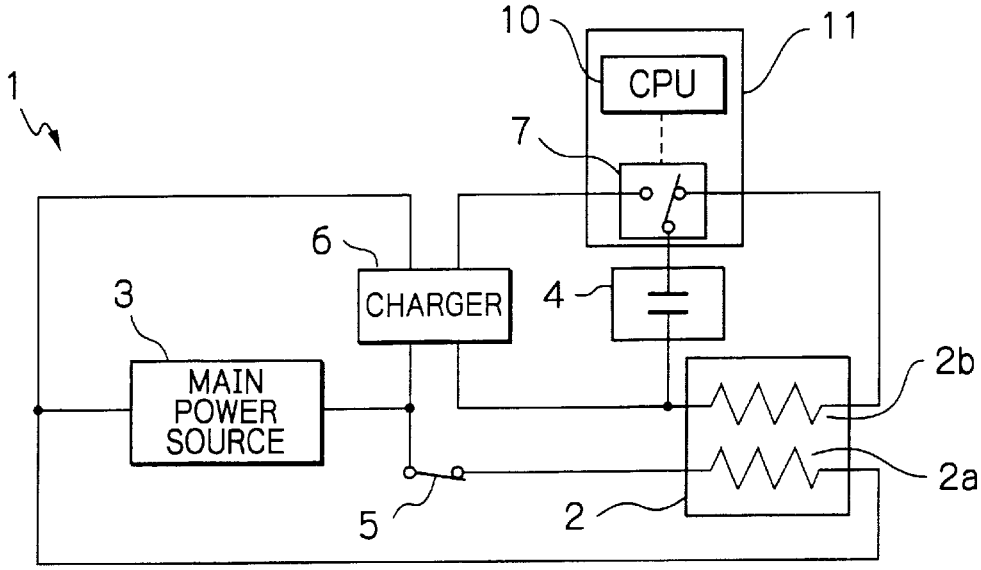
FIGS. 2 through 9 are circuit diagrams respectively showing a first to an eighth modification of the illustrative embodiments.

FIG. 2 shows a modification of the illustrative embodiment. As shown, the modification includes a charge/discharge switching device 11 including the CPU 10 and switch 7. The charge/discharge switching device 11 selectively sets up power supply from the auxiliary power source 4 to the auxiliary heating element 2*b*.

Figure 3:
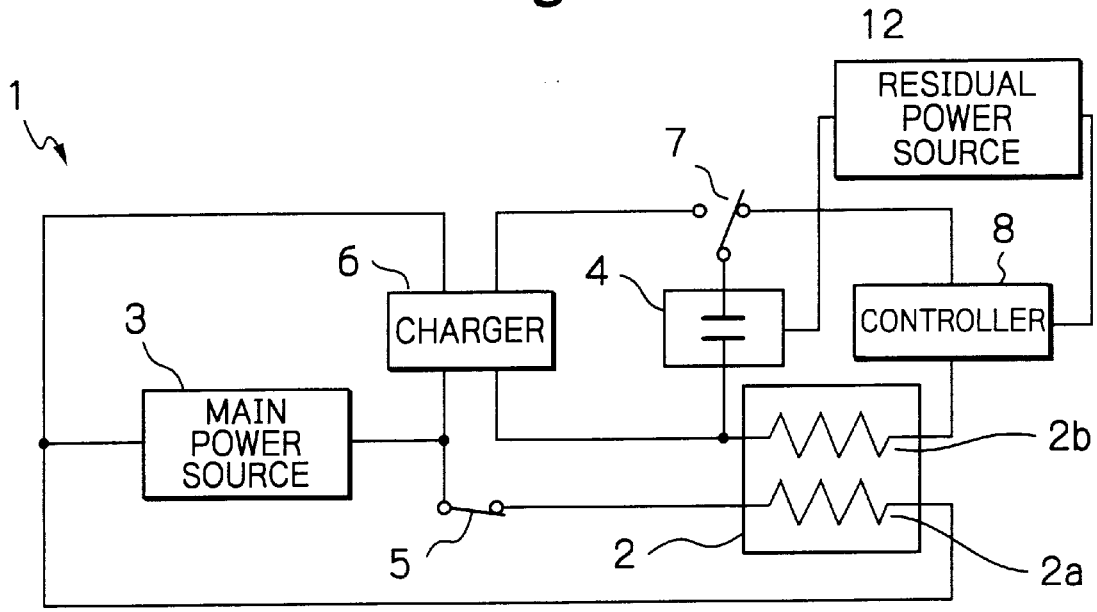
Figure 4:
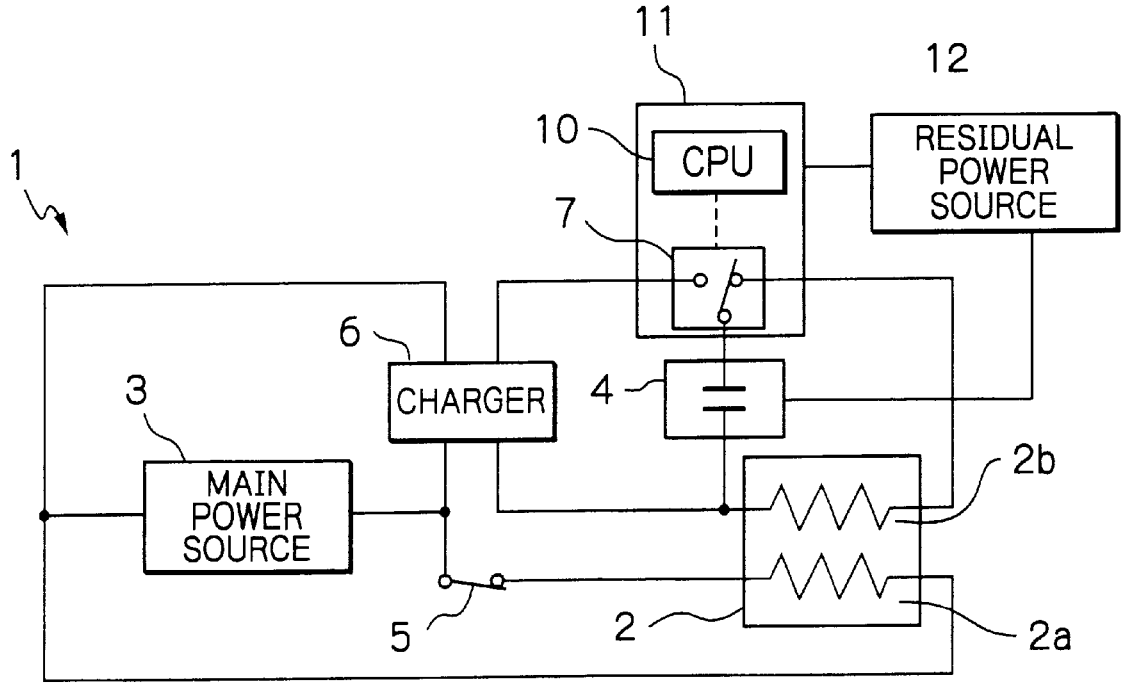

FIG. 3 shows another modification of the illustrative embodiment. As shown, the modification additionally includes a residual power detector 12 connected to the auxiliary power source 4 and controller 8. The residual power detector 12 is responsive to the residual power of the auxiliary power source 4. Assume that while the auxiliary power source is feeding power to the auxiliary heating element 2*b*, the residual power detector 12 determines that the power remaining in the power source 4 has lowered to a preselected value. Then, the controller 8 shuts off the power supply from the auxiliary power source 4 to the auxiliary heating element 2*b*. Alternatively, as shown in FIG. 4, the charge/discharge switching device 11 may shut off the above power supply.

The modifications described above also successfully obviate the deterioration of the parts of circuitry around the heating device 1 and electromagnetic noise otherwise occurring due to the shut-off of great power.

Figure 5:
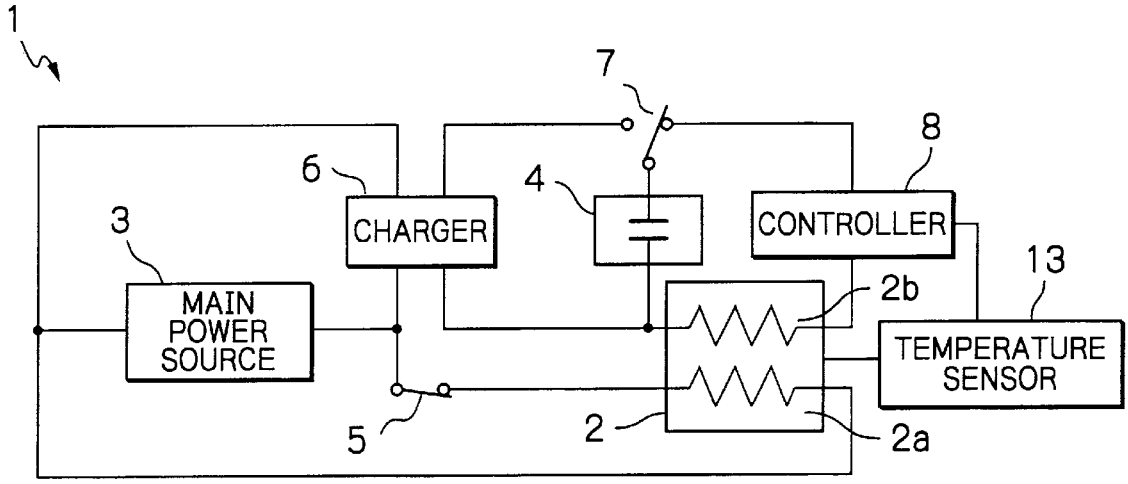

FIG. 5 shows another modification of the illustrative embodiment. As shown, the modification includes a thermistor, thermocouple, radiation thermometer or similar temperature sensor 13. The temperature sensor 13 senses the temperature of the heater 2 when the main power source 3 and auxiliary power source 4 are feeding power to the main heating element 2*a* and auxiliary heating element 2*b*, respectively. When the temperature of the heater 2 reaches a preselected upper limit, the controller 8 shuts off the power supply from the auxiliary power source 4 to the auxiliary heating element 2*b*. The controller 8 may, of course, be replaced with the charge/discharge switching device 11. Assume that the temperature 2 being sensed by the temperature sensor 13 drops to a preselected lower 14 limit when the power supply from the auxiliary power source 4 to the auxiliary heating element 2*b* is shut off. Then, the controller 3 again causes the auxiliary power source 4 to resume power supply to the auxiliary heating element 2*b*.

As stated above, by ON/OFF controlling the power supply from the auxiliary power source 4 to the auxiliary heating element 2*b*, it is possible to prevent the heater 2 from being overheated without controlling power supply from the main power source 3 to the main heating element 2*a*.

Figure 6:
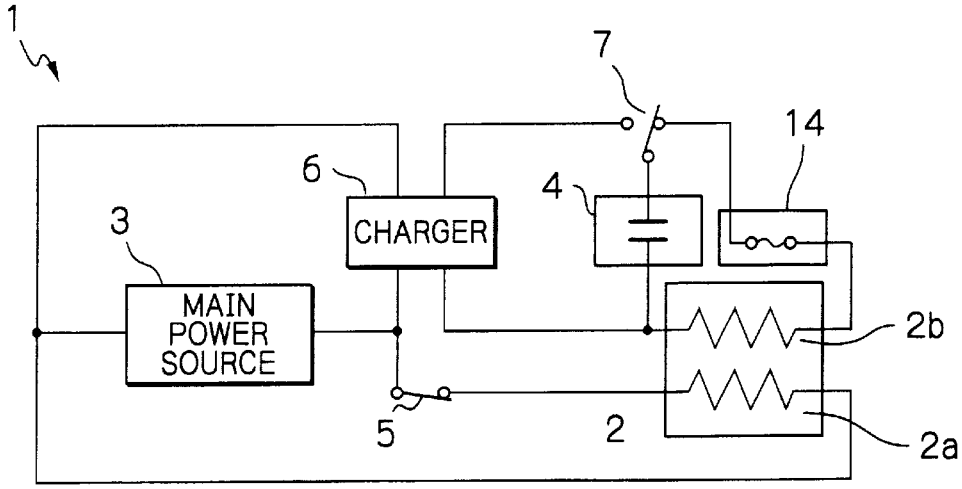

FIG. 6 shows another modification of the illustrative embodiment. As shown, a thermostat or similar temperature controller 14 adjoins the heater 2. When the temperature of the heater 2 rises to a preselected value, the temperature controller 15 shuts off power supply from the auxiliary power source 4 to the auxiliary heating element 2*b*. The temperature controller 14 may additionally include a temperature fuse or similar anti-overheat member in order to more surely protect the heater 2 from overheating.

Figure 7:
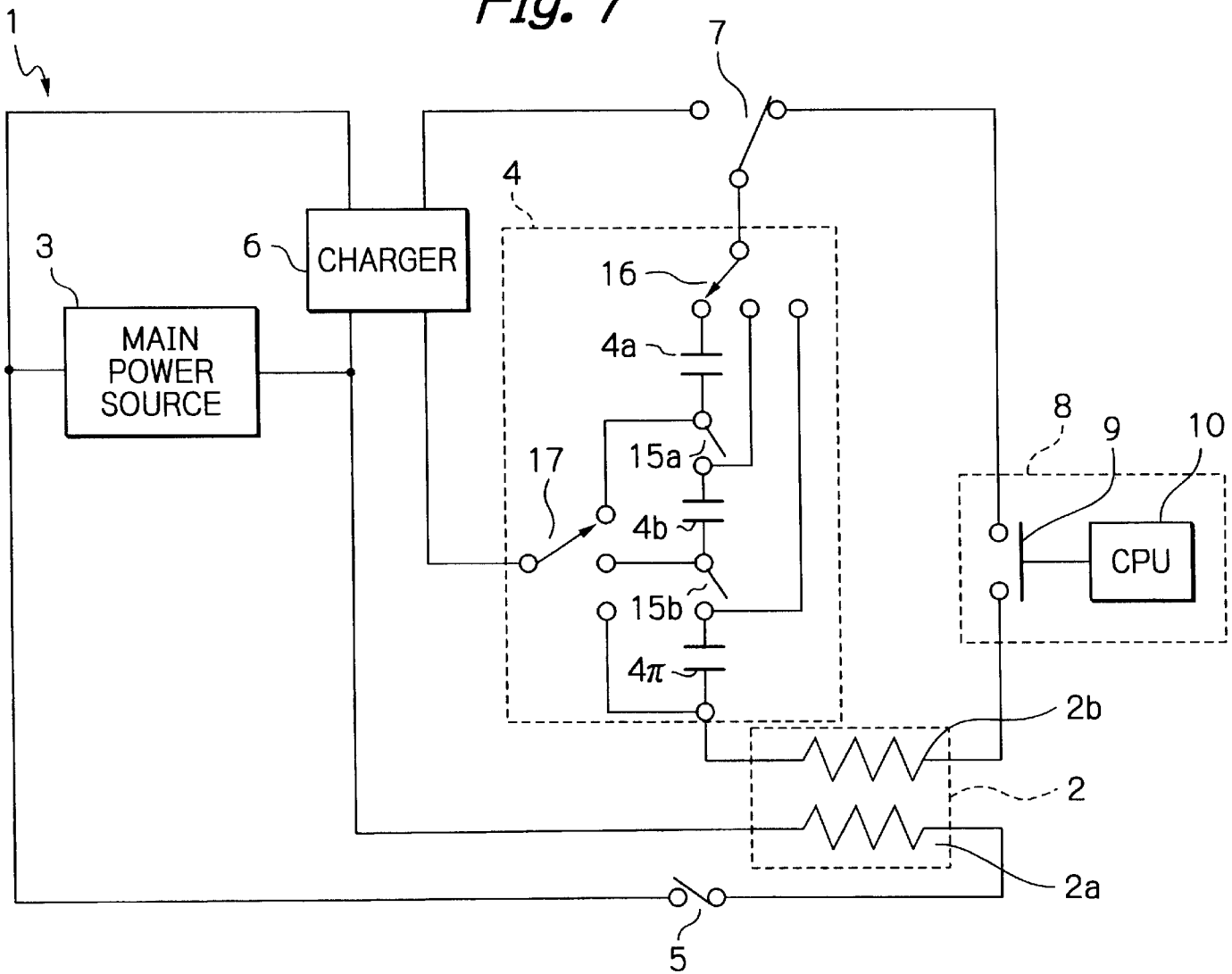

As shown in FIG. 7, the auxiliary power source 4 may be implemented by a serial connection of a plurality of capacitors or cells 4*a* through 4*n*. When the auxiliary power source 4 is required to output a voltage of 60 V, five 12 V capacitors will be connected in series. To charge the capacitors 4*a* through 4*n* one by one, this modification additionally includes switches 15*a* and 15*b* for switching the capacitors 4*a* through 4*n* and switches 16 and 17 for selectively connecting or disconnecting the capacitors 4*a* through 4*n* to or from the charger 6. More specifically, to charge the capacitor 4*a* by way of example, the switch 7 is connected to the charger 6. At the same time, the switches 15*a* and 15*b* are turned off while the switches 16 and 17 are connected to the capacitor 4*a* to thereby charge the capacitor 4*a*. As soon as the capacitor 4*a* is fully charged, the switches 15 and 17 are connected to the next capacitor 4*b*. This operation 13 repeated until the last capacitor 4*n* has been charged.

After all of the capacitors 4*a* through 4*n* have been charged, the switches 15*a* and 15*b* are turned on to serially connect the capacitors 4*a* through 4*n*. When the heating device 1 heats the heater 2, the switch 7 is connected to the auxiliary heating element 2*b* while the switch 16 is connected to the capacitor 4*a*. As a result, power is fed from the capacitors 4*a* through 4*n* to the auxiliary heating element 2*b*.

As stated above, power is fed from the serial connection of the capacitors 4*a* through 4*n* to the auxiliary heating element 2*b*, so that the capacitors 4*a* through 4*a* constitute a high-tension auxiliary power source. Further, because the capacitors 4*a* through 4*n* are charged one by one, the charger 6 can be implemented by a low voltage, low cost charger. This reduces not only the cost but also the overall size of the heating device 1.

Figure 8A:
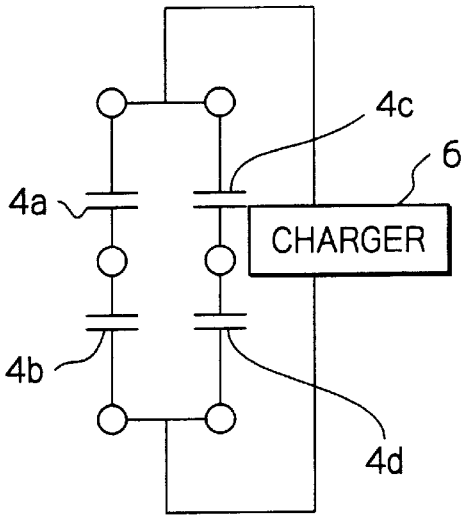
Figure 8B:
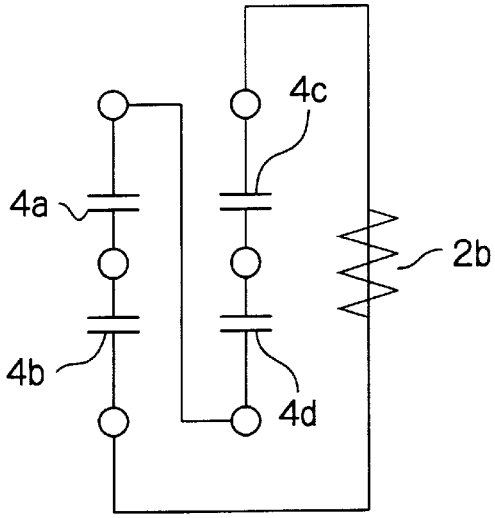

FIGS. 8A and 8B show another modification of the illustrative embodiment. As shown in FIG. 8B, a plurality of capacitors or cells 4*a* through 4*d* are serially connected when feeding power to the auxiliary heating element 2*b*. As shown in FIG. 8A, to charge the capacitors 4*a* through 4*d*, the charger 6 is connected to a serial connection of the capacitors 4*a* and 4*b* and a serial connection of the capacitors 4*c* and 4*d*; the two serial connections are connected in parallel to each other. In this condition, the charger 6 charges the capacitors 4*a* through 4*c* at the same time and thereby reduces irregularity in charge. Further, when power should be fed to the auxiliary heating element 2*b* before all of the capacitors 4*a* through 4*d* are fully charged, the capacitors 4*a* through 4*d* are well balanced as to the amount of charge. This insures stable power source to the auxiliary heating element 2*b*.

Figure 9A:
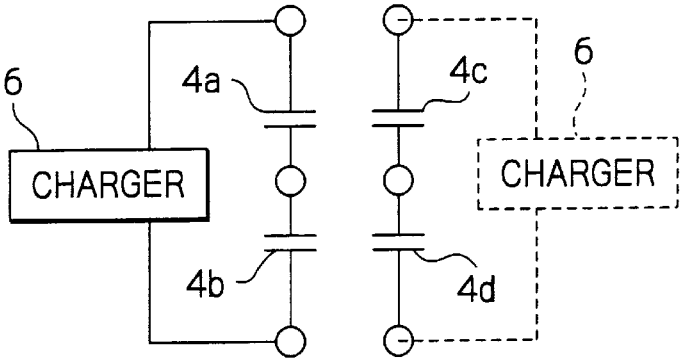
Figure 9B:
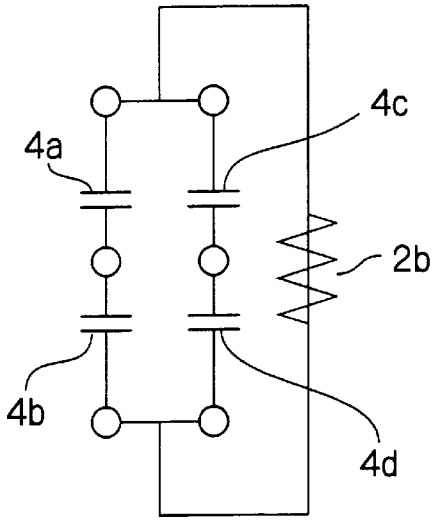

Alternatively, as shown in FIG. 9B, to feed power to the auxiliary heating element 2*b*, a serial connection of the capacitors or cells 4*a* and 4*b* and, a serial connection of the capacitors or cells 4*c* and 4*c* may be connected in parallel. In this case, as shown in FIG. 9B, to charge the capacitors 4*a* through 4*d*, the serial connection of the capacitors 4*a* and 4*b* and the serial connection of the capacitors 4*c* and 4*d* will be charged independently of each other. This configuration is also successful to lower the voltage required of the charger 6.

Figure 10:
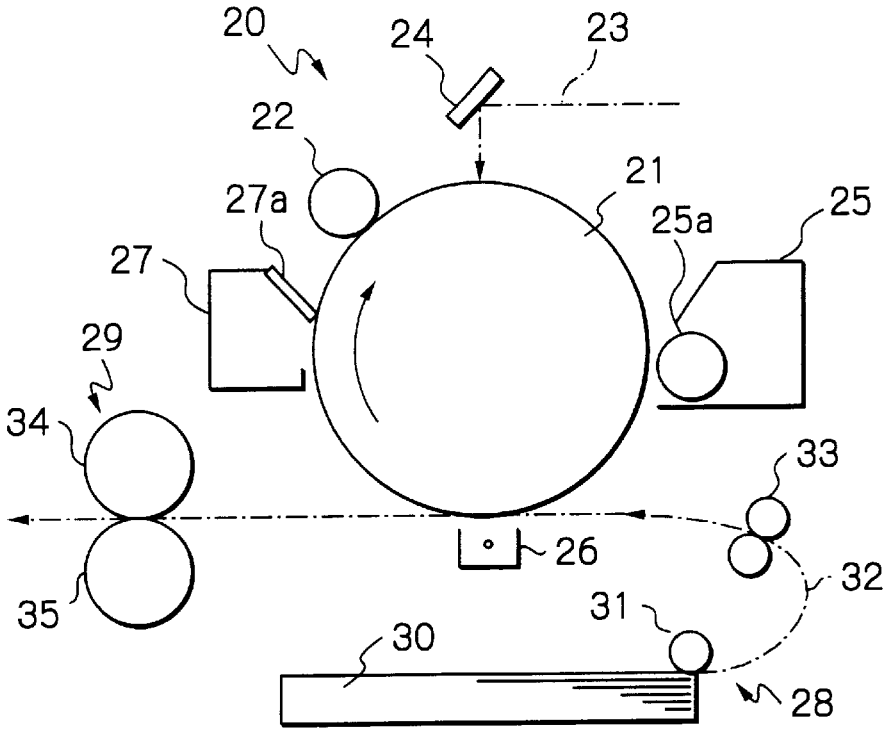
FIG. 10 is a view showing an image forming apparatus to which the illustrative embodiment modifications thereof are applied.

Reference will be made to FIG. 10 for describing an image forming apparatus including a fixing unit that uses the heating device 1. As shown, the image forming apparatus, generally 20, includes a photoconductive element implemented as a drum 21, which is rotatable in a direction indicated by an arrow. A charger 22, a mirror 24, a developing device 25, an image transferring device 26 and a cleaning unit 27 are sequentially arranged in this order around the drum 21 in a direction of rotation of the drum 21. More specifically, the mirror 24 is positioned downstream of the charger 22 in the direction of rotation of the drum 21 and forms part of an optical writing unit. The mirror 24 reflects a laser beam 23 toward the surface of the drum 21. The developing device 25 is positioned downstream of the writing unit and includes a developing roller 25*a*. The image transferring device 26 is positioned downstream of the developing device 25. The cleaning unit 27 is positioned downstream of the developing unit 26 and includes a cleaning blade 27*a*.

The apparatus 20 additionally includes a sheet feeder 28 and a fixing device 29. The sheet feeder 25 includes a sheet tray 20 loaded with a stack of sheets 30, a pickup roller 31, a sheet path 32, and a registration roller pair 33. The sheet feeder 28 feeds the sheets from the sheet tray 20 to the image transferring device 26 one by one.

Figure 11:
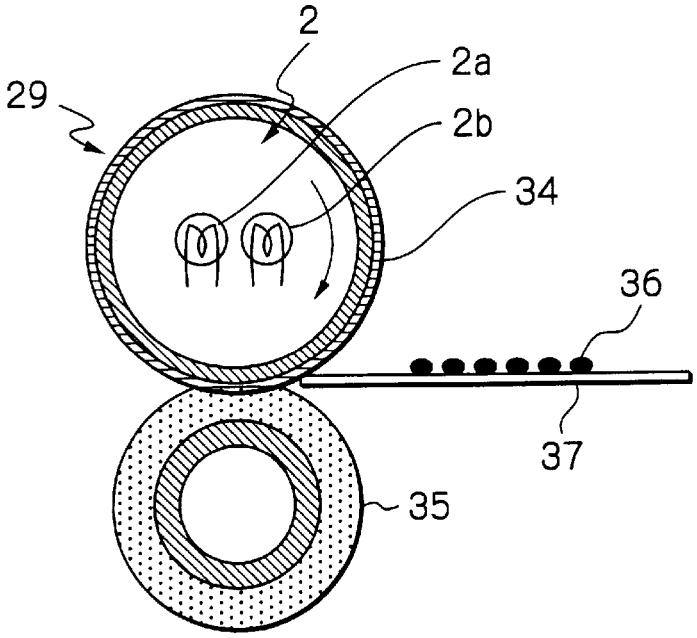
FIG. 11 is a section showing a fixing device included in the apparatus of FIG. 10.

As shown in FIG. 11, the fixing device 29 includes a heat roller or fixing member 34 and a press roller or pressing member 35. The heat roller 34 accommodates therein the heater 2 made up of the main heating element 2*a* and auxiliary heating element 2*b*. The main heating element 2*a* may be implemented by a halogen heater by way of example. The main power source 3 and auxiliary power source 4 stated earlier feed power to the main heating element 2*a* and auxiliary heating element 2*b*, respectively. The power fed from the auxiliary power source 4 is selectively shut off in order to maintain the heater 2 at a preselected temperature, as described previously.

In operation, while the drum 21 is in rotation, the charger 22 uniformly charges the surface of the drum 21. The writing unit scans the charged surface of the drum 21 with a laser beam 23 modulated in accordance with image data via the mirror 24, thereby forming a latent image on the drum 21. The developing device 25 develops the latent image with toner to thereby produce a corresponding toner image. The pickup roller 31 pays out one sheet from the sheet tray 30 to the registration roller pair 33 along the sheet path 32. The registration roller pair 33 once stops the sheet and then drives it toward the image transferring device 26 at such a timing that the leading edge of the sheet meets the leading edge of the toner image carried on the drum 21. The image transferring device 26 transfers the toner image from the drum 21 to the sheet. The sheet is then conveyed to the fixing unit 29. The cleaning unit 27 removes the toner left on the drum 21 after the image transfer.

In the fixing unit 29, the sheet carrying the toner image thereon is passed through a nip between the heat roller 34 and the press roller 35. The heat roller 34 held at a preselected temperature melts the toner while the press roller 35 presses the sheet against the heat roller 34. As a result, the toner image, labeled 36 in FIG. 11, is fixed on the sheet 37 labeled 37 in FIG. 11. At this instant, the circuitry stated earlier prevents the heat roller 34 from being excessively heated and thereby allows it to stably melt the toner on the sheet. The toner image 36 can therefore be desirably fixed on the sheet 37. Further, both the main power source 3 and auxiliary power source 4 feed power to the heat roller 34 at the same time, so that the surface temperature of the heat roller 34 can be rapidly elevated to a preselected value.

Second Embodiment

Figure 12:
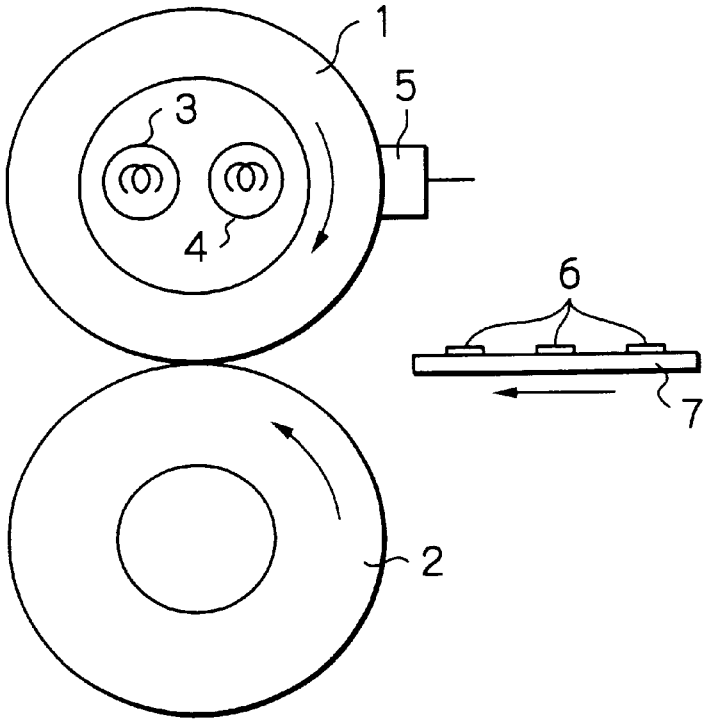
FIG. 12 is a section showing a second embodiment of the present invention.

A fixing device representative of an alternative embodiment of the present invention will be described with reference to FIG. 12. As shown, the fixing device includes a heat roller or fixing member 1 and a press roller or pressing member 2 pressed against the heat roller 2 by biasing means not shown. The press roller 2 is formed of silicone rubber or similar elastic material. Of course, one or both of the heat roller 1 and press roller 2 may be implemented as endless belts, if desired.

The fixing device includes a first heating element 3 and a second heating element 4 that generate heat when supplied with power. In the illustrative embodiment, the two heating elements 3 and 4 are accommodated in the heat roller 1 for heating the heat roller 1 from the inside of the roller 1. A drive mechanism, not shown, causes the heat roller 1 and press roller 2 to rotate. A temperature sensor 5 is held in contact with the heat roller or heating member 1 (or the press roller or pressing member 2) in order to sense the surface temperature of the roller 1. When a paper sheet or similar sheet-like recording medium 7 passes through a nip between the heat roller 1 and the press roller 2, the two rollers 1 and 2 fix a toner image 6 formed on the sheet 7 with heat and pressure.

Figure 13:
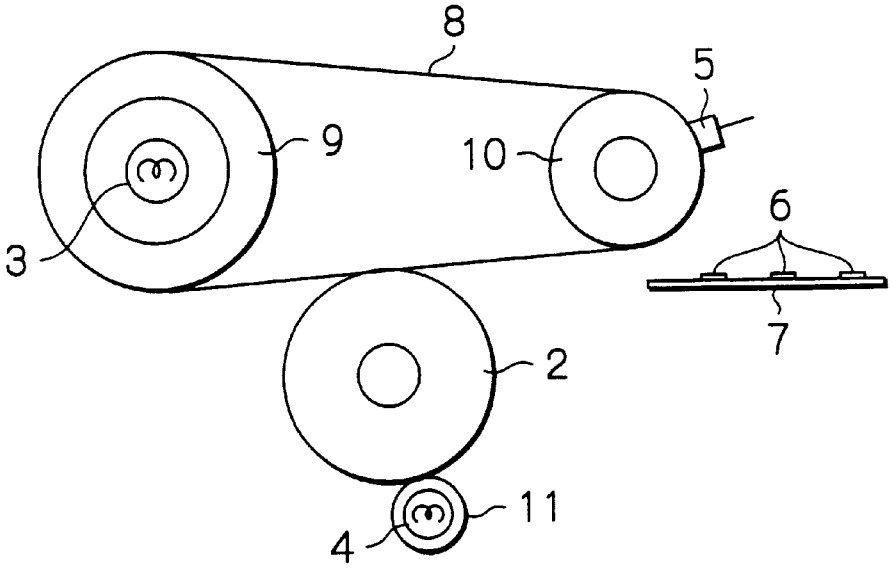
FIG. 13 is a section showing a modification of the second embodiment in which an endless belt is used as a fixing member.

As shown in FIG. 13 specifically, assume that the heat roller 1 is replaced with an endless belt 8. Then, the belt 8 is passed over at least two rollers 9 and 10. The press roller 2 is pressed against the belt 8 by biasing means not shown. The first and second heating elements 3 and 4 may be located at any suitable positions so long as they can heat the belt 8 and press roller 2, respectively. In the specific configuration shown in FIG. 13, the first heating element 3 is disposed in the roller 9 in order to heat the roller 9; in this sense the roller 9 plays the role of a heat roller that heats the belt 8. The first heat roller 3 may be disposed in the other roller 10, if desired. The second heating element 4 is disposed in an auxiliary heat roller 11 that contacts the circumference of the press roller 2. The heating element 4 heats the press roller 2 by way of the auxiliary heat roller 11. The heating element 4 may, of course, be disposed in the press roller 2 or in the roller 9 or 10 together with the heating element 3.

In FIG. 13, the roller 10 is a drive roller and driven by a mechanism, not shown, to cause the belt 8 to run. When sheet 7 carrying the toner image 6 thereon passes through the nip between the belt 8 and the press roller 2, the belt 8 and press roller 2 cooperate to fix the toner image 6 on the sheet 7 with heat and pressure. In this case, the temperature sensor 5 is responsive to the surface temperature of the belt 8.

Figure 14:
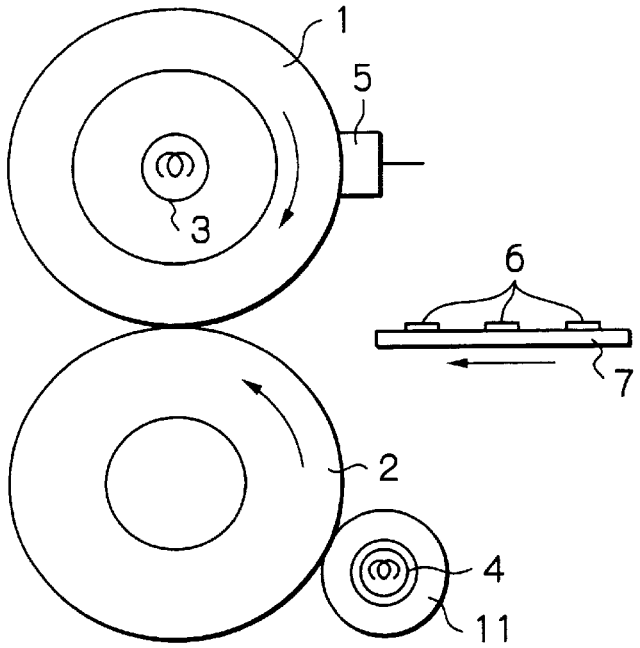
FIG. 14 is a section showing another modification of the second embodiment in which a fixing roller and an auxiliary heat roller are used.

As shown in FIG. 14, when use is made of the heat roller 1, an arrangement may also be made such that the auxiliary heat roller 11 contacts the press roller 2. In this case, the second heating element 4 heats the press roller 2 by way of the auxiliary heat roller 11.

Figure 15:
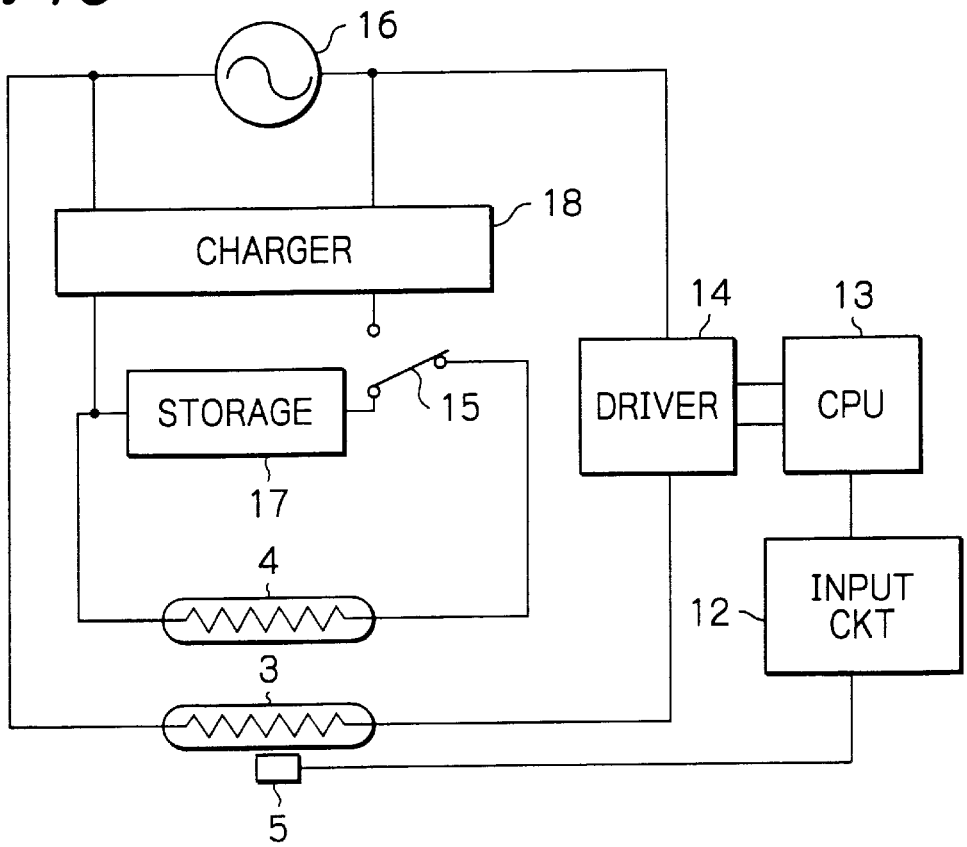
FIG. 15 is a schematic block diagram showing a control system included in the second embodiment.
Figure 16:
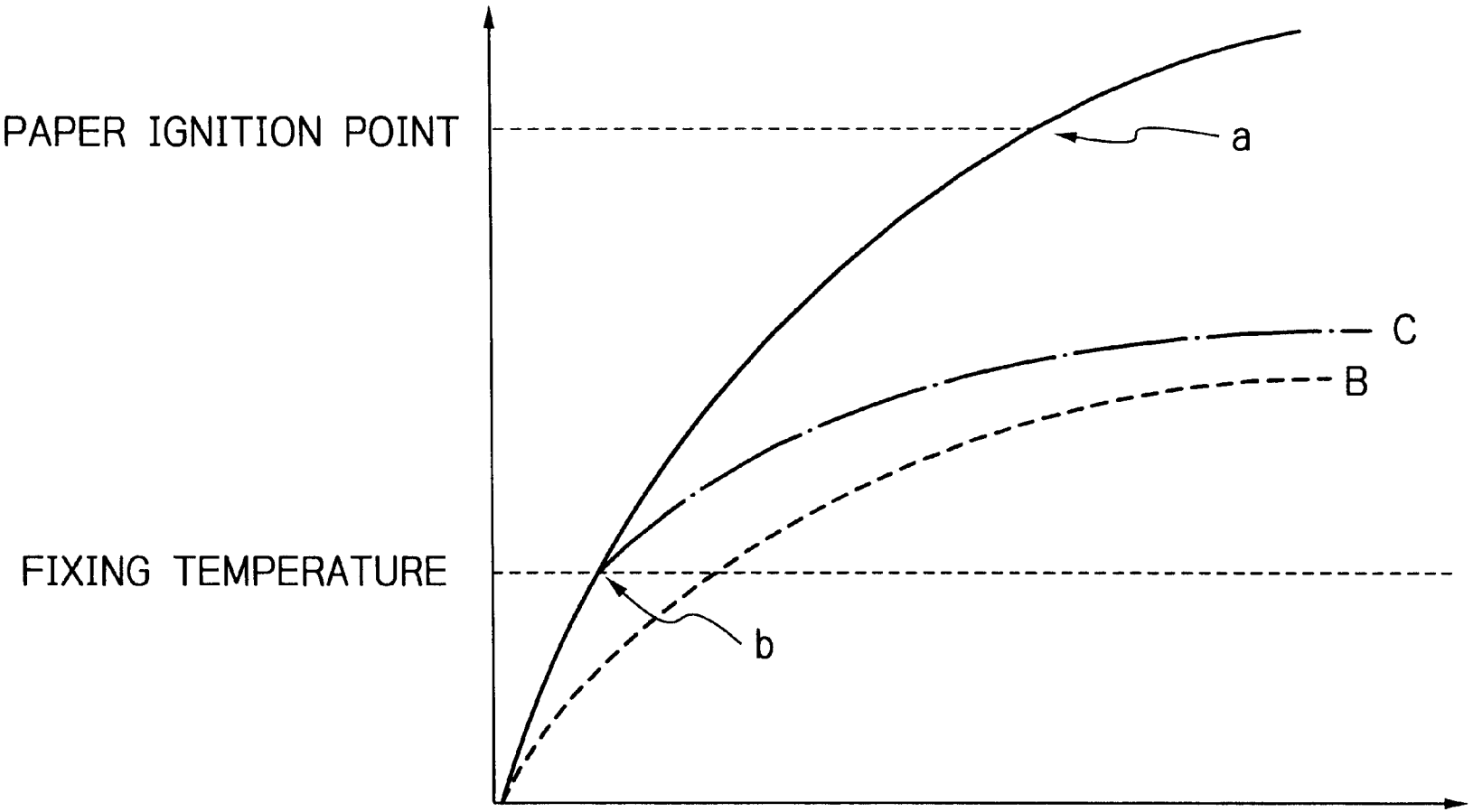
FIG. 16 is a graph comparing the second embodiment and a conventional fixing device with respect to temperature elevation.

FIG. 15 shows circuitry for controlling the fixing device of the illustrative embodiment. As shown, the output of the temperature sensor 5 is input to a CPU or control means 13 via an input circuit 12. The CPU 13 controls, based on the output of the temperature sensor 5, power supply to the first heating element 3 via a driver 14 such that the surface temperature (fixing temperature) of the heat roller 1 remains at a preselected value. In addition, the CPU 13 controls power supply to the second heater 4 via a switch 15.

The first heating element 3 is connected to a commercially available power source 16 via the driver 14. The driver 14 controls power supply from the commercial power source 16 to the first heating element 3 under the control of the CPU 13. The CPU 13 selectively connects a storage 17 to a charger 18 or the second heating element 4, depending on whether or not the fixing device is in operation. The storage 17 is implemented by, e.g., a capacitor or similar storage capable of being rapidly charged or discharged within the warm-up time of the fixing device from the stand-by state.

More specifically, in the stand-by state of the fixing device, the CPU 13 connects the storage 17 to the charger 18 via the switch 15. In this condition, AC power output from the commercial power source 16 is transformed to DC power and then applied to the storage 17, thereby charging the storage 17. When the fixing device is in operation, the CPU 13 connects the storage 17 to the second heating element 4 via the switch 15 with the result that the AC power output from the storage 17 drives the second heating element 4.

In the configuration described above, when the fixing device starts operating, the AC power fed from the commercial power source 16 via the driver 14 and the DC power fed from the storage 17 respectively drive the first and second heating elements 3 and 4 at the same time. As a result, the surface temperature of the heat roller 1 rapidly elevates to the preselected value. Subsequently, the CPU 13 controls the power supply to the heating element 3 via the driver 14 such that the surface temperature of the heat roller 1 remains at the preselected value.

The second heating element 4 is driven only at the beginning of operation of the fixing unit. Specifically, after the surface temperature at the heat roller 1 has reached the preselected value, only the first heating element 3 is selectively turned on or turned off to maintain the preselected temperature of the heat roller 1. The duration of the drive of the heating element 4 by the DC power output from the storage 17 is selected to be shorter than a preselected period of time. This preselected period of time should preferably be the warm-up time of the fixing device from the stand-by state.

In the illustrative embodiment, the storage or capacitor 17, which is chargeable and dischargeable, feeds power to the second heating element in order to reduce the warm-up time of the fixing device, as stated earlier. Therefore, the storage 17 runs out of charge after the warm-up of the fixing device, i.e., power supply from the storage 17 to the second heating element 4 ends. This prevents excess energy from being fed to the heating element 4 after the warm-up.

FIG. 6 shows a relation between the temperature of the fixing unit and time with respect to three different cases. In FIG. 6, a curve A shows temperature elevation effected by rapid charging without any temperature control. A curve B shows temperature elevation particular to a conventional fixing device and effected by ordinary charging without temperature control. Further, a curve C shows temperature elevation available with the illustrative embodiment by charging without temperature control. A point a indicates a temperature at which a sheet ignites while point b indicates a temperature at which power supply to the second heating element 4 ends. As FIG. 6 indicates, the curve C rises more slowly than the curve B after the preselected temperature has been reached. The illustrative embodiment is therefore advantageous over any one of conventional fixing devices configured to reduce the warm-up time from the safety standpoint, e.g., when temperature runs out of control due to an error.

In the energy saving aspect, it is necessary to interrupt power supply to a heater in a stand-by state or to rapidly raise the temperature of the heater to a preselected value at the beginning of operation. The illustrative embodiment can feed power exceeding the limit of power available with the commercial power source 16 only at the beginning of operation. This successfully saves energy while guaranteeing safety when the heater runs out of control.

Figure 17:
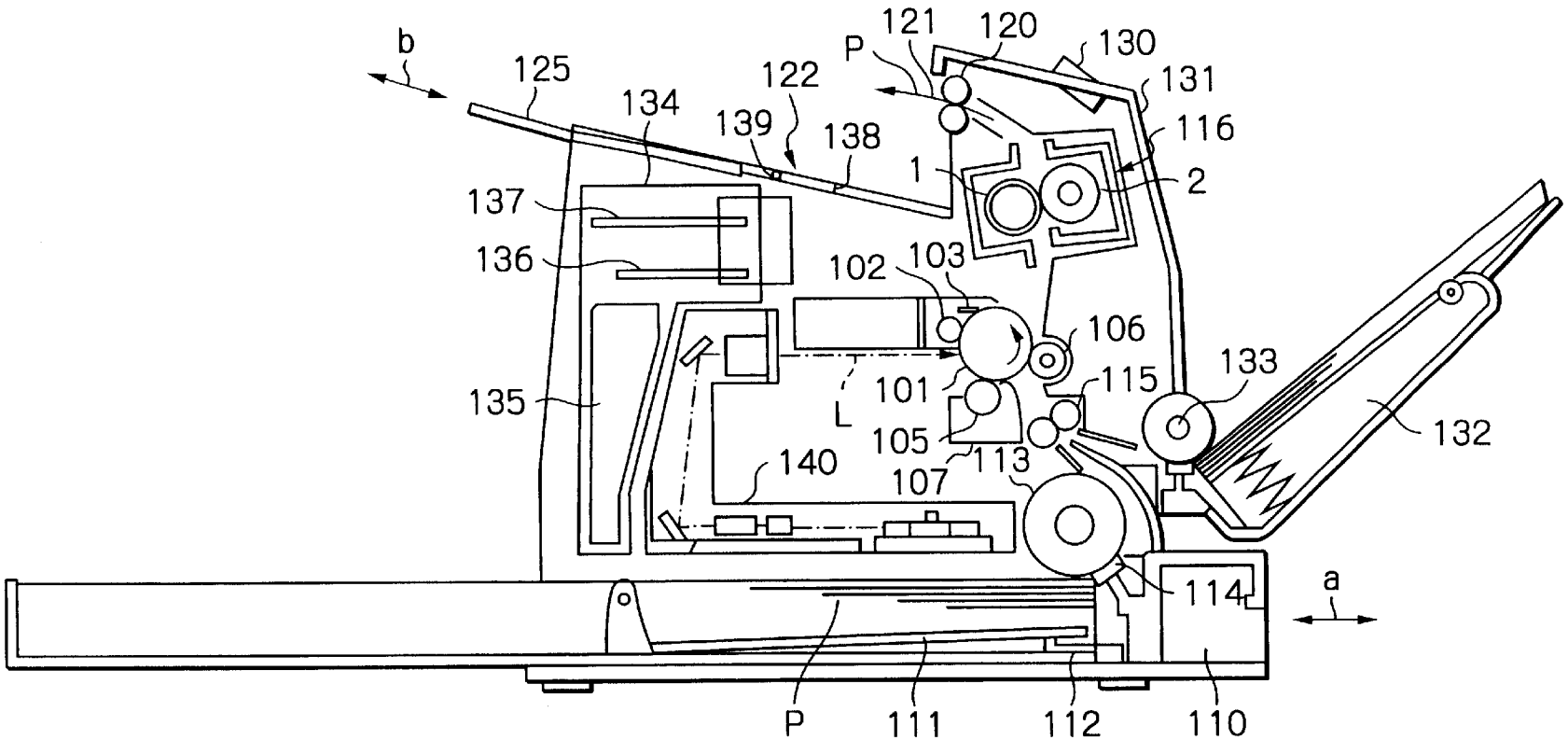
FIG. 17 is a section showing an image forming apparatus to which the second embodiment is applied.

Reference will be made to FIG. 17 for describing an image forming apparatus including the fixing device of the illustrative embodiment. As shown, the image forming apparatus includes a photoconductive drum or image carrier 101, which is rotatable in a direction indicated by an arrow. A charger 102, a cleaning unit 103, a developing unit 107 and an image transferring device 106 are sequentially arranged around the drum 101. The developing unit 107 includes a sleeve 105 and develops a latent image formed on the drum 101.

In operation, while a drive mechanism, not shown, causes the drum 101 to rotate, the charger 102 uniformly charges the surface of the drum 101. Laser optics 140 scans the charged surface of the drum 101 with a laser beam L modulated in accordance with image data, thereby forming a latent image on the drum 101. The developing unit 107 develops the latent image with toner to thereby produce a corresponding toner image. The image transferring device 106 transfers the toner image from the drum 101 to a paper sheet or similar sheet-like recording medium. The cleaning unit 103 removes the toner left on the drum 101 after the image transfer. In this sense, the charger 102, laser optics 140 and developing unit 107 constitute image forming means.

A sheet feeder is mounted on the bottom of the apparatus and includes a removable sheet cassette loaded with a stack of sheets P (sheet 7). More specifically, a bottom plate 111 supporting the sheets P is constantly biased upward by a spring, not shown, pressing the sheets P against a pickup roller 113. When a controller, not shown, outputs a sheet feed command, the pickup roller 113 starts rotating and pays out the top sheet from the sheet cassette 110. At this instant, a pad 114 prevents the sheets P underlying the top sheet P from being paid out together. The top sheet is conveyed to a registration roller pair 115.

An operation panel 130 is mounted on the right side of the apparatus, as viewed in FIG. 17, and protrudes above a cover 131. A manual feed tray 132 is mounted on the apparatus and angularly movable about a pin 133. A pickup roller associated with the manual feed tray 132 sequentially feeds sheets stacked on the tray 132 toward the registration roller pair 115. A pad cooperates with the pickup roller to feed only the top paper sheet at a time. The paper sheets are selectively fed from either one of the cassette 110 and tray 132.

The registration roller pair 115 once stops the sheet P and then drives it at such a timing that the leading edge of the sheet P meets the leading edge of the toner image formed on the drum 101. The image transferring device 106 transfers the toner image from the drum 101 to the sheet P, as stated earlier. The sheet P with the toner image is conveyed to a fixing device 116. The fixing device 116 fixes the toner image on the sheet P with heat and pressure.

The sheet P coming out of the fixing unit 116 is driven out of the apparatus to a tray 122 via an outlet 121 by an outlet roller pair 120. A stop 125 mounted on the tray 122 is movable in a direction indicated by a double-headed arrow b in order to position the size of the sheet P. A case 134 positioned at the left side of the apparatus, as viewed in FIG. 17, accommodates a power source circuit 135, a printed circuit board or engine driver board 136 and other electric parts as well as a controller board 137. A cover 138, which forms the tray 122, is openable about a fulcrum 139.

The fixing device 116 includes the various components described with reference to FIGS. 11 through 15. In the illustrative embodiment, the storage 17 and charger 18 stated earlier constitute drive means. The fixing device 116 has various advantages stated previously. In addition, the fixing device 116 promotes rapid warm-up of the entire apparatus from the stand-by state while insuring safety against the disorder of the heater.

Hereinafter will be described various modifications of the illustrative embodiment.

Figure 18:
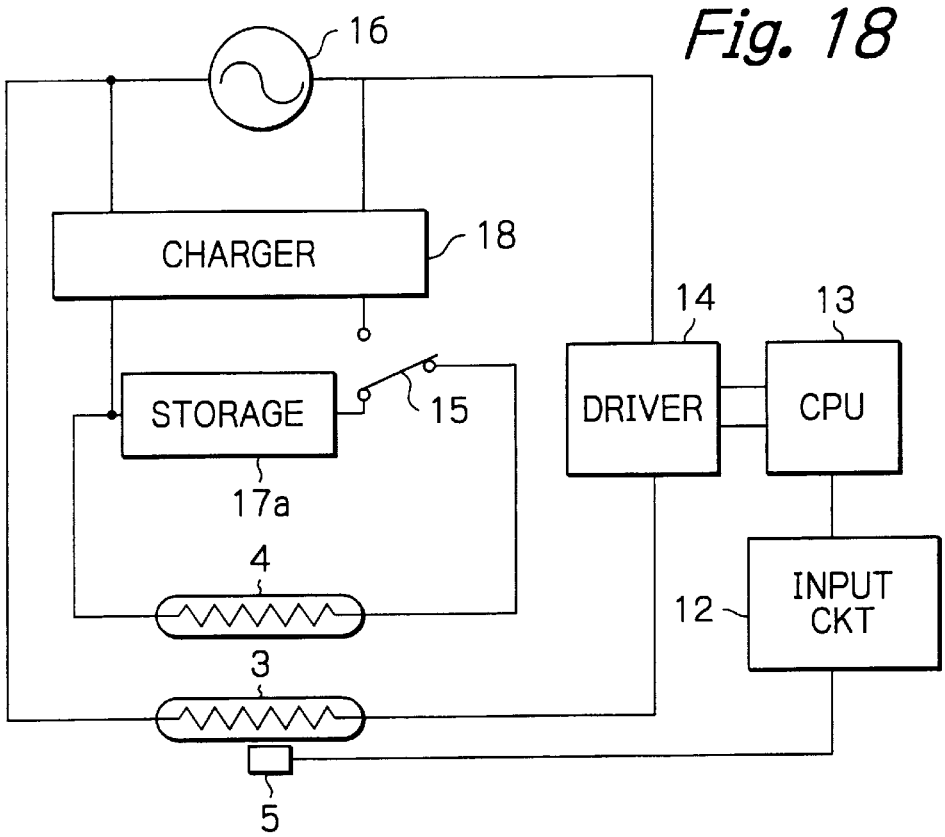
FIGS. 18 through 20 are schematic block diagrams respectively showing a first to a third modification of the circuitry of the second embodiment.

FIG. 18 shows a first modification of the illustrative embodiment. As shown, the modification differs from the circuitry of FIG. 15 in that a capacitor 17*a* capable of storing total energy of 1 kJ or above is substituted for the storage 17. A flash fixing device using an electrolytic capacitor as a power source has been proposed in various forms in the past. However, when a capacitor is used as a power source for the second heating element 4, an in the illustrative embodiment, an arrangement is made such that the DC current from the capacitor drives the second heating element 4 within a preselected period of time, preferably the warm-up time of the fixing unit. Therefore, a capacitor capable of storing total energy of 1 kJ or above is necessary.

At the time of warm-up of the fixing devices energy stored in the capacitor 17*a* is fed to the second heating element 4 for a preselected period of time, accelerating temperature elevation. The fixing temperature therefore sharply rises only at the time of warm-up of the fixing unit, so that safety is insured when the heater runs out of control.

Figure 19:
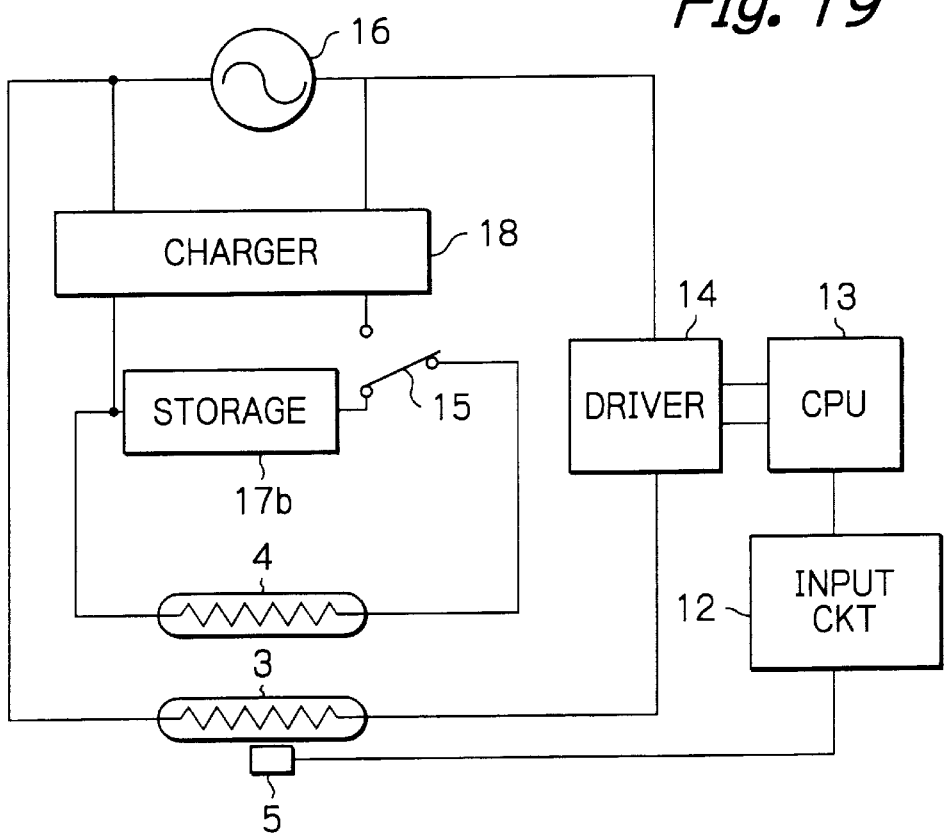

FIG. 19 shows a second modification of the illustrative embodiment. As shown, this modification differs from the illustrative embodiment in that an electric double-layer capacitor 17*b* is substituted for the storage 17. The electric double-layer capacitor 17*b* is a large-capacity storage capable of storing electricity by physically adsorbing ions. In the stand-by state of the fixing unit, the charger 18 charges the double-layer capacitor 17*b* via the switch 15. At the time of warm-up, the storage 18 feeds power to the second heating element 4 via the switch 15. The storage 17*b* can instantaneously discharge a great amount of energy in a short period of time and is desirable for the rapid warm-up of the fixing unit. Further, the number of times of charging and discharging of the storage 17*b* is, in principle, not limited, so that the storage 17*b* does not need maintenance. It follows that the storage 17*b* is desirable from the total cost standpoint in a long term of operation.

Figure 20:
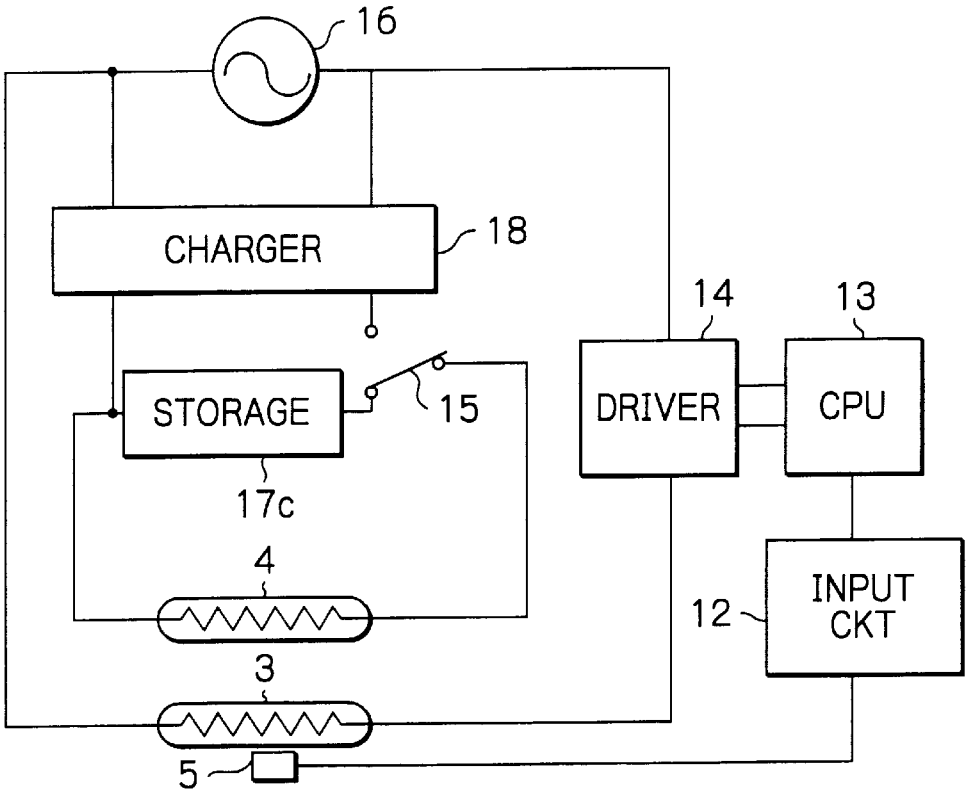

FIG. 20 shows a third modification of the illustrative embodiment. As shown, this modification differs from the illustrative embodiment in that the storage 17 is implemented as a capacitor or similar storage 17*c* having an energy capacity and a discharging characteristic that fully discharge 90% of the total stored energy within the warm-up time of the fixing unit.

The energy capacity and discharging characteristic described above allow the supply of energy from the storage 17*c* to the second heating element 4 to complete within substantially the warm-up time of the fixing unit. This is also desirable from the safety standpoint when the fixing device runs out of control at the time of warm-up. Further, the supply of energy to the second heating element 4 automatically ends and makes it needless to control the duration of drive of the heating element 4.

A fourth modification, which is a modification of any one of the illustrative embodiment and first to third modification thereof will be described hereinafter. In this modification, the warm-up time of the fixing device except for the power sources assigned to the heating elements 3 and 4 is shorter than a period of time necessary for a single sheet P to reach the fixing device after the turn-on of the power switch of an image forming apparatus, which includes the fixing device, preferably shorter than 6 seconds. Specifically, when use is made of a capacitor rapidly chargeable and dischargeable and capable of implementing a great current in a short period of time, the advantage of the capacitor cannot be made most of unless the fixing device except for the power sources thereof has a short warm-up time. In this respect, the fourth modification can make most of the advantage of the above capacitor.

Figure 21:
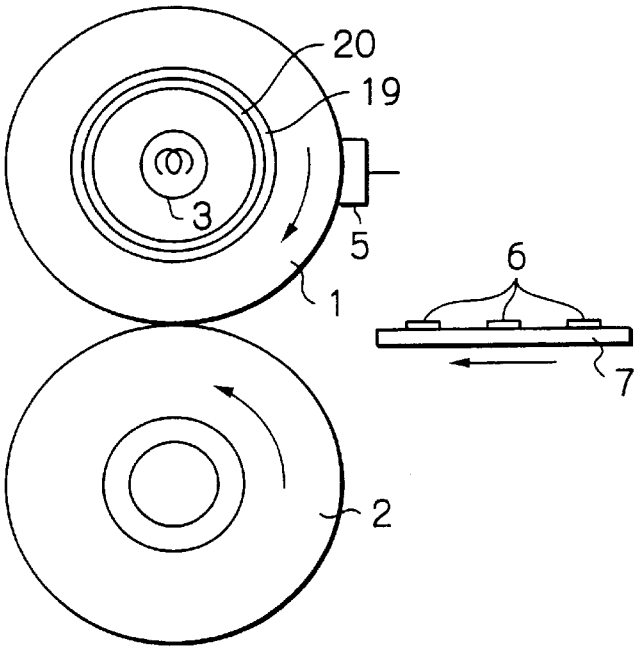
FIG. 21 is a section showing a fifth modification of the second embodiment.

FIG. 21 shows a fifth modification that is a modification of the illustrative embodiment or any one of the first to fourth modifications. As shown, an electric insulation layer 19 is formed in the inner periphery (or the outer periphery) of the heat roller 1. A heating resistor 20 forms a power feed pattern on the insulation layer 19. The insulation layer 19 and heating resistor 20 constitute a planar, second heating element 4. The heating resistor 20 includes a power feed member, not shown. At the time of warm-up of the fixing device, the storage 17 feeds power to the heating resistor 20 via the switch 15 and power feed members.

If a commercially available power source is used as a power source assigned to the heating resistor, then the heating resistor must have relatively high resistance and therefore needs a sophisticated power supply pattern. By contrast, in the fifth modification, the storage 17 feeds low DC voltage to the second heating element 4 and obviates the need for a sophisticated power supply pattern.

If desired, two heating resistors 20 may be used to implement the first and second heating elements 3 and 4. Also, the insulation layer 19 and the power supply pattern of the heating resistor 20 may be formed on the surface of the auxiliary heat roller 11, FIGS. 13 and 14.

Figure 22:
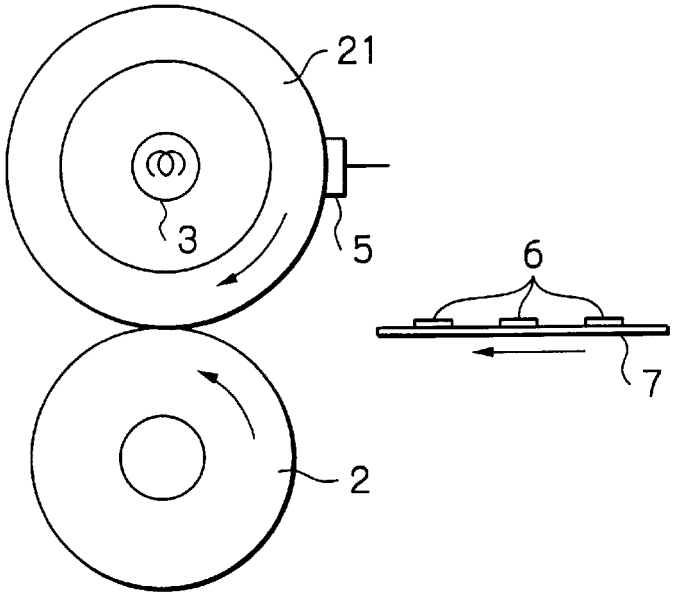
FIG. 22 is a section showing a sixth modification of the second embodiment.

FIG. 22 shows a sixth modification that is a modification of the illustrative embodiment or any one of the first to fifth modifications. As shown, a heat roller 21 is substituted for the heat roller 1. The heat roller 21 itself is implemented by a planar, heating resistor, so that the heat roller 21 itself constitutes the second heating element 4. The second heating element 4 may heat the heat roller 21 or the belt 8 or may heat the press roller 2. Further, the belt 8 or the press roller 2 may be implemented as a planar heating resistor.

Figure 23:
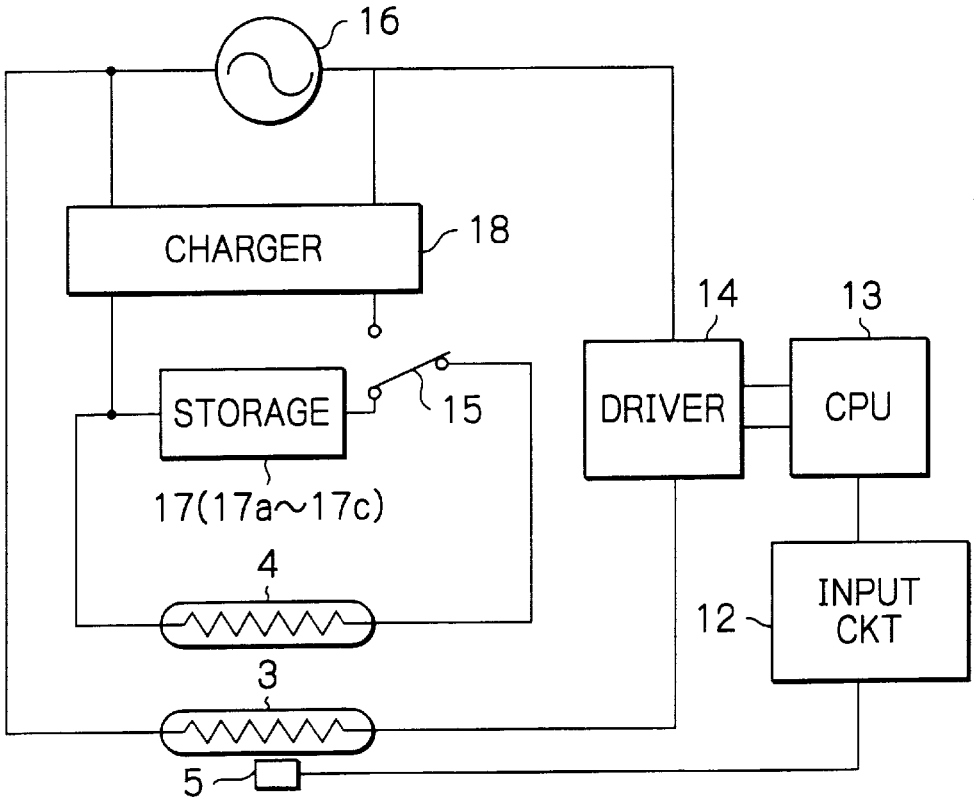
FIG. 23 is a schematic block diagram showing a sixth modification of the second embodiment.
Figure 24:
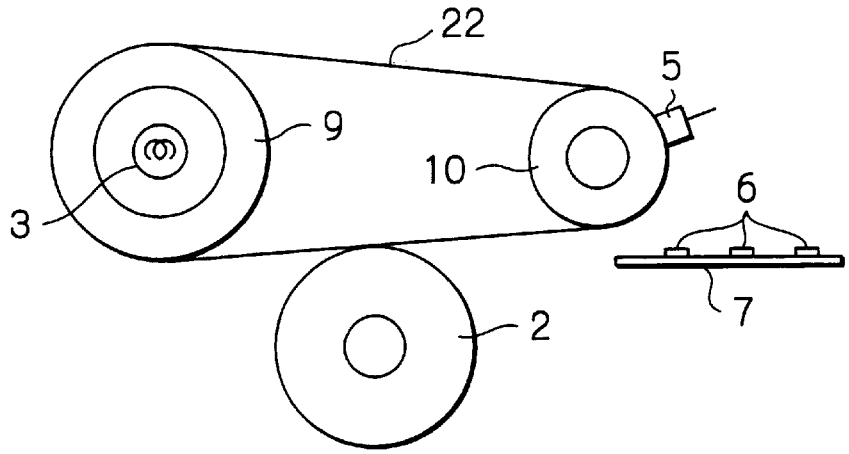
FIG. 24 is a section showing the sixth modification in which an endless belt is used as a fixing member.

The heat roller 21 includes a power feed member not shown. At the time of warm-up of the fixing device, the storage 17 shown in FIG. 23 feeds power to the heat roller or second heating element 21 via the switch 15 and power feed member, causing the heat roller 21 to heat. As shown in FIG. 24, an endless conductive belt 22 maybe substituted for the heat roller 21, FIG. 22, and implemented as a planar heating resistor.

In the configuration shown in FIG. 24, the belt 22 is passed over at least two rollers 9 and 10 while the press roller 2 is pressed against the belt 22 by pressing means not shown. The roller 9 accommodates the first heating element 3 therein. The first heating element 3 heats the belt 22 via the roller or heat roller 9. The two rollers shown in FIG. 24 play the role of the power feed members for feeding power to the belt 22. The roller 10 is a drive roller driven by a drive mechanism, not shown, causing the belt 22 to run. The belt 22 and press roller 2 fix the toner image on the sheet 7, which is being conveyed via the nip between the belt 22 and the press roller 2, with heat and pressure. The temperature sensor 5 senses the surface temperature of the belt 22.

In the sixth modification, the heat roller or fixing member 22 itself constitutes at least the second heating element and is implemented as a planar heating resistor, as stated above.

This configuration does not need an insulation layer and thereby simplifies the laminate structure while reducing thermal capacity, compared to the configuration including an insulation layer and a heating resistor layer sequentially laminated on a fixing member.

Figure 25:
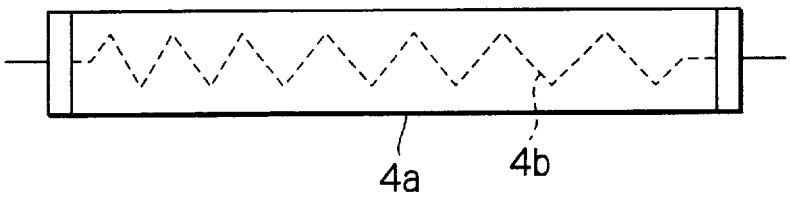
FIG. 25 is a front view showing a second heating element included in a seventh modification of the second embodiment.

FIG. 25 shows a seventh modification that is a modification of the illustrative embodiment or any one of the first to fourth modifications. As shown, at least the second heating element 4 is implemented as a traditional radiation heater made up of a glass tube 4*a* and a filament 4*b* disposed in the glass tube 4*a*. The radiation heater is low-cost and reliable. To further enhance reliability, the second heating element 4 may be implemented by a halogen heater.

Figure 26:
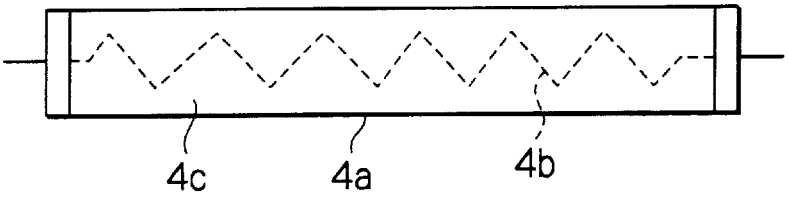
FIG. 26 is a front view showing the second heater included in an eighth modification of the second embodiment.

FIG. 26 shows an eighth modification similar to the seventh modification except that the glass tube 4*a* is filled with gas 4*c* whose major or component is krypton or xenon. Generally, when a radiation heater is applied to a fixing device, electric energy fed to the heater at the time of warm-up heats not only a fixing member but also the filament and glass tube of the heater. Heating the glass tube is practically the loss of energy. The ratio of this loss becomes greater as the fixing device is more rapidly warmed up, and is therefore not negligible.

A fixing device with a heater capable of reducing the loss mentioned above and capable of sharply warmed up at the initial stage of power feet can be rapidly warmed up. Particularly, the total amount of energy and the duration of energy supply available for the second heating element 4 are limited. The second heating element 4 will therefore wastefully consume the limited energy and will fail to sufficiently achieve the above advantage if the loss is not small. The gas whose major component is krypton or xenon is capable of reducing the heat loss ascribable to convection and thereby reducing the warm-up time.

A ninth modification is similar to the seventh or eighth modification except for the following. While the ninth modification also uses the radiation heater shown in FIG. 25 or 26, it is characterized in that the filament 4*b* has a color temperature of 2,500° K. or above in a steady state. By reducing the diameter of a filament included in a radiation heater, it is possible to raise the color temperature of the heater and therefore to reduce the warm-up time. Generally, the life of a radiation heater decreases when the diameter of its filament is reduced. However, because the second heating element 4 is driven only at the time of warm-up, i.e., driven over only a short period of time in total and therefore has a margin as to life great enough to cope with the decrease in the diameter of the filament.

Further, if the radiation heater cannot be sharply warmed up at the initial stage of power supply, then an additional loss is brought about. The second heating element 4 reduces the warm-up time of the radiation heater because its filament has a higher color temperature (2,500° K., or above), i.e., a smaller diameter than conventional.

A tenth modification is similar to the seventh or eighth modification except for the following. While the tenth modification also uses the radiation heater shown in FIG. 25 OR 26, it is characterized in that the gas filled in the glass tube 14*a* has a full pressure higher than 1 atmospheric pressure. The full pressure higher than 1 atmospheric pressure also reduces the heat loss ascribable to the convection of the gas and therefore reduces the warm-up time of the heater. Further, the radiation heater can have its life extended if the evaporation of the filament is suppressed. This, coupled with the thinning of the filament, not only further reduces the warm-up time of the heater, but also reduces the decrease in life ascribable to the thinning of the filament.

In an eleventh modification of the illustrative embodiment or any one of the first to fourth modifications, the storage 17 and charger 18 shown in FIG. 15 are mounted on the body of an image forming apparatus other than the fixing device 116 shown in FIG. 17. In this configuration, the fixing device 116, storage 17 and charger 18 each are replaceable in accordance with its life. It follows that when the fixing device 116 is replaced due to the life of, e.g., the heater, the storage 17 and charger 18 can be left in the apparatus body.

The electric double-layer capacitor constituting the storage 17 is, in principle, free from a limitation on the number of times of charging and discharging. Basically, therefore, this kind of capacitor is maintenance-free, i.e., it does not have to be replaced until the life of the entire apparatus body ends. The eleventh modification therefore not only reduces the size of the fixing unit 116, but also facilitates the replacement of the fixing unit 116 and that of the storage 17.

Figure 27:
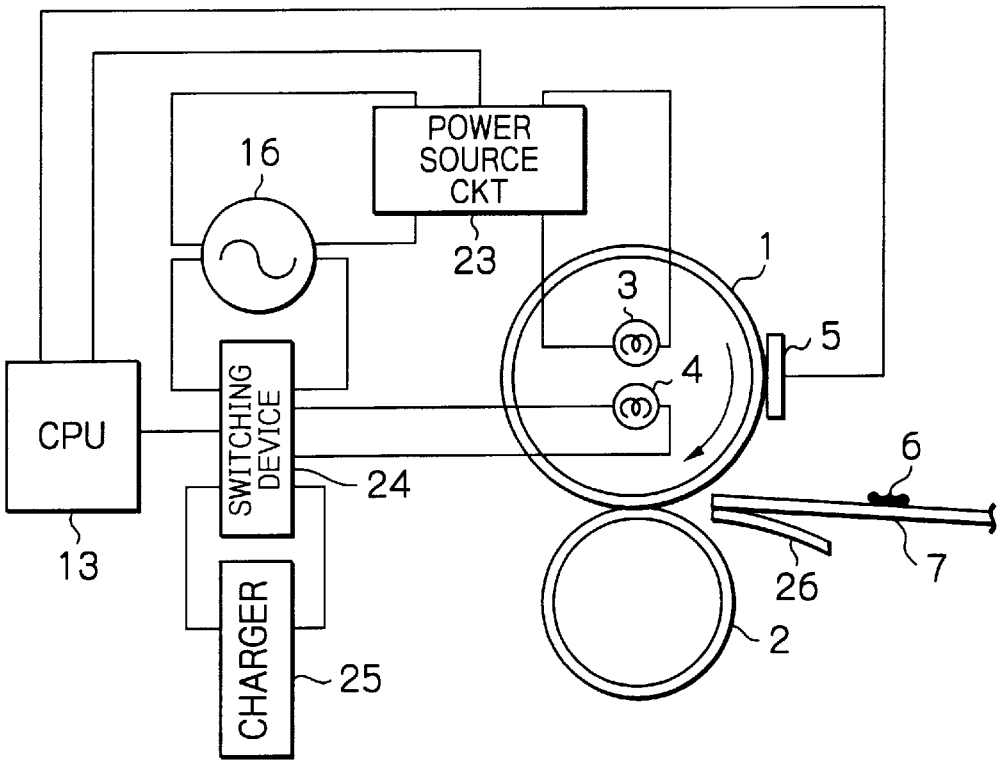
FIG. 27 is a schematic block diagram showing a twelfth modification of the second embodiment.

FIG. 27 shows a twelfth modification of the illustrative embodiment. As shown, a power source circuit 23 controls power supply from the commercial power source 16 to the first heating element 3 in response to a control signal output from the CPU 13. For this purpose, the power source circuit 23 uses a solid state relay (SSR). More specifically, the CPU 13 sends a control signal to the power source circuit 23 in accordance with the output of the temperature sensor 5 responsive to the surface temperature of the heat roller 1, thereby maintaining the above surface temperature at a preselected fixing temperature.

The CPU 13 causes a switching circuit 24 to select a first mode at the time other than the time of warm-up or select a second mode at the time of warm-up. In the first mode, the CPU 13 causes the charge/discharge switching means to connect the commercial power source 16 to a storage 25. The storage 25 includes a charge/discharge control circuit and a capacitor or storage body. When the charge control circuit is connected to the commercial power source 16, it transforms AC power output from the power source 16 to DC power and feeds the DC power to the capacitor. In the second mode, the CPU 13 causes the charge/discharge switching means to connect the above capacitor to the second heating element 4 to thereby drive the heating element 4.

The first and second heating elements 3 and 4 both are implemented as halogen heaters and therefore heated before radiation becomes stable at the initial stage of power supply. However, in this modification, the heating elements 3 and 4 or the heating element 4 needs energy of about 2.7 kJ or less for a preselected period of time at the initial stage of power supply until radiation becomes stable. The preselected period of time is, e.g., 10 seconds since the start of power supply. The glass tube of each halogen heater is filled with inactive gas whose major component is krypton or xenon, so that convection in the glass tube is suppressed. This successfully prevents the filament from loosing heat and slowing down the warm-up at the initial stage of power supply. Further, the volume of the filament is reduced in order to reduce the heat of the filament itself, so that the filament achieves a color temperature of 2,500° K. or above, e.g., 2,800° K.

The capacitor of the storage 25 is implemented as a 70 V, 1.3 F electric double-layer capacitor capable of discharging energy of 3.3 kJ for 10 seconds. The capacitor may store energy of 3 kJ or more on the basis of capacity.

In operation, when the power switch of the apparatus body is turned on, a print signal including image data is input to the controller board 137. In response, the CPU 13 causes the switching circuit 24 to select the second mode. As a result, the capacitor of the storage 25 feeds power to the second heating element 4. Substantially at the same time, the CPU 13 causes the power source circuit 23 to connect the commercial power source 16 to the first heating element with a triac. Consequently, the two heating elements 3 and 4 rapidly hat the heat roller 1.

When the surface temperature of the heat roller 1 reaches the preselected fixing temperature, as determined by the temperature sensor 5, the CPU 13 causes the switching circuit 24 to select the first mode. In this mode, the power source from the capacitor of the storage 25 to the second heating element 4 is shut off to thereby stop drinking the heating element 4.

The process for forming the toner image 6 on the sheet 7 is executed in synchronism with the heating of the heat roller 1. When the sheet 7 carrying the toner image thereon 6 arrives at a guide 26 positioned at the inlet of the fixing device 116, the surface temperature of the heat roller has risen to the fixing temperature. The heat roller 1 and press roller 2 fixes the toner image 6 on the sheet 6 being passed through the nip between the rollers 1 and 2. The heat roller 1 has a hollow cylindrical base formed of aluminum or iron and a parting layer covering the circumference of the base. The base has a wall thickness of 0.2 mm to 1.0 mm.

Assume that a period of time necessary for the fixing unit device to be heated from the atmospheric temperature to the fixing temperature is T seconds, that the storage 25 is capable of discharging energy of E1 (J) for T seconds, and that the second heating element 4 stores energy of E2 (J) for T seconds. Then, in this modification, the energy E1 is selected to be greater than the energy E2. This relation realizes a low cost, energy saving image forming apparatus.

As stated above, this modification uses the heating element 3 that receives AC power output from the commercial power source and the heating element 4 that receives DC power from the capacitor of the storage 25. With this configuration, it is possible to temporarily feeding power exceeding power available with the commercial power source to the heating elements 3 and 4 only at the time of warm-up, in addition, after the energy stored in the capacitor of the storage 25 has been fully discharged, the fixing device is prevented from being excessively heated even when the heater runs out of control. This is desirable from the safety standpoint.

The capacitor of the storage 25 discharging energy as great as 3 kJ or more for only 10 seconds, as stated earlier, drives the second heating element 4 for a moment at the time of warm-up and thereby accelerates temperature elevation.

Figure 28:
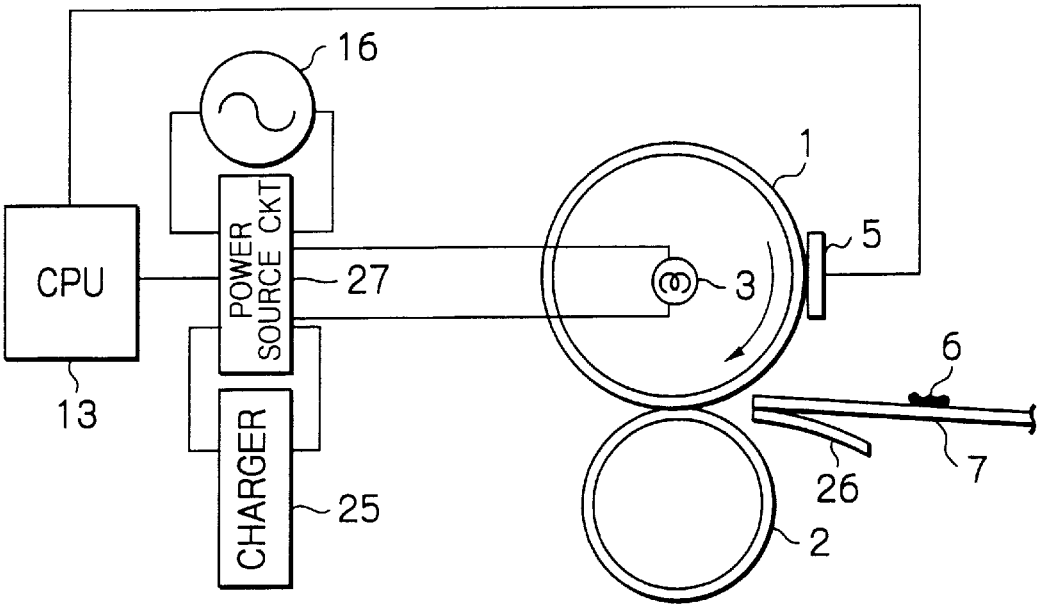
FIG. 28 is a schematic block diagram showing a thirteenth modification of the second embodiment.

FIG. 28 shows a thirteenth modification of the illustrative embodiment similar to the twelfth embodiment except for the following. As shown, the thirteenth modification uses only the first heating element 3. The CPU 13 causes the power source circuit 27 to select any one of a first, a second and a third mode. In the first mode, which is selected at the time of warm-up, the power source circuit 27 superposes the AC power output from the commercial power source 16 and the power output from the capacitor of the storage 25 and feeds the superposed power to the heating element 3. In the second mode that is a usual mode, the power source circuit 27 feeds the AC power from the commercial power source 16 to the heating element 3. In the third mode, the power source circuit 27 transforms the AC power of the commercial power source 16 to the DC power and feeds it the DC power to the capacitor of the storage 25.

The heating element 3 is implemented as a halogen heater and therefore heated before radiation becomes stable at the initial stage of power supply. However, in this modification, the heating element 3 needs energy of about 2.7 kJ or less for a preselected period of time at the initial stage of power supply until radiation becomes stable. The preselected period of time is, e.g., 10 seconds since the start of power supply. The glass tube of the halogen heater is filled with inactive gas whose major component is krypton or xenon, so that convection in the glass tube is suppressed. This successfully prevents the filament from loosing heat and slowing down the warm-up at the initial stage of power supply. Further, the volume of the filament is reduced in order to reduce the heat of the filament itself, so that the filament achieves a color temperature of 2,500° K. or above, e.g., 2,800° K.

The capacitor of the storage 25 is an electric double-layer capacitor capable of storing energy of 3.3 kJ for a preselected period of time, e.g., 10 seconds. The capacitor may store energy of 3.3 kJ or more on the basis of capacity, if desires. At the time of image formation, the surface temperature of the heat roller 1 must be immediately raised to the fixing temperature within, e.g., 10 seconds. Generally, however, a halogen heater heats itself at the time of warm-up before radiation becomes stable and therefore needs energy of about 4.4 kJ for, e.g., 10 seconds until radiation becomes stable. In this modification, the AC power of the commercial power source 16 and the power of the capacitor of the storage 25 are superposed and fed to the heating element 3. This reduces the energy that the heater needs for, e.g., 10 seconds before radiation becomes stable to about 2.7 kJ or less, thereby minimizing an energy loss ascribable to the halogen heater 3.

Assume that an auxiliary power source for driving a heat source is implemented as a chargeable power source. Then, most of the energy discharged from the auxiliary power source is absorbed by the heat source itself unless the heat of the heat source itself is reduced, making the power source meaningless. Also, a halogen heater or similar heat source generally slow down the heating of the fixing unit because the heat source itself is heated.

This modification includes the capacity of the storage 25 as storing means to be charged by the output of the commercial power source 16. The power source circuit 27 plays the role of first means for driving the heat source with the output of the commercial power source 16. At the same time, the power source circuit 27 plays the role of second means for driving the heaving element 3 with the output of the capacitor of the storage 25. The heating element 3 is a radiation heat source. When the fixing unit needs rapid heating, the heater 3 is driven by both of the output of the commercial power source 16 and that of the capacitor of the storage 25 superposed on each other. Usually, the heating element is driven by the output of the commercial power source 16.

Assume a fixing device constructed to rapidly warm up within a period of time in which a sheet arrives thereat, preferably 5 seconds. Then, the warm-up of this type of fixing device is slowed down unless the halogen heater has sharp response at the initial stage of power supply. In light of this, a fourteenth modification of the illustrative embodiment, which is similar to the twelfth or the thirteenth modification, includes the heating elements 3 and 4 each being implemented as a radiation heater whose color temperature is 2,500° K. or above, e.g., 2,800° K. The radiation heater is filled with inactive gas whose major component is krypton or xenon. This is also Successful to reduce the warm-up time of the heater.

The twelfth to fourteenth modifications each using the fixing unit 113 insure safety when the heater runs out of control, and reduce the warm-up time.

Figure 29:
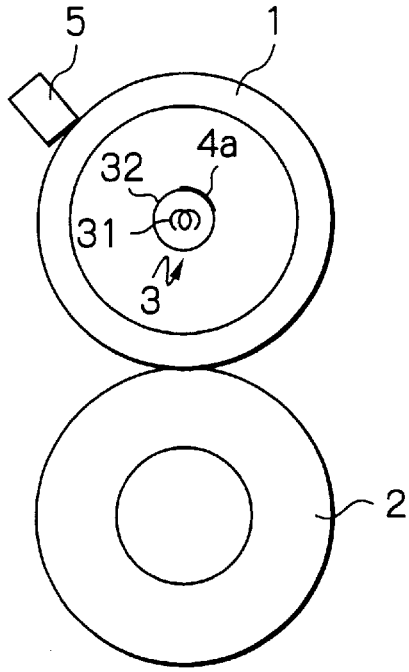
FIG. 29 is a section showing a fifteenth modification of the second embodiment.

FIG. 29 shows a fifteenth modification of the illustrative embodiment similar to any one of the first to fourth modifications except for the following. As shown, the first heating element is made up of a glass tube 32 and a filament 31 sealed in the glass tube 32. The second heating element 2 is implemented as a heating resistor 4*a* pained on part of the circumference of the glass tube 32. At the time of warm-up, the first heating element 3 received power form the commercial power source 16 while the second heating element 4*a* receives power from the storage 17. After the warm-up, only the first heating element 3 receives power from the commercial power source 16.

A space available in the heat roller 1 is sometimes too narrow to accommodate two heating elements. This is particularly true when each heating element is squeezed at opposite ends. In this modification, the heat roller 1 needs only a space therein just sufficient to accommodate the first heating element 3 because the second heating element 4*a* is painted on the element 3. Further, the resistance of the heating resistor 4*a* can be relatively freely set and allows the energy of the low-voltage storage 17 to be output in a short period of time.

Figure 30:
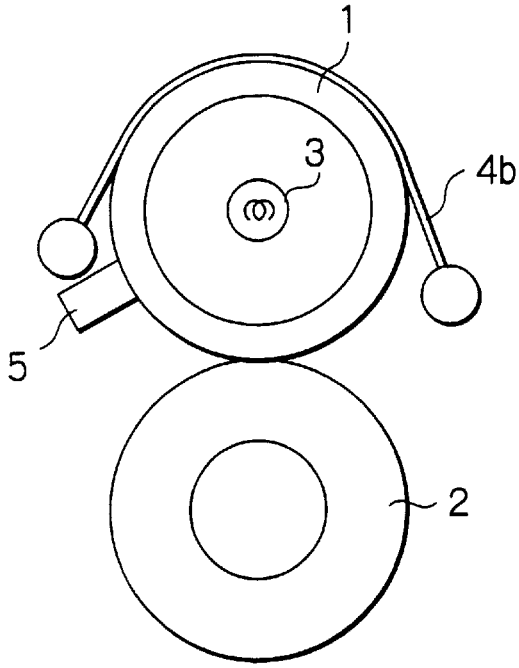
FIG. 30 is a section showing a sixteenth modification of the second embodiment.

FIG. 30 shows a sixteenth modification of the illustrative embodiment similar to the illustrative modification or any one of the first to fourth modifications. As shown, in the sixteenth modification, the second heating element 4 is implemented as a planar heating body 4*b* contacting the circumference of the heat roller 1. The planar heating body 4*b* may contact the belt 8, FIG. 3, if desired.

Figure 31:
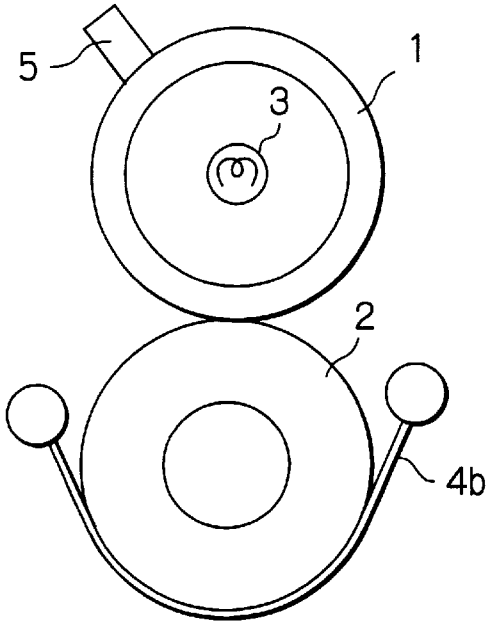
FIG. 31 is a section showing a seventeenth modification of the second embodiment.

FIG. 31 shows a seventeenth modification of the illustrative embodiment similar to the illustrative embodiment or any one of the first to fourth modifications. As shown, the second heating element 4 is implemented as a planar heating body 4*b* contacting the circumference of the press roller 2. Heating the press roller 2 is desirable in the case of a high-speed image forming apparatus in which initial temperature drop is noticeable. More specifically, in a high-speed image forming apparatus, a press roller formed of, e.g., sponge and having a low thermal capacity is not feasible from the durability standpoint. When a press roller having a high thermal capacity is used for the above reason, it absorbs heat of a heat roller or fixing member just after the start of rotation, preventing the heat roller from being maintained at a fixing temperature.

In the sixteenth and seventeenth modifications, at the time of warm-up, the first heating element 3 receives power from the commercial power source 16 while the second heating element 4*b* receives power from the storage 17. After the warm-up, only the first heating element 3 receives power from the commercial power source 16.

As stated above, in the sixteenth and seventeenth modifications, the second heating element is implemented as the planar heating body contacting the circumference of the fixing member or the pressing member. The planar heating body promotes the effective use of energy available with the storage at the time of warm-up. When the fixing device continuously fixes toner images on a plurality of consecutive sheets, the planar heating body is not used, insuring safety operation. Further, the resistance of the planar heating body can be relatively freely set and allows the energy of the low-voltage storage 17 to be output in a short period of time.

An eighteenth modification of the illustrative embodiment is similar to the sixteenth or the seventeenth embodiment except that part of the heat roller 1 or the press roller 2 which the planar heating body 4*b* contacts is formed of an insulator. This obviates electrical danger, e.g., leakage to the heat roller 1 or the press roller 2 likely to occur when power is fed to the heating body 4*b*.

A nineteenth modification of the illustrative embodiment is similar to the sixteen or the seventeenth modification except that part of the heat roller 1 or the press roller 2 which the planar heating body 4*b* contacts is formed of silicone rubber or similar heat-insulating material. This successfully reduces the heating time of the heat roller 1 or that of the press roller 2. More specifically, the heat-insulating material causes the heat roller 1 or the press roller 2 to release a minimum of heat, so that the heat roller 1 or the press roller 2 can be rapidly heated to the fixing temperature.

Figure 32:
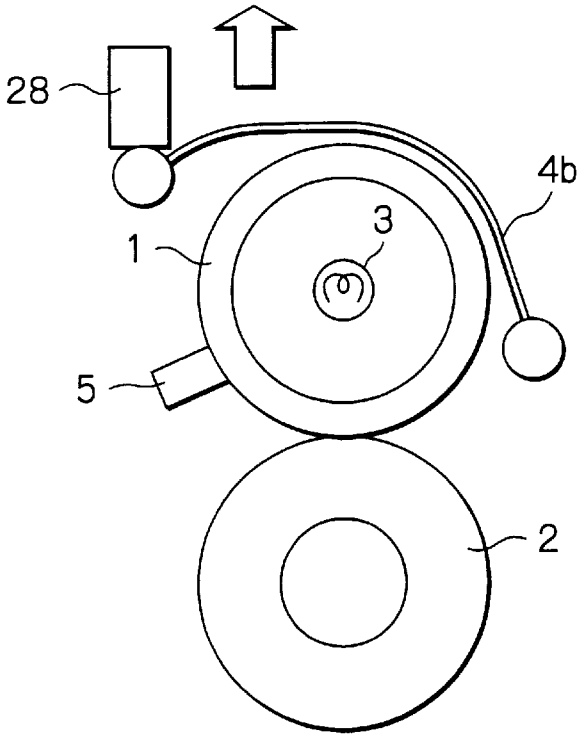
FIG. 32 is a section showing a twentieth modification of the second embodiment.

FIG. 32 shows a twentieth modification of the illustrative embodiment similar to the eighteenth or the nineteenth modification except for the following. As shown, in the stand-by state in which the press roller 2 does not rotate or at the time of warm-up, a solenoid 28 is not energized while a spring, not shown, maintains the planar heating body 4*b* in contact with the heat roller 1 or the press roller 2. In the event of fixing the toner image 6 on the sheet 7, a drive mechanism, not shown causes the heat roller 1 and press roller 2 to rotate. At this instant, the solenoid 28 is energized to pull the planar heating body 4*b* away from the heat roller 1 or the press roller 2. This protects both of the heating body 4*b* and the heat roller 1 or the press roller 2 form wear and thereby allows them to be used over a long period of time.

In a twenty-first modification of the illustrative embodiment similar to the twentieth modification, the planar heating body 4*a* or 4*b* is held in contact with the heat roller 1 or the press roller by the spring in the stand-by state or at the time of warm-up with the solenoid 28 being deenergized. At the time of warm-up or fixation, a drive mechanism, not shown, drives the heat roller 1 and press roller 2. When the heat roller 1 and press roller 2 fixes the toner image 6 on the sheet 7, the solenoid 28 is energized to move the heating body 4*b* away from the heat roller 1 or the press roller 2. This modification has the same advantage a the twentieth modification.

Figure 33:
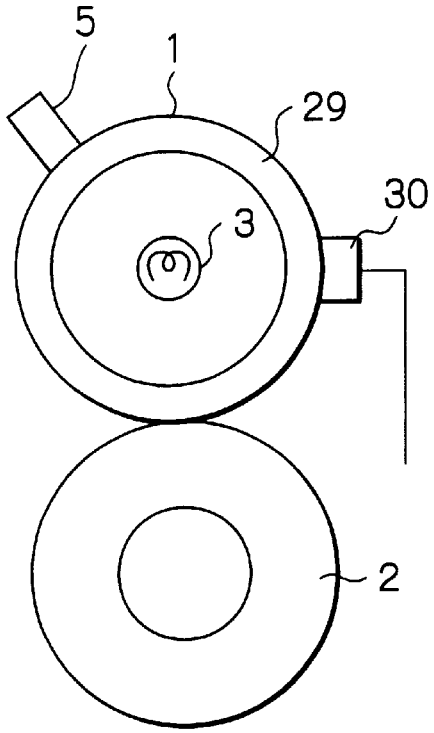
FIGS. 33 through 35 are sections showing a twenty-second modification of the second embodiment.
Figure 34:
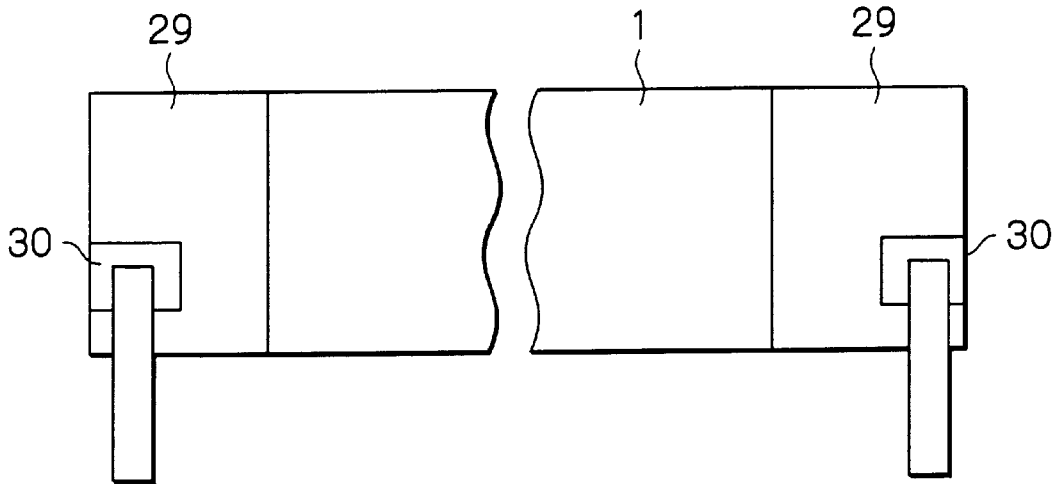
Figure 35:
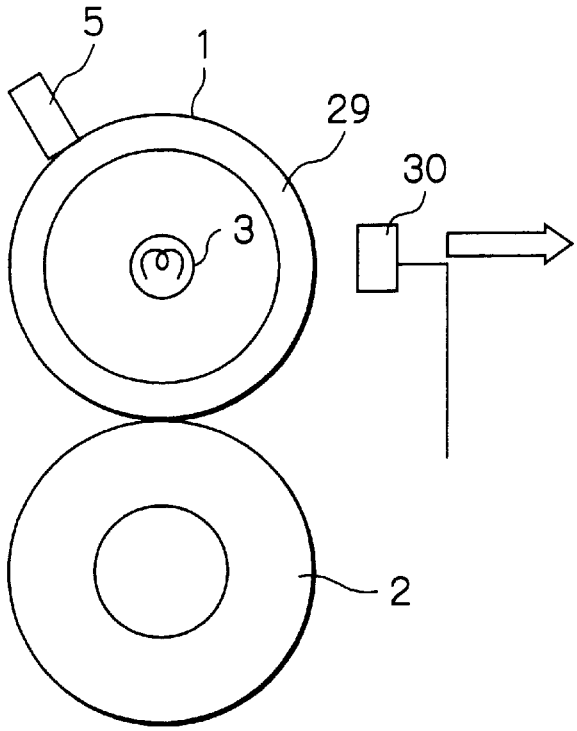

FIGS. 33 through 35 show a twenty-second modification of the illustrative embodiment similar to anyone of the first to fourth modifications. As shown, the second heating element 4 is implemented as a conductive core 29 disposed in the heat roller or fixing member 1. An electrode 30 is held in contact with the exposed circumference of the core 29. The storage 17 feeds power to the core 29 via the switch 15 and electrode 30. As a result, the outer portion of the core 29 is heated. This configuration is extremely effective when the storage 17 is implemented as an electric double-layer capacitor.

In the stand-by state in which the heat roller 1 does not rotate or at the time of warm-up, moving means, not shown, holds the electrode 30 in contact with the circumference of the heat roller 1. When the heat roller 1 and press roller 2 fix the toner image 6 on the sheet 7, a drive mechanism, not shown, causes the rollers 1 and 2 to rotate. At this instant, the moving means releases the electrode 30 from the circumference of the heat roller 1. This obviates wear and noise otherwise occurring due to the sliding contact of the electrode 30 and heat roller 1 and thereby extends the life of the electrode 30 and heat roller 1.

This modification allows the heat roller 1 to be heated by the electric energy output from the storage 17 without increasing the thermal capacity, thereby reducing the start-up time. The resistance of the core 29 can be relatively freely set and allows the electric energy to be rapidly output from the low-voltage storage 17.

A twenty-third modification is identical with the twenty-second modification except that the second heating element 4 is implemented as a conductive core included in the press roller 2 in stead of the conductive core of the heat roller 1.

In a twenty-four modification similar to the twenty-second or the twenty-third modification, moving means, not shown, holds the electrode in contact with the circumference of the heat roller 1 or the press roller 2 in the stand-by state or at the time of warm-up. At the time of warm-up or fixation, the drive mechanism, not shown, causes the heat roller 1 and press roller 2 to rotate. At this instant, the moving means releases the electrode from the heat roller 1 or the press roller. This modification noticeably reduces the wear of the heat roller 1 and that of the press roller 2 because the electrode remains in contact with the roller 1 or 2 for only a short period of time.

Third Embodiment

Figure 36:
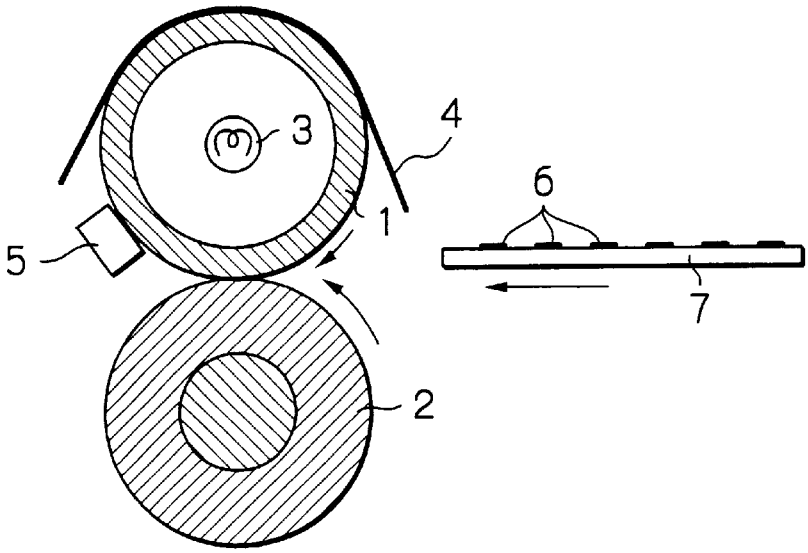
FIG. 36 is a section showing a third embodiment of the present invention.

Referring to FIG. 36, another alternative embodiment of the present invention will be described. As shown, the fixing device also includes the heat roller 1 and press roller 2 pressed against the heat roller 2 by biasing means not shown. The press roller 2 is formed of silicone rubber or similar elastic material. Of course, one or both of the heat roller 1 and press roller 2 may be implemented as endless belts, if desired.

The fixing device includes the first and second heating elements 3 and 4 each generating heat when supplied with power. The heating elements 3 and 4 each are positioned at any desired position where it can heat the heat roller 1. For example, the heating element 3 is disposed in the heat roller 1 in order to heat it from the inside. The heating element 4 is sheet-like or planar and contacts the upper portion of the heat roller 1, thereby heating the roller 1 form the outside.

A drive mechanism, not shown, causes the heat roller 1 and press roller 2 to rotate. The temperature sensor 5 is held in contact with the heat roller 1 for sensing the surface temperature of the roller 1. The heat roller 1 and press roller 2 fix the toner image 6 on the sheet 7 being conveyed via the gap between the rollers 1 and 2 with heat and pressure.

Figure 37:
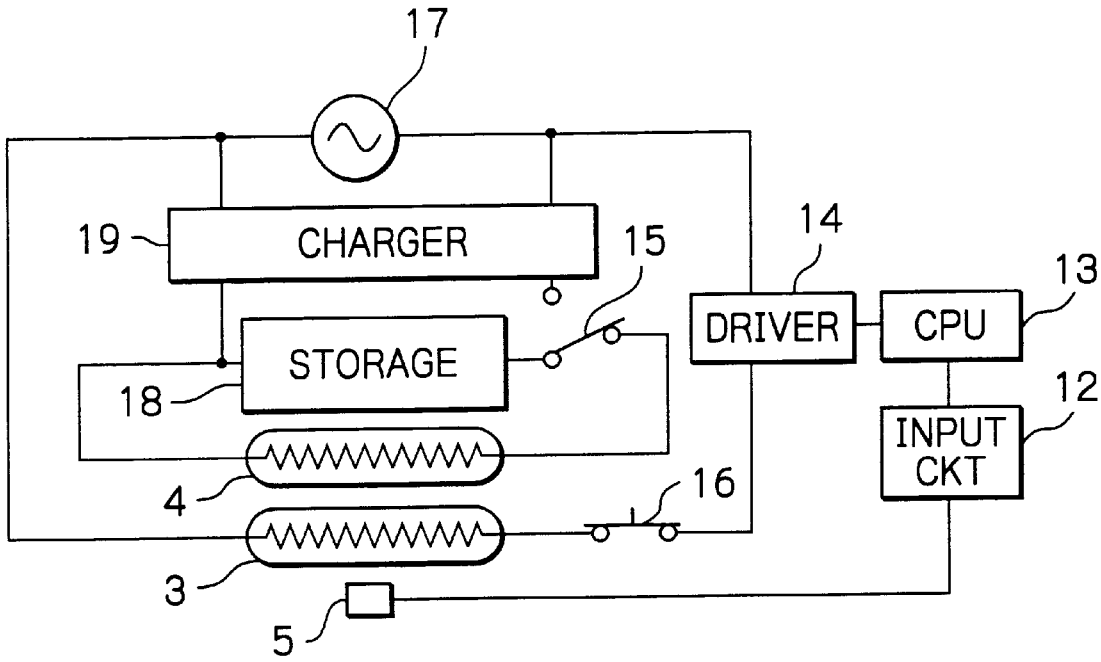
FIG. 37 is a schematic block diagram showing a control circuit included in the third embodiment.

FIG. 37 shows control circuitry included in the illustrative embodiment. As shown, the CPU or control means 13 receives the output of the temperature sensor 5 via an input circuit 12. In response, the CPU 13 controls power supply to the heater 3 via the driver 14 and power supply to the heater 4 via a the switch 15 such that the surface temperature of the heat roller 1 remains at the preselected fixing temperature.

The heating element 3 is connected to the commercial power source 17 via a thermostat or safety device 16 and the driver 14. The driver 14 controls power supply from the commercial power source 17 to the heating element 3 under the control of the CPU 13. When the temperature of the fixing unit rises to an upper limit, the thermostat 16 turns off to interrupt power supply from the commercial power source 17 to the heating element 3. The thermostat 16 may be replaced with any other suitable safety device, e.g., a temperature fuse, if desired.

In a stand-by state, the CPU 13 causes the switch 15 to connect the capacitor or storage 18 to the charger 19. In this condition, the charger 19 transforms the AC power output from the commercial power source 17 to DC power and feeds the DC power to the capacitor 18, thereby charging the capacitor 18. When the fixing unit is used, the CPU 13 causes the switch 15 to connect the capacitor 18 to the heating element 4. As a result, the capacitor 18 feeds the DC power to the heating element 4 at the time of the warm-up or fixing unit.

In the above-described configuration, at the time of warm-up, the heating element 3 is driven by the AC current flowing from the commercial power source 17 via the driver 14. At the same time, the heating element 4 is driven by the DC current flowing from the capacitor 18. The surface temperature therefore rapidly rises to the fixing temperature. After the warm-up, the CPU 13 controls the power source to the heating element 3 via the driver 14 such that the surface temperature of the heat roller 1 remains at the fixing temperature.

The capacitor 18 has a capacity as great as the order of farad (F). Such a capacitor may be replaced with, e.g., a connection of a number of electrolytic capacitors, if desired. Capacitors having capacities of the order of farad are a recent achievement in the battery art (see "Special Edition Latest Secondary Battery Expedition Technological Innovations of New Type of High-Capacity Power Capacitors", Electronics, April, 1998).

Figure 38:
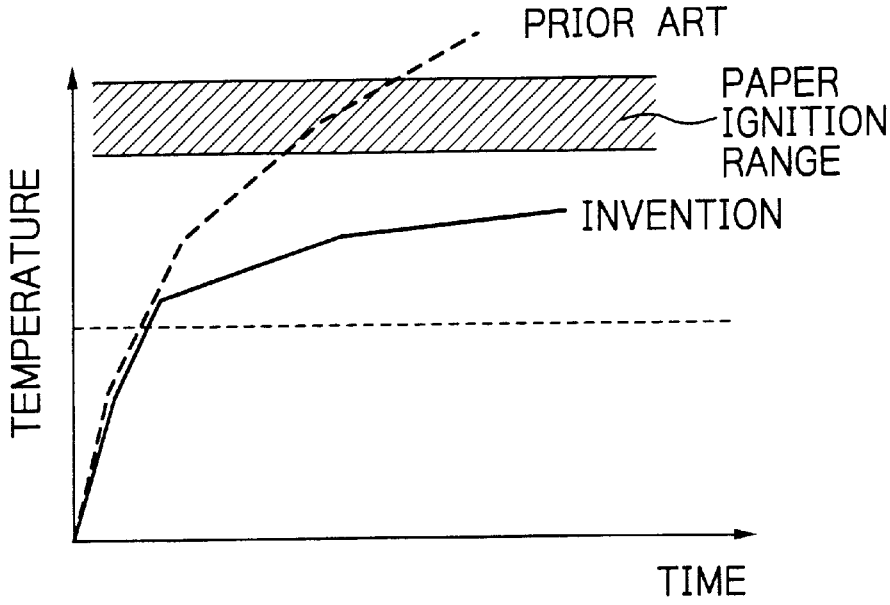
FIG. 38 is a graph comparing the third embodiment and a conventional fixing device with respect to temperature elevation to occur when temperature control is disabled.

The capacitor 18 is configured to substantially fully discharge within the warm-up time of the fixing unit, e.g., 6 seconds. More specifically, the capacitor 18 discharges power greater than the power available with the ordinary commercial power source 17 within the warm-up time of the fixing unit at the ordinary atmospheric temperature (room temperature) of 15° to 25°. It is to be noted that this discharge does not include small currents below a preselected current effective to heat the heating element 4. Therefore, the capacitor 18 discharges within the warm-up time of the fixing device. As shown in FIG. 38, even when the switch 15 malfunctions due to the disorder of the CPU 13, the capacitor 18 fully discharged does not drive the heating element 3. Only the heating element 4 is heated by the power fed from the commercial power source 17. Consequently, as shown in FIG. 38, a curve representative of temperature elevation to occur due to the disorder of the CPU 13 varies only slowly after reaching the fixing temperature. This protects the sheet 7 from ignition and thereby insures safety.

FIG. 38 also shows temperature variation particular to the conventional fixing device that continuously feeds preselected power during warm-up. As shown, when the fixing temperature is brought out of control due to the disorder of the CPU 13, the temperature sharply rises above the ignition range of the sheet 7.

The commercial power source 17 feeds power to AC loads other than the heaters 3 and 4. More specifically, a power source circuit, not shown, transforms the AC power output from the commercial power source 17 to a DC power and feeds the DC power to the DC loads.

The illustrative embodiment is also practical with the image forming apparatus described with reference to FIG. 17.

Various modifications of the illustrative embodiment will be described hereinafter. A first modification of the illustrative embodiment is identical with the configuration shown in FIG. 13 and will not be described specifically.

Figure 39:
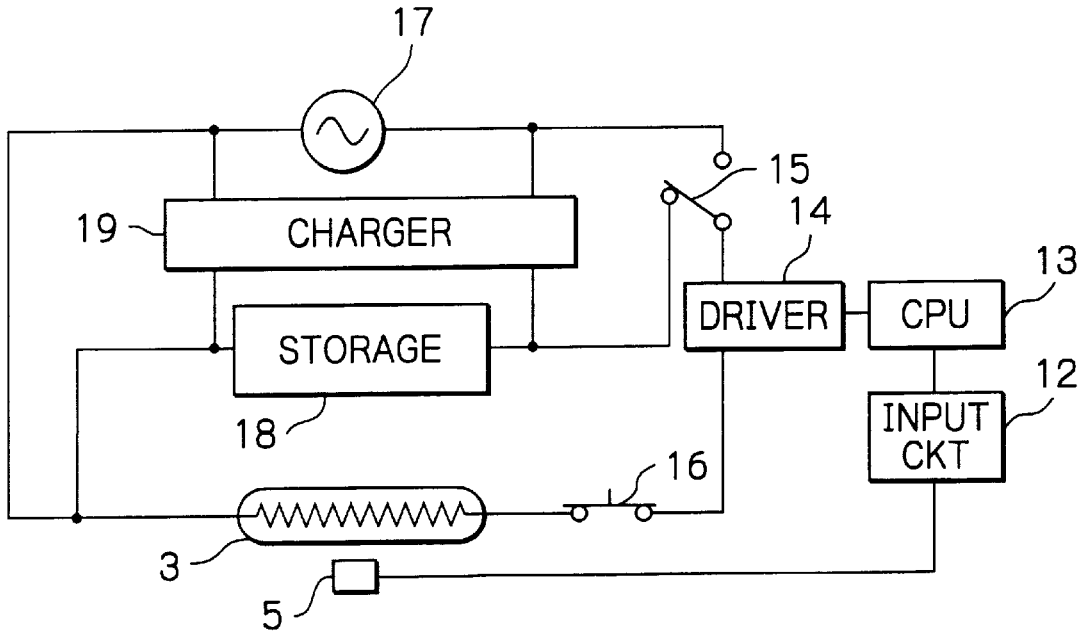
FIG. 39 is a schematic block diagram showing the third embodiment in which a single heating element is used.

FIG. 39 shows a second modification of the illustrative embodiment. As shown, the second modification includes only the heating element 3. In the stand-by state, the CPU 13 causes the switch 15 to select the commercial power source 17, causing the charge 19 to charge the capacitor or storage 18. At the time of warm-up, the CPU 13 causes the switch 15 to select the charger 19. In this condition, the capacitor 18 feeds the DC current to the heating element 3 via the driver 14 with the result that the surface temperature of the heat roller 1 is rapidly raised to the fixing temperature. After the warm-up, the CPU 13 again causes the switch 15 to select the commercial power source 17 and connect it to the heating element 3 via the driver 14. The heating element 3 therefore receives the AC current from the commercial power source 17. The CPU 13 then controls power source to the heater 3 via the drier 14 such that the surface temperature of the heat roller 1 remains at the fixing temperature.

The illustrative embodiment and first and second modifications thereof each warm up the fixing unit in a short period of time without regard to the limited power of the commercial power source 17. This not only saves power, but also insures safety when temperature control is disabled. The results of a questionnaire showed that if the warm-up time was not longer than the sheet passing time of a fixing unit (generally 4 seconds) plus 2 seconds, a person did not have the feeling of "waiting".

The modification implements static energy of the order of kJ, which is calculated by (½) $CV^2$, required of the fixing unit without resorting to a dangerously high voltage of 1,000 V or above. This, coupled with the fact that the capacitor, in principle, can be repeatedly charged and discharged without any limit, makes the charger maintenance-free.

Moreover, the maximum power available with the limited commercial power source 17 can be fed to the heat source in order to warm up the fixing unit in a short period of time. It is therefore possible to reduce preheating power necessary for the fixing member or the pressing member or even make it practically needless for thereby saving power. In addition, the modification realizes rapid warm-up and guarantees safety when the temperature runs out of control.

Figure 40:
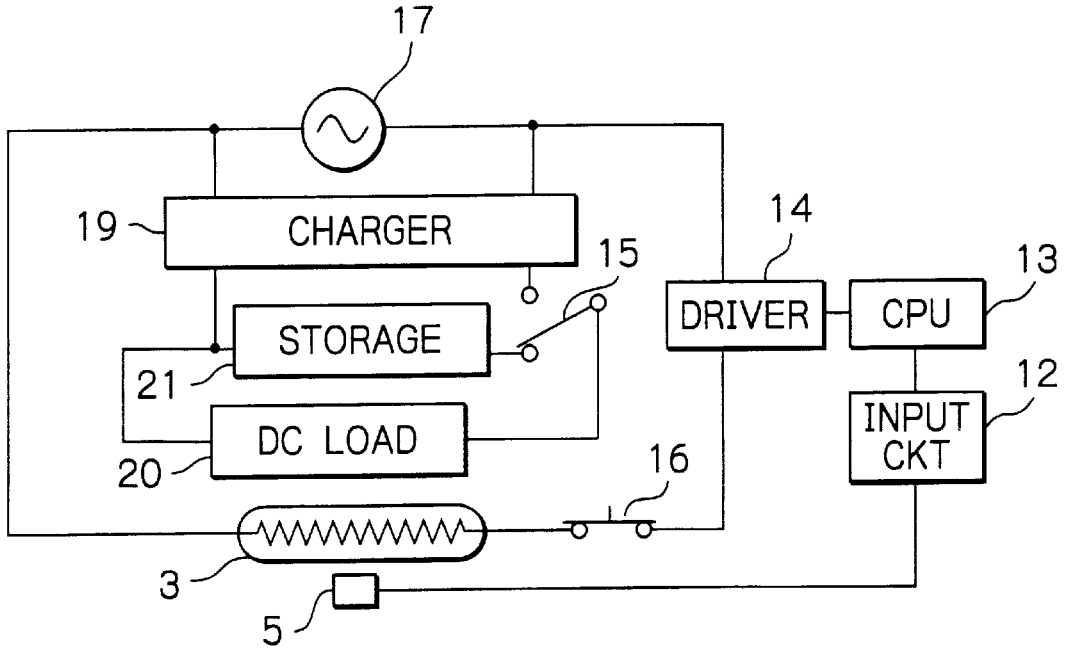
FIG. 40 is a schematic block diagram showing a first modification of the third embodiment.

FIG. 40 shows a third modification of the illustrative embodiment. As shown, this modification includes only the heating element 3 and includes 2 a charger 21 implemented by a storage battery in place of a capacitor. The CPU 13 selectively connects the storage battery 21 to the charger 19 or a DC load (electric circuit) 20 other than the loads of the primary power source (commercial power source 17) included in the image forming apparatus.

Specifically, in the stand-by state, the CPU 13 causes the switch 15 to connect the storage battery 21 to the charger 19. In this condition, the charger 19 transforms the AC power output from the commercial power source 17 to DC power and feeds the DC power to the storage battery 21. When the fixing unit is used, the switch connects the storage battery 21 to the DC load 20 so as to feed a DC current to the DC load. The CPU 13 controls the power supply to the heating element via the driver 14 in accordance with the output of the temperature sensor 5 such that the surface temperature of the heat roller 1 remains at the fixing temperature. In this manner, at the time of warm-up, the commercial power source 17 feeds its power to the heating element 3 via the driver 14, rapidly elevating the surface temperature of the heat roller 1 to the fixing temperature.

This modification also allows the maximum power available with the limited commercial power source 17 to be fed to the heat source in order to warm up the fixing unit to the fixing temperature in a short period of time. It is therefore possible to reduce preheating power necessary for the fixing member or the pressing member or even make it practically needless for thereby saving power. In addition, the modification easily uses the low voltage and great current available with the storage battery to drive the DC load 20.

Figure 41:
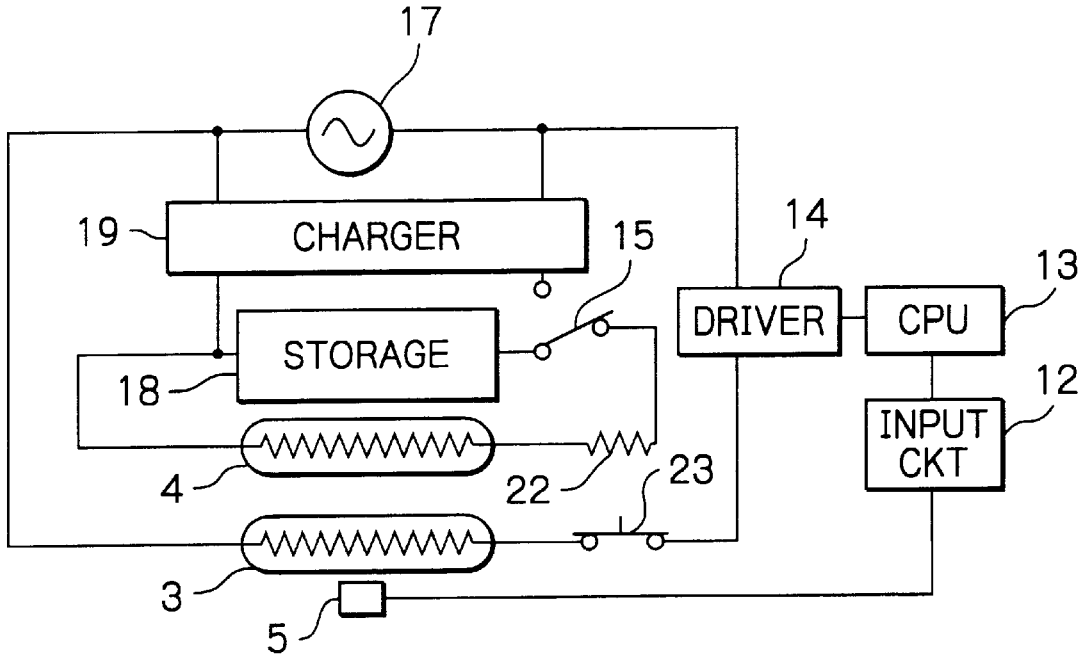
FIG. 41 is a schematic block diagram showing a second modification of the third embodiment.

FIG. 41 shows a fourth modification of the illustrative embodiment. As shown, a miniature heater 22 is serially connected to the heating element 4 in order to heat a thermostat or safety device 23. The thermostat 23 is serially connected to the heating element 3. The thermostat 23 may be replaced with any other suitable safety device, e.g., a temperature fuse.

The thermostat 23 is located at a position for sensing the surface temperature of the heat roller 1, i.e., the fixing temperature. So long as the surface temperature of the heat roller 1 is lower than a preselected temperature (lower than the sheet ignition range, but higher than a fixable temperature), the thermostat 23 remains closed. However, when the surface temperature rises above the upper limit, the thermostat 23 opens to thereby interrupt power source to the heating element 3.

At the time of warm-up, the capacitor or charger 18 drives the miniature heater 22 with a DC current and thereby heats the thermostat 23 to a temperature below the upper limit. Assume that the control over the fixing device is disabled due to, e.g., an error occurred in the CPU 13 or the switch 15. Then, the thermostat 23 immediately opens in order to prevent the surface temperature of the heat roller 1, i.e., the temperature of the fixing unit from rising above the upper limit.

Figure 42:
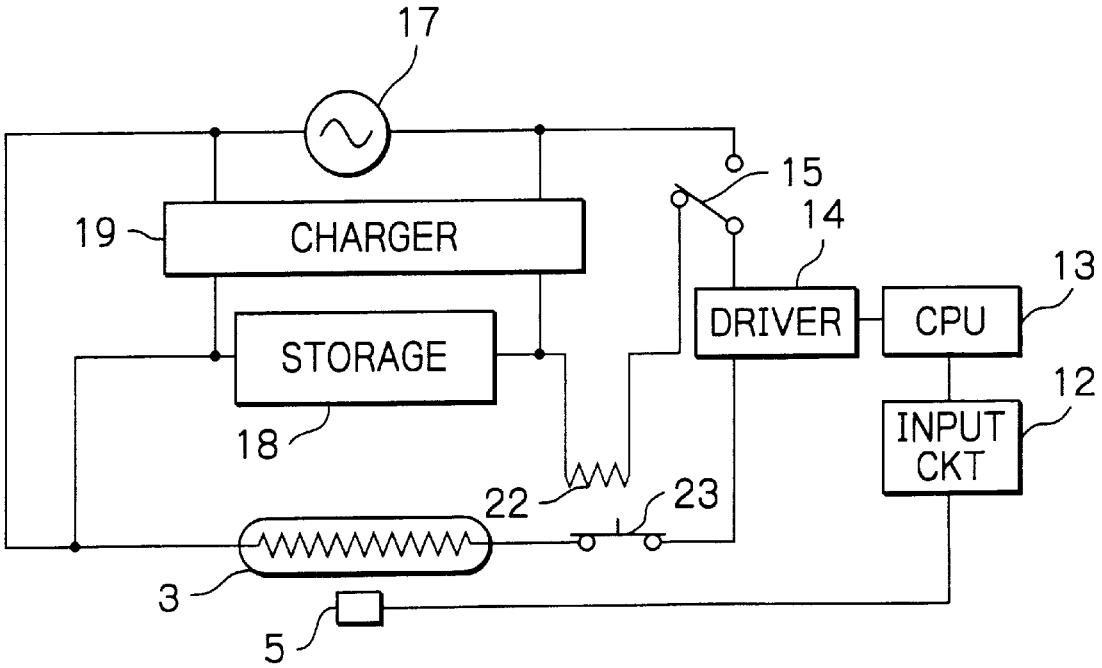
FIG. 42 is a schematic block diagram showing the second modification in which a single heating element is used.

Because the capacitor 18 almost fully discharges within the warm-up time, it does not occur that the miniature heater 22 continuously turns or due to the malfunction of the switch 15 and causes the thermostat 23 to malfunction. When the heating element 4 is omitted, as shown in FIG. 39, the miniature heater 22 should only be serially connected to the capacitor 18, as shown in FIG. 42.

The fourth modification shown and described insures safety when the temperature control is disabled. In the first modification, too, the miniature heater 22 for heating the thermostat 23 may be serially connected to the heating element 3.

Figure 43:
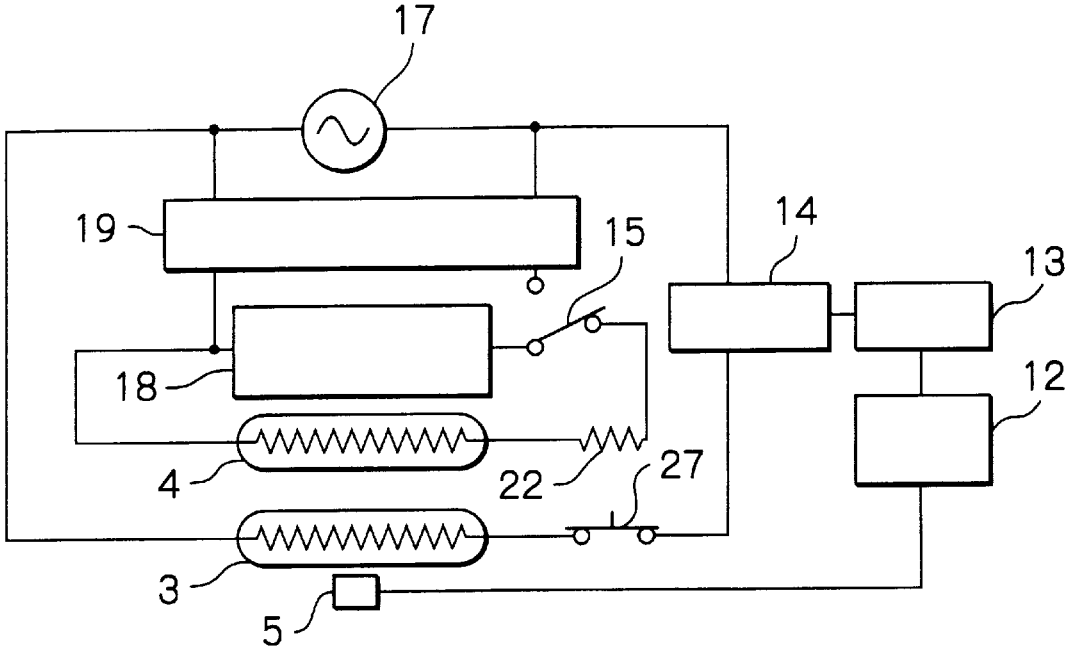
FIGS. 43 and 44 are schematic block diagrams respectively showing a fifth and a sixth modification of the third embodiment.

FIG. 43 shows a fifth modification of the illustrative embodiment similar to the fourth modification except for the following. As shown, use is made of an ordinary safety device, i.e., a thermostat 27 responsive to the temperature of the fixing device and turns off when it rises above an upper limit for thereby interrupting power source from the commercial power source 17 to the heating element 3. The thermostat 27 plays the role of the thermostat 23 at the same time. This modification achieves the same advantage as the fourth modifications.

Figure 44:
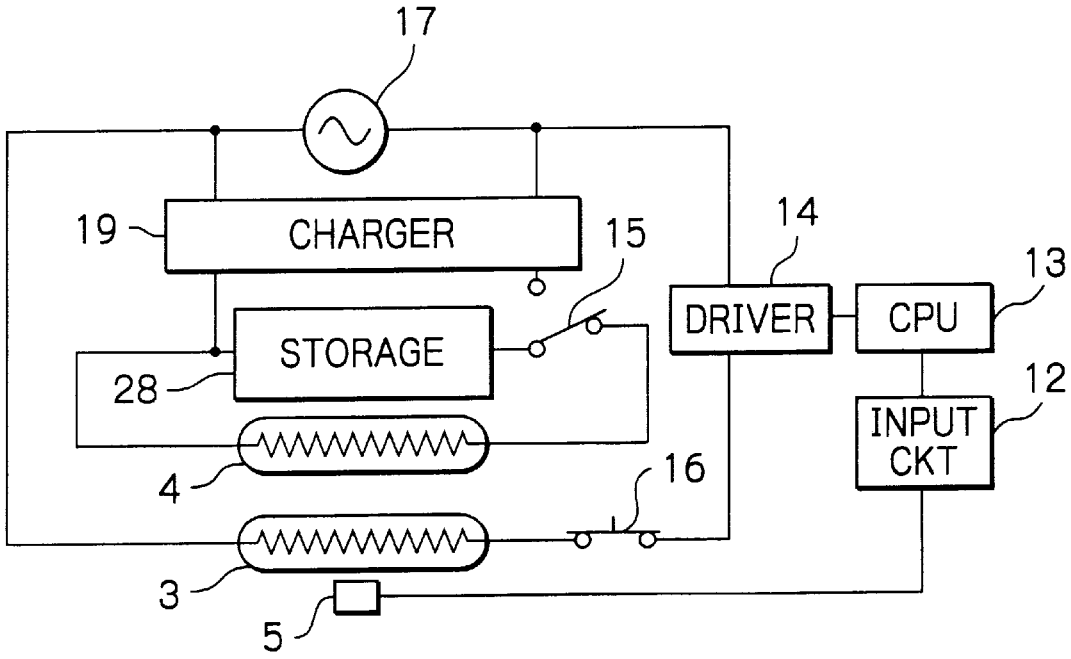
Figure 45:
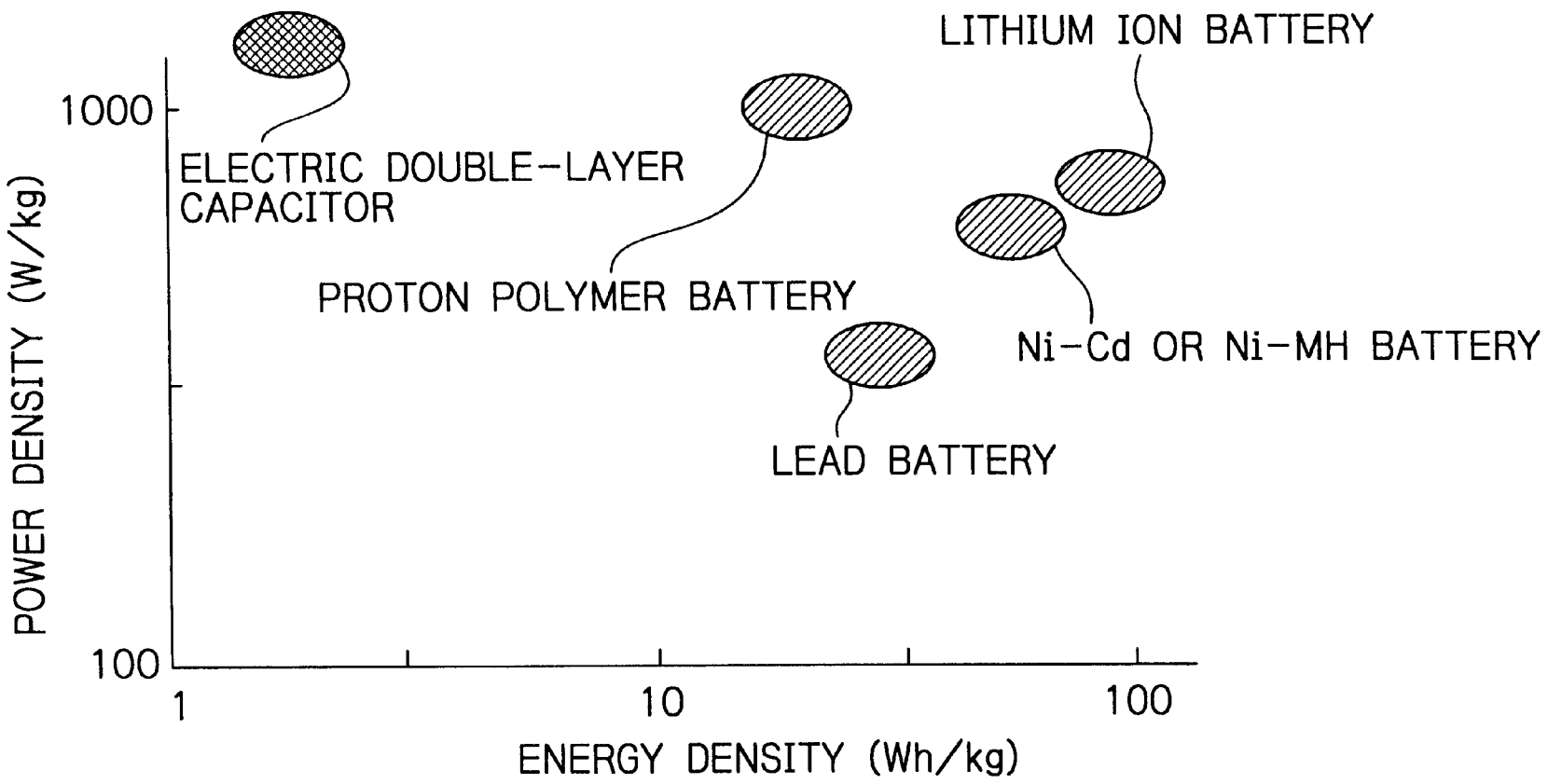
FIG. 45 plots the characteristic of an electric double-layer capacitor and the characteristics of various storage batteries.

FIG. 44 shows an eighth modification of the illustrative embodiment. As shown, the charger 18 is replaced with an electric double-layer capacitor 28. The electric double-layer capacitor 28 may be implemented by a plurality of electric double-layer capacitors connected together and using an organic solvent. As shown in FIG. 45, an electric double-layer capacitor having a capacity of the order of farad has recently been developed. An electric double-layer capacitor has the various advantages stated earlier. The first to fifth modifications may also use an electric double-layer capacitor, if desired.

Figure 46:
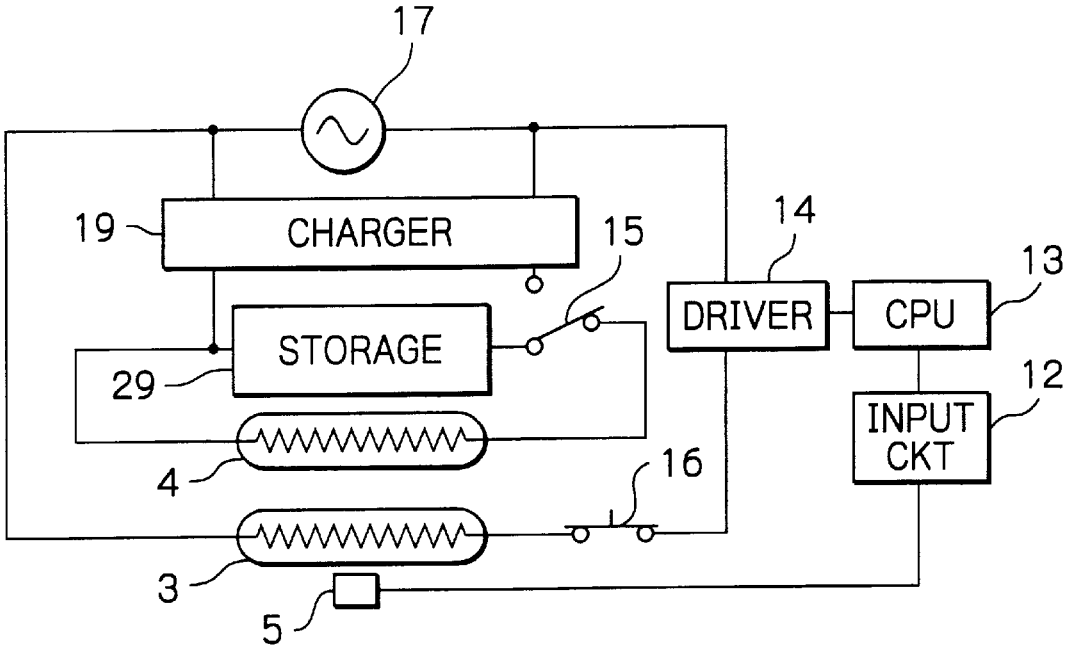
FIGS. 46 and 47 are schematic block diagrams respectively showing a seventh and an eighth modification of the third embodiment.
Figure 47:
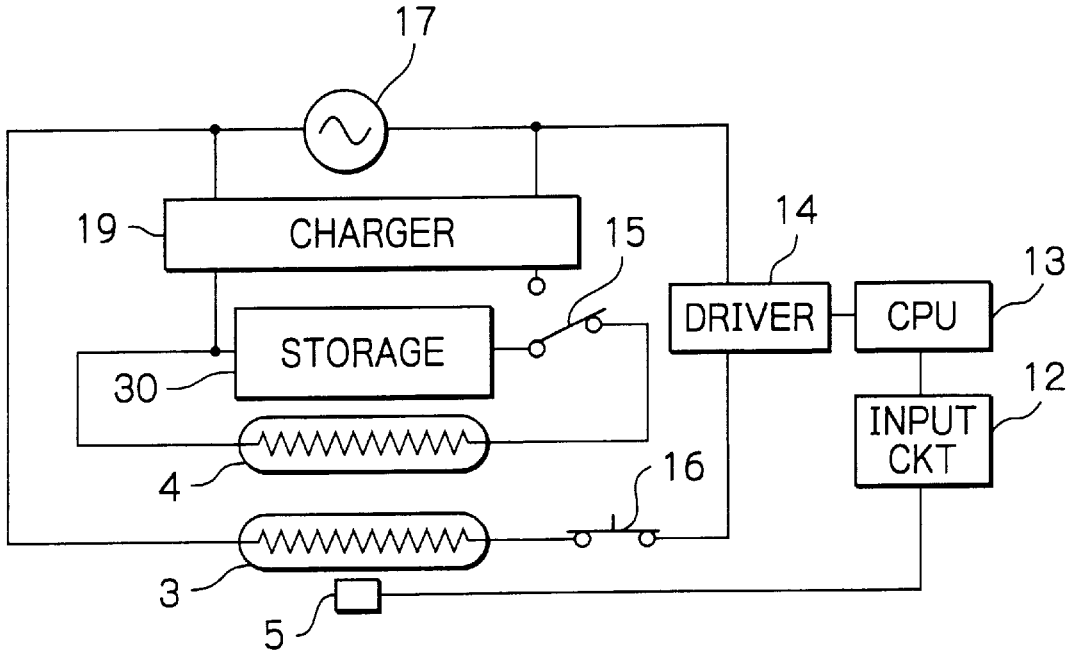

FIG. 46 shows a seventh modification of the illustrative embodiment. As shown, the capacitor 18 is replaced with an electric double-layer capacitor 29 using an aqueous solution. For the electric double-layer capacitor 29, use may be made of a connection of a plurality of electrolytic capacitors. An electric double-layer capacitor can discharge great current in a shorter period of than the other electric double-layers capacitors. It is therefore possible to realize rapid warm-up and safety in the event of the failure of temperature control and to reduce environmental loads ascribable to waste matters. The double-layer capacitor 29 is similarly applicable to the first to fifth modifications.

FIG, 47 shows an eighth modification of the illustrative embodiment. As shown, the capacitor or charger 18 is replaced with a proton polymer battery 30. Japanese Patent Laid-Open Publication No. 11-288171, for example, discloses a proton polymer battery including a electrode, which contains an electrode active substance, and a solid state electrolyte. Only the adsorption and separation of protons of the electrode active substance join in the interchange of electrons, which is derived from the oxidation reduction of the electrode active substance. As shown in FIGS. 45 and 48, among various dry batteries, a proton polymer battery is easiest to instantaneously output great current and easiest to handle. Further, a proton polymer battery can be repeatedly charged and discharged several ten thousand times, i.e., has a long life. By contrast, conventional secondary batteries withstand 500 times to 1,000 times of repeated charging and discharging. A proton polymer battery is similarly applicable to the first to fifth modifications.

Figure 49:
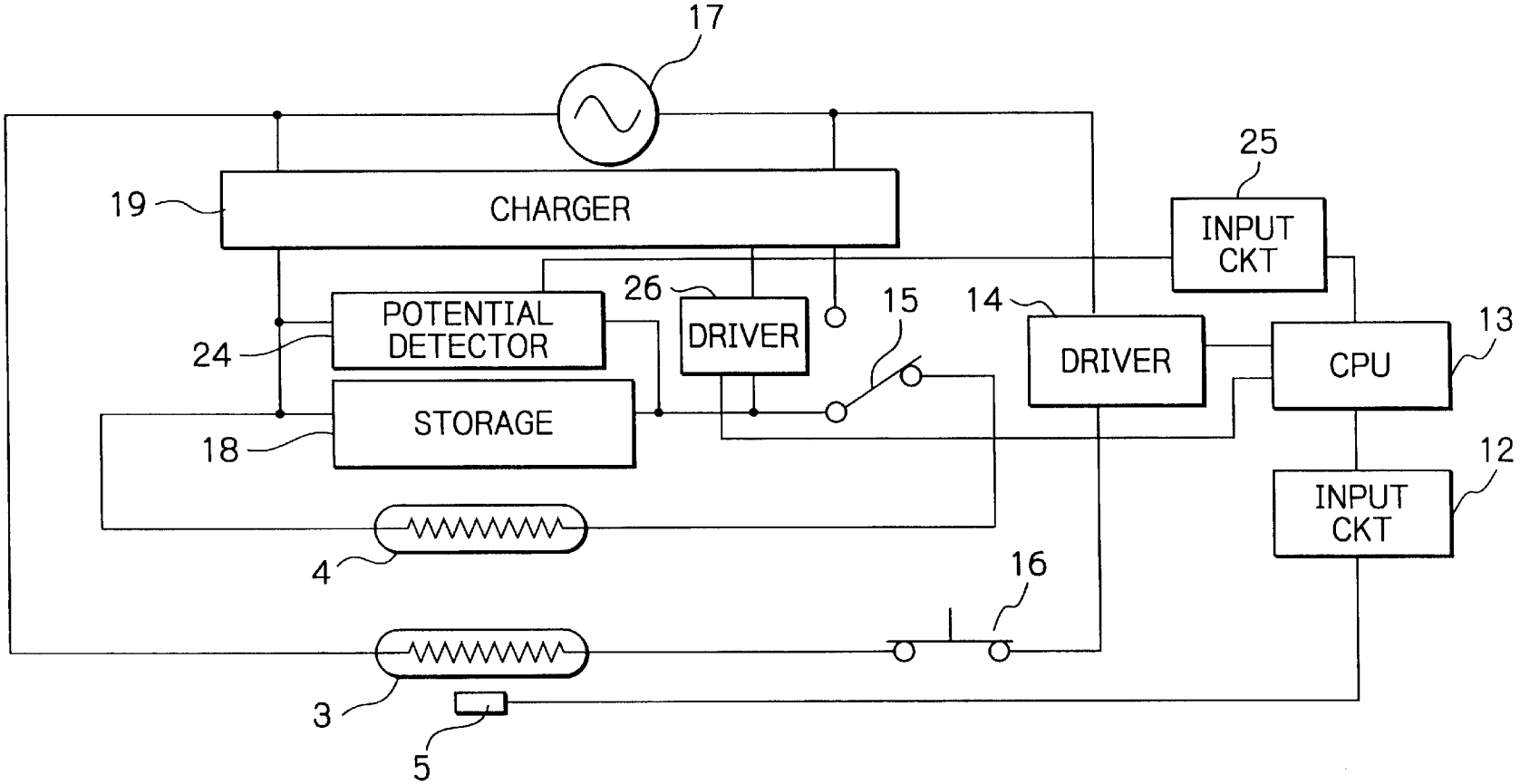
FIGS. 49 through 51 are block diagrams respectively showing a ninth, a tenth and an eleventh modification of the third embodiment.

FIG. 49 shows a ninth modification of the illustrative embodiment. As shown, a potential detector 24 detects a voltage between opposite ends of the capacitor 18 and delivers its output to the CPU 13 via an input circuit 25. The temperature sensor 5 is responsive to the surface temperature of the heat roller 1 (fixing temperature) and delivers its output to the CPU 13 via the input circuit 12, The charger 19 transforms the AC power output from the commercial power source 17 to DC power and feeds the DC power to the capacitor or charger 18 via the driver 26. In this modification, the following relation holds:

(fixable temperature−surface temperature of roller 1 or 8 in stand-by state)×thermal capacity of roller 1 or 8

W of power source 17×warm-up time+energy stored in capacitor 18).

Also, there holds a relation:

voltage between opposite ends of capacitor energy stored in capacitor 18

It follows that the voltage between opposite ends of the capacitor 18 should preferably be raised as the surface temperature of the heat roller 1 in the stand-by state is lowered.

The CPU 13 controls, in accordance with the outputs of the potential sensor 24 and temperature sensor 5, the driver 26 such that the voltage between opposite ends of the capacitor 18, as detected by the potential detector 24, increases with a decrease in the surface temperature of the heat roller 1. As a result, the energy stored in the capacitor 18 varies in accordance with the fixing temperature in the stand-by state. More specifically, the capacitor 18 stores more energy as the surface temperature of the heat roller 1 (fixing temperature) drops, maintaining the warm-up time substantially constant and minimizing the energy to be stored in the capacitor 18. This configuration is similarly applicable to the first, second and fourth through eighth modifications described previously.

Figure 50:
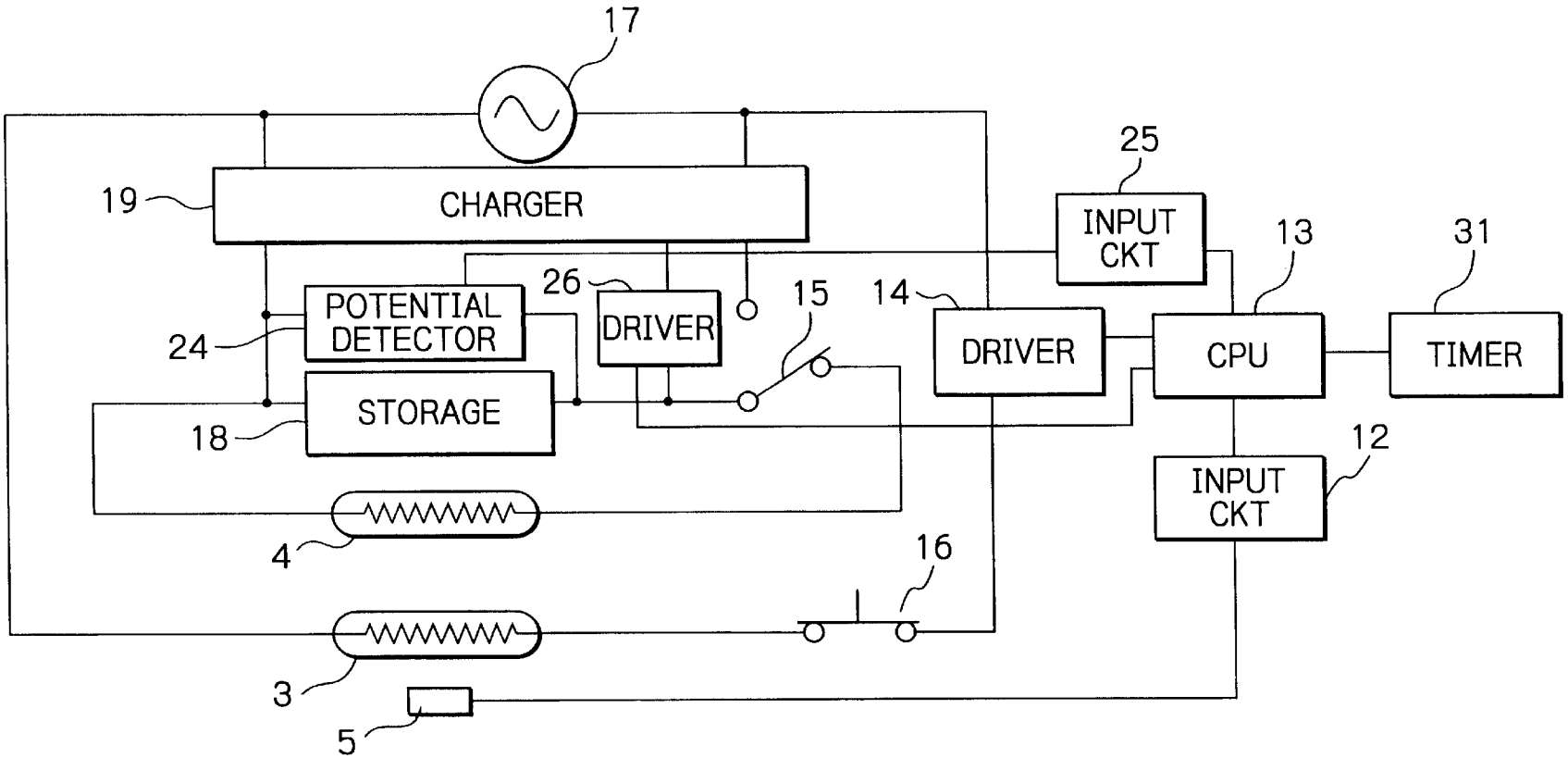

FIG. 50 shows a tenth modification of the illustrative embodiment similar to the ninth embodiment. As shown, the tenth modification additionally includes a timer 31 for counting a waiting time every time the fixing unit takes the stand-by state. The CPU 13 controls the driver 26 such that the voltage detected by the potential detector 24 rises as the above waiting time increases. This modification achieves the same advantages as the ninth modification. The timer scheme may also be applied to any one of the first, second and fourth to eighth modifications.

Figure 51:
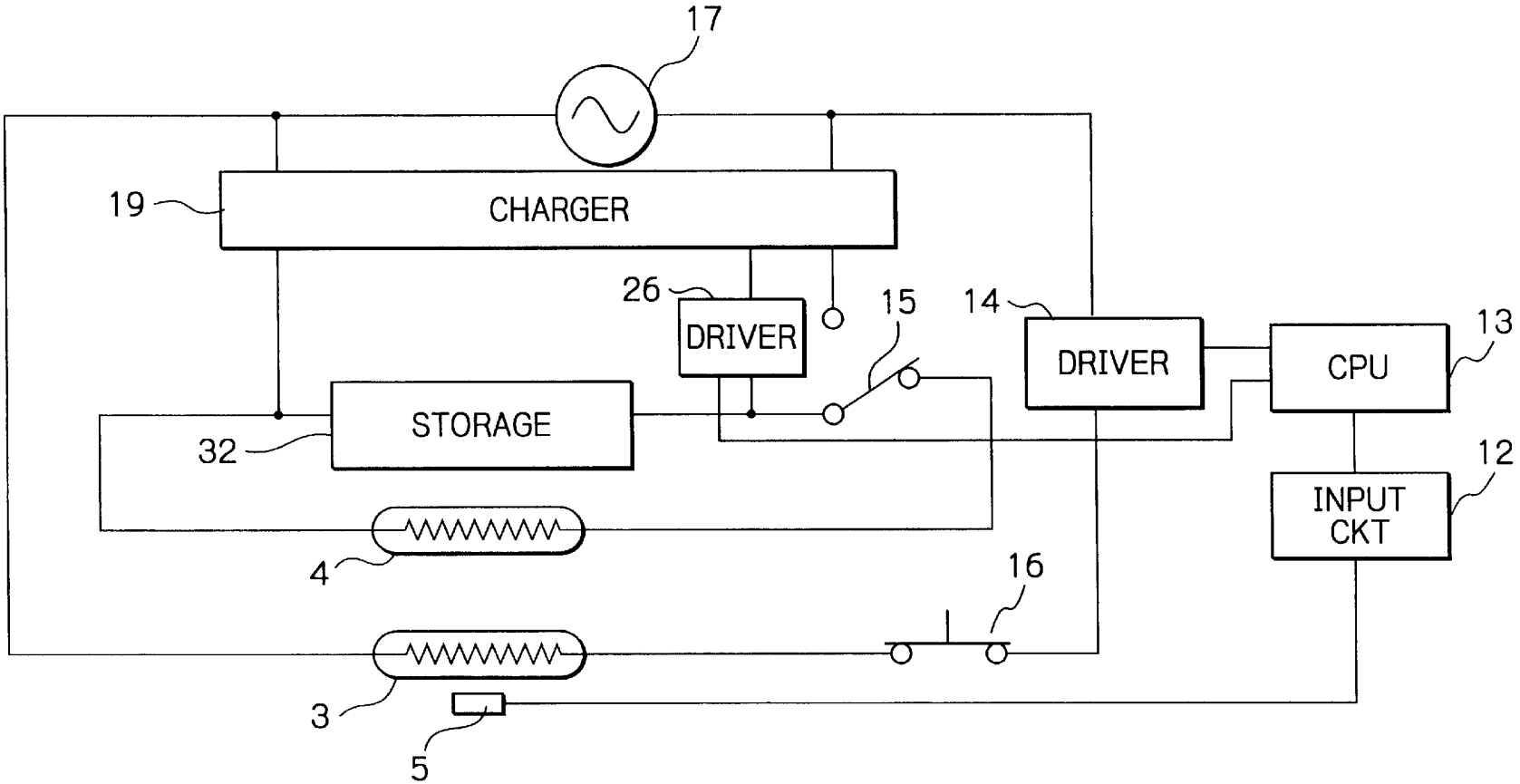

FIG. 51 shows an eleventh modification of the illustrative embodiment. As shown, this modification is similar to the ninth modification except that the potential detector 24 and input circuit 25 are omitted, and that the capacitor 18 is replaced with a storage battery to be charged by the charger 19 at the time of warm-up of the fixing device. At the time of warm-up, the CPU 13 controls the driver in accordance with the output of the temperature sensor 5 such that the duration of discharge from the storage battery increases with a drop of the surface temperature of the heat roller in the stand-by state. Consequently, the duration of discharge from the storage battery varies in accordance with the fixing temperature in the stand-by state. More specifically, the storage battery continuously discharges over a longer period of time as the surface temperature of the heat roller 1 in the stand-by state drops, thereby maintaining the warm-up time substantially constant and minimizing the discharge from the storage battery.

Figure 52:
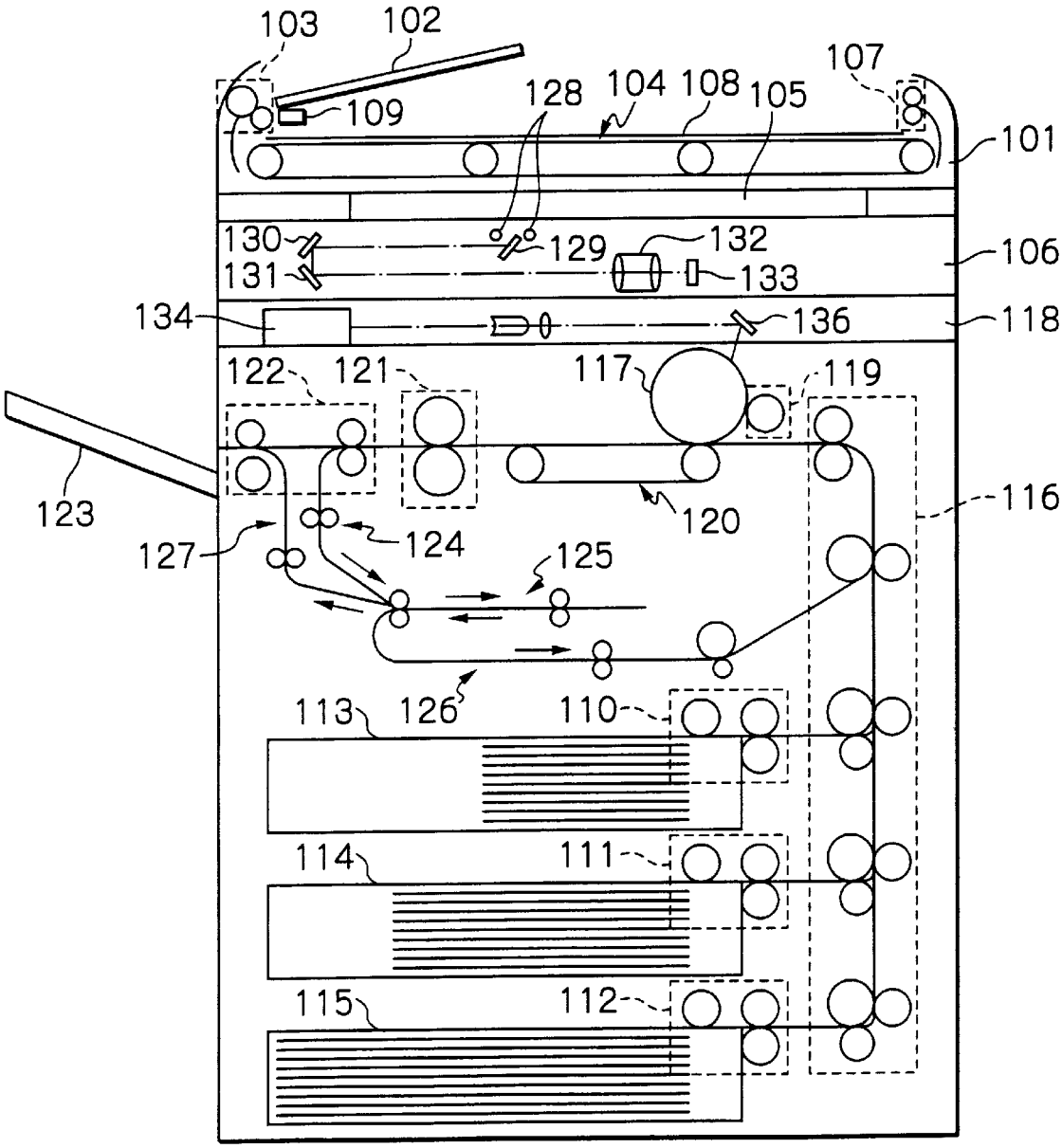
FIG. 52 is a section showing an image forming apparatus to which the third embodiment is applied.

FIG. 52 shows an image forming apparatus to which the illustrative embodiment is applied and having, e.g., a printer function and a facsimile function in addition to a copier function. The operator of the apparatus is capable of operating an application switch key provided on an operation panel in order to sequentially select the above functions.

In the copier mode, the operator stacks documents on a document tray 102 included in an ADF (Automatic Document Feeder) 101 face up and then pushes a start key positioned on the operation panel. In response, a pickup roller 103 and a belt conveyor 104 convey the bottom sheet to a preselected position on a glass platen 105. The ADF 101 has a counting function for counting up a document every time it feeds the document. A scanner or image inputting means 106 reads the document positioned on the glass platen 105. Thereafter, the belt conveyor 104 and an outlet roller pair 107 drive the document out of the apparatus to a tray 108. A motor drives the feed roller 3, belt conveyor 4, and outlet roller pair 7.

A document set sensor 109 determines whether or not the next document is present on the document tray 102. The next document, if present on the document tray 102, is dealt with in the same manner as the preceding document.

A first, a second and a third sheet feeder 110, 111 and 112, respectively, each are loaded with a stack of sheets and constitute sheet feeding means in combination. A sheet fed from any one of the sheet feeders 110 through 112 selected is conveyed to a position where it contacts a photoconductive drum or image carrier 117 by a vertical conveyor unit 116. A main motor causes the drum 117 to rotate.

Image processing means, not shown, processes image data output from the scanner 106 and feeds the processed image data to an optical writing unit 118. After a charger, not shown, has uniformly charged the surface of the drum 117, the optical writing unit 118 scans the charged surface of the drum 117 with a light beam modulated in accordance with the image data to thereby form a latent image. A developing unit 119 develops the latent image for thereby producing a corresponding toner image.

A power source, not shown, applies a bias for image transfer to the belt conveyor 120, which plays the role of sheet conveying means and image transferring means at the same time. While the belt conveyor 120 conveys the sheet at the same linear velocity as the drum 117, the toner image is transferred from the drum 117 to the sheet due to the bias applied to the belt conveyor 120. A fixing device 121 fixes the toner image on the sheet. The sheet coming out of the fixing device 121 is driven out to a print tray 123 by a sheet discharge unit 122. A drum cleaner cleans the surface of the drum 117 after the image transfer.

The drum 117, charger, optical writing unit 118, developing unit 119 and image transferring means constitute an image forming means for forming an image on a sheet in accordance with image data.

The procedure described above pertains to a simplex copy mode as distinguished from a duplex copy mode. In the duplex copy mode for forming images on both sides of a sheet, the sheet fed from any one of the sheet trays 113 through 115 and carrying an image on one side thereof is steered by the sheet discharged unit 122 into a duplex copy path 124. A turning unit 125 switches back the sheet entered the duplex copy path 124 to thereby turn the sheet upside down and then hands it over to a duplex conveyor unit 126.

The duplex conveyor unit 126 conveys the sheet to the vertical conveyor unit 116. The vertical conveyor unit 116 again conveys the sheet to the drum 117, so that another toner image is transferred from the drum 117 to the other side of the sheet. The fixing device 121 again fixes this toner image on the sheet to thereby produce a duplex copy. At this time, the sheet discharge unit 122 discharges the duplex copy to the copy tray 123.

When the sheet or print should be turned upside down and then driven out to the tray 123, the sheet turned upside down by the turning unit 125 is directly discharged to the copy tray 123 by the discharge unit 122.

The printer mode is identical with the copier mode except that image data fed from the outside of the apparatus are input to the optical writing unit 118 in place of the image data output from the image processing means.

In the facsimile mode, the image data output from the image reading means are sent to a desired destination via a facsimile transmitter/receiver not shown. Image data from a sending station are input to the facsimile transmitter/receive and delivered to the optical writing unit 118. The image forming means forms an image on a sheet in accordance with the received image data.

When the operator standing by the apparatus selects the copier function, it is necessary to instantaneously warm up the fixing unit 121. Only in the copier mode, the CPU 13 causes the storage to operate via the switch 15, as stated previously. The charger drives the heating element 4. In the point mode or the facsimile mode, the CPU 13 does not cause the storage to operate via the switch 15, i.e., does not cause it to drive the heating element 4. This successfully minimizes the number of times of operation of the charger and thereby extends the life of the charger while promoting rapid warm-up. The fixing unit 121 may have any one of the configurations of the first to eleventh modifications.

Figure 53:
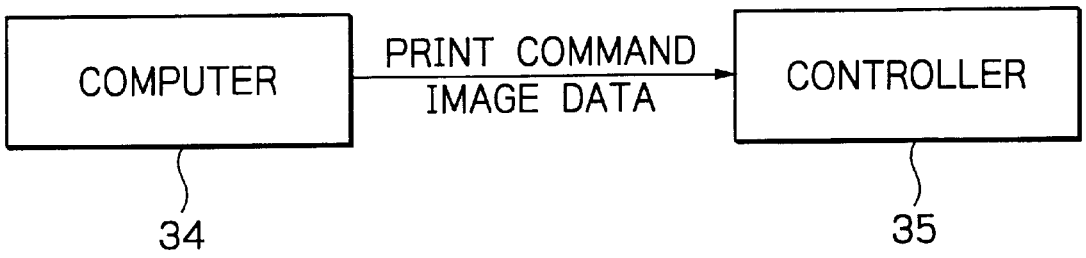
FIGS. 53 and 54 are schematic block diagrams showing a control circuit included in the third embodiment.

As shown in FIG. 53, the illustrative embodiment allows a person to input desired one of a plurality of different print commands to a controller 35 via a computer 34. The print commands include a usual print command for executing the print mode at an ordinary speed and a rapid print command for executing it at a higher speed in a shorter period of time.

When the usual print command is input to the controller 35 via the computer 34, the controller 35 sets up a usual print mode and controls the printer function in order to effect printing at a usual speed. Image data are input from the computer 34 to the writing unit 118 in place of the image data output from the image processing means. The image forming means forms an image on a sheet at the usual speed in accordance with the image data.

When the rapid print command is input to the controller 35 via the computer 24, the controller 35 sets up a rapid print mode and controls the printer function in order to effect printing in a shorter period of time (at a higher speed) than in the usual print mode. Image data are input from the computer 34 to the writing unit 118 in place of the image data output from the image processing means. In this case, the image forming means forms an image on a sheet at a speed higher than in the usual print mode in accordance with the image data.

When the controller receives the usual print command from the computer 34, it informs the CPU 13 of the usual print mode. In response, the CPU 13 does not cause the storage to operate via the switch 15, i.e., prevents the storage from driving the heating element 4. On receiving the rapid print command, the controller 35 causes the CPU 13 to operate the switch 15 such that the storage drives the heating element 4, as stated earlier. This also successfully minimizes the number of times of operation of the charger and thereby extends the life of the charger while promoting rapid warm-up.

Figure 54:
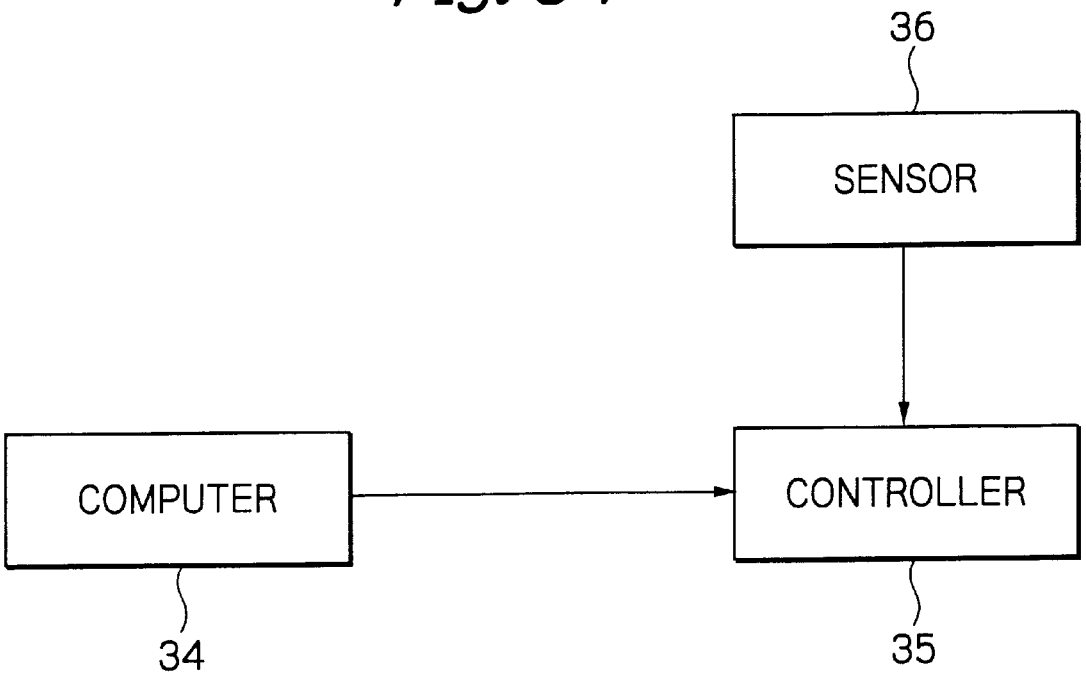

FIG. 54 shows a modified form of the arrangement of FIG. 53. As shown, the modified arrangement includes a sensor 36 response to a human body, but does not include the rapid print command. When the sensor 36 senses a human body, the controller 35 determines than a person is standing around the apparatus in response to the resulting output of the sensor 36. The controller 35 then automatically sets up the rapid print mode and effects printing in a shorter period of time (at a higher speed) than usual. Consequently, the image forming means forms an image on a sheet at a higher speed than usual in accordance with image data input from the computer 34.

So long as the sensor 35 does not sense a human body, the controller 35 sets up the usual print mode in response to the usual print command received from the computer 34. The controller 35 then effects printing at the usual mode. Consequently, the image forming means forms an image on a sheet at the usual speed in accordance with image data input from the computer 34.

Figure 55:
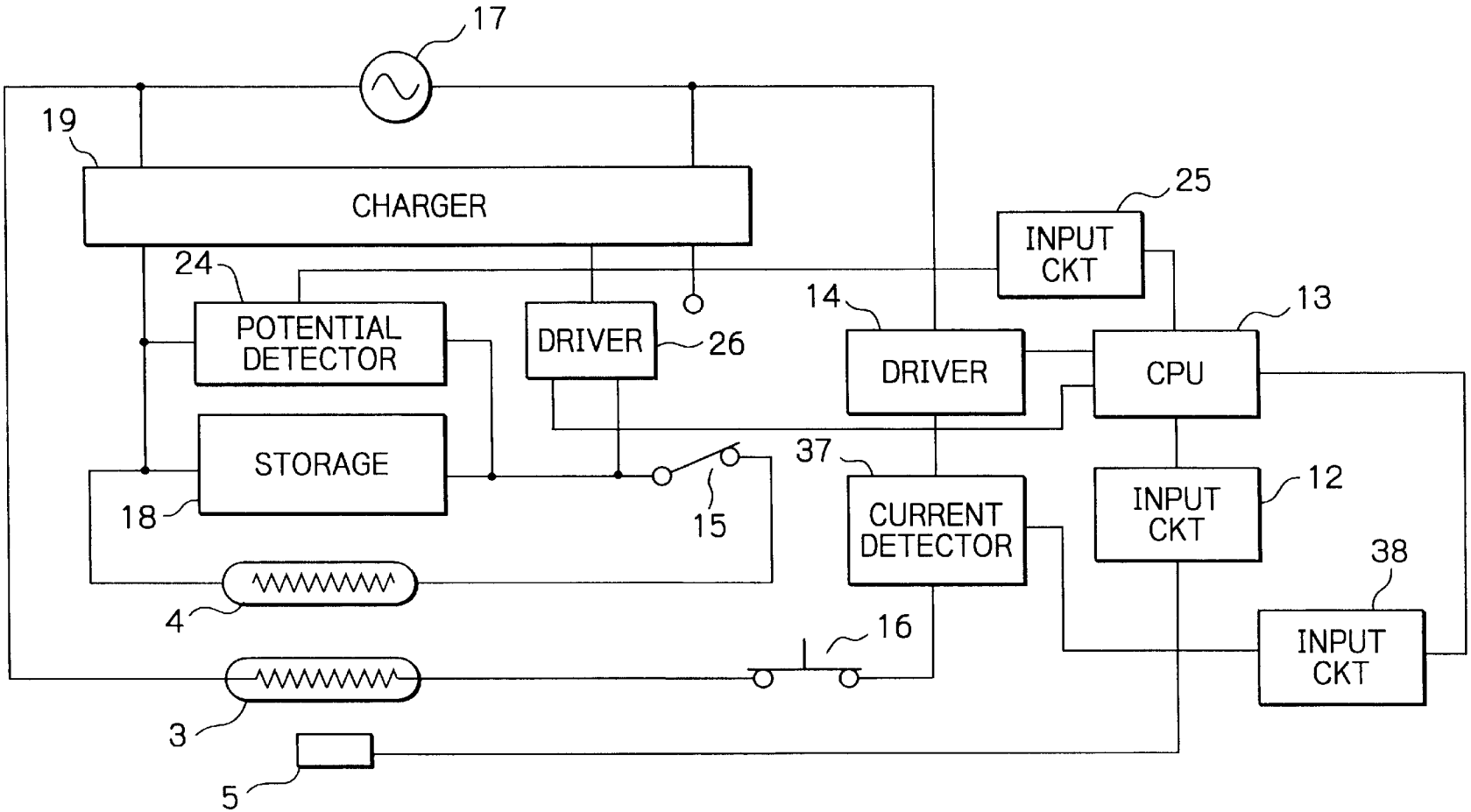
FIG. 55 is a schematic block diagram showing a twelfth modification of the third embodiment.

FIG. 55 shows a twelfth modification of the illustrative embodiment similar to the tenth modification. As shown, the output of the potential detector 24 responsive to a voltage between opposite ends of the capacitor 18 is input to the CPU 13 via the input circuit 25. A current detector 37 detects a current being discharged from the capacitor 18 while sending its output to the CPU 13 via an input circuit 38.

The CPU 13 determines, at preselected intervals, the internal resistance of the capacitor 18 on the basis of the voltage and current detected by the potential detector 24 and current detector 37, respectively. When the internal resistance becomes two times as high as the initial internal resistance of the capacitor 18, the CPU 13 determines that the life of the capacitor 18 has ended. The CPU 13 then displays a warning on the operation panel or inhibits the copier mode from being selected on setting means or cancels it. The capacitor 18 whose life is long can therefore be collected and reused when the apparatus is to be discarded. This promotes the effective use of limited resources and reduces waste matters as well as cost. This internal resistance scheme is similarly applicable to the illustrative embodiment and any one of the sixth and seventh modifications thereof.

A thirteenth modification of the illustrative embodiment is similar to the twelfth modification except for the following. When the internal resistance of the capacitor 18 becomes two times as high as the initial internal resistance, the CPU 13 determines that the life of the capacitor 18 has ended. The CPU 13 then inhibits the rapid print mode from being selected and thereby presents the capacitor 18 from discharging. This modification achieves the same advantages as the twelfth modification.

A fourteenth modification of the illustrative embodiment is unique in that the date of production of the capacitor or charger 18 is printed or otherwise provided on the capacitor 18. This allows the capacitor 18 to be collected and reused at an adequate time. This kind of scheme is similarly applicable to the sixth and seventh modifications.

Various modifications will become possible for those skilled in the art after receiving the teachings of the present disclosure without departing from the scope thereof.

What is claimed is:

1. A heating device comprising:

a main power source;

an auxiliary power source comprising a chargeable capacitor;

a heater comprising a main heating element configured to heat when supplied with power from said main power source and an auxiliary heating element configured to heat when supplied with power from said auxiliary power source;

a charger configured to charge said capacitor of said auxiliary power source when supplied with power from said main power source;

a switch configured to selectively cause said auxiliary power source to be charged or to feed power to said auxiliary heating-element; and a controller configured to adjust the power to be fed from said auxiliary power source to said auxiliary heating element by at least shutting off power supply from said auxiliary power source to said auxiliary heating element when a preselected period of time elapses since a start of said power supply.

2. The device as claimed in claim 1, wherein said switch connects said auxiliary power source to said charger when said controller shuts off the power supply from said auxiliary power source to said auxiliary heating element.

3. The device as claimed in claim 1, wherein said auxiliary power source comprises a plurality of cells.

4. The device as claimed in claim 3, further comprising a switching device for serially connecting said plurality of cells when said device is used.

5. The device as claimed in claim 4, wherein said plurality of cells are sequentially charged one by one.

6. The device as claimed in claim 4, wherein said switching device connects said plurality of cells in parallel when said plurality of cells are to be charged.

7. A heating device comprising:

a main power source;

an auxiliary power source comprising a chargeable capacitor;

a heater comprising a main heating element configured to heat when supplied with power from said main power source and an auxiliary heating element configured to heat when supplied with power from said auxiliary power source;

a charger for charging said capacitor of said auxiliary power source when supplied with power from said main power source;

a switch for selectively causing said auxiliary power source to be charged or to feed power to said auxiliary heating element;

a residual power detector for detecting power remaining in said auxiliary power source; and a controller for adjusting power to be fed from said auxiliary power source to said auxiliary heating element in accordance with an output of said residual power detector representative of the power remaining in said auxiliary power source.

8. The device as claimed in claim 7, wherein said controller shuts off power supply from said auxiliary power source to said auxiliary heating element when the power remaining in said auxiliary power source decreases to a preselected value.

9. The device as claimed in claim 7, wherein said auxiliary power source comprises a plurality of cells.

10. The device as claimed in claim 9, further comprising a switching device for serially connecting said plurality of cells when said device is used.

11. The device as claimed in claim 10, wherein said plurality of cells are sequentially charged one by one.

12. The device as claimed in claim 10, wherein said switching device connects said plurality of cells in parallel when said plurality of cells are to be charged.

13. A heating device comprising:

a main power source;

an auxiliary power source comprising a chargeable capacitor;

a heater comprising a main heating element configured to heat when supplied with power from said main power source and an auxiliary heating element configured to heat when supplied with power from said auxiliary power source;

a charger for charging said capacitor of said auxiliary power source when supplied with power from said main power source;

a switch for selectively causing said auxiliary power source to be charged or to feed power to said auxiliary heating element;

a temperature sensor for sensing a temperature of said heater; and a controller for controlling power to be fed from said auxiliary power source to said auxiliary heating element in accordance with a temperature of said heater.

14. The device as claimed in claim 13, wherein said auxiliary power source comprises a plurality of cells.

15. The device as claimed in claim 14, further comprising a switching device for serially connecting said plurality of cells when said device is used.

16. The device as claimed in claim 15, wherein said plurality of cells are sequentially charged one by one.

17. The device as claimed in claim 15, wherein said switching device connects said plurality of cells in parallel when said plurality of cells are to be charged.

18. A heating device comprising:

a main power source;

an auxiliary power source comprising a chargeable capacitor;

a heater comprising a main heating element configured to heat when supplied with power from said main power source and an auxiliary heating element configured to heat when supplied with power from said auxiliary power source;

a charger for charging said capacitor of said auxiliary power source when supplied with power from said main power source;

a switch for selectively causing said auxiliary power source to be charged or to feed power to said auxiliary heating element;

a switching device for selectively causing said auxiliary power source to be charged or to feed power to said auxiliary heating element; and a temperature controller for adjusting the power to be fed from said auxiliary power source to said auxiliary heating element in accordance with a variation of temperature of said heater.

19. The device as claimed in claim 18, wherein said auxiliary power source comprises a plurality of cells.

20. The device as claimed in claim 19, further comprising a switching device for serially connecting said plurality of cells when said device is used.

21. The device as claimed in claim 20, wherein said plurality of cells are sequentially charged one by one.

22. The device as claimed in claim 20, wherein said switching device connects said plurality of cells in parallel when said plurality of cells are to be charged.

23. A fixing device for fixing a toner image formed on a recording medium, comprising:

a heating device comprising:

a main power source;

an auxiliary power source comprising a chargeable capacitor;

a heater comprising a main heating element configured to heat when supplied with power from said main power source and an auxiliary heating element configured heat when supplied with power from said auxiliary power source;

a charger for charging said capacitor or said auxiliary power source when supplied with power from said main power source;

a switch for selectively causing said auxiliary power source to be charged or to feed power to said auxiliary heating element; and a controller for adjusting the power to be fed from said auxiliary power source to said auxiliary heating element; and a heat roller accommodating said heater.

24. A fixing device for fixing a toner image formed on a recording medium, comprising:

a heating device comprising:

a main power source;

an auxiliary power source comprising a chargeable capacitor;

a heater comprising a main heating element configured to heat when supplied with power from said main power source and an auxiliary heating element configured to heat when supplied with power from said auxiliary power source;

a charger for charging said capacitor of said auxiliary power source when supplied with power from said main power source;

a switch for selectively causing said auxiliary power source to be charged or to feed power to said auxiliary heating element;

a residual power detector for detecting power remaining in said auxiliary power source; and a controller for adjusting power to be fed from said auxiliary power source to said auxiliary heating element in accordance with an output of said residual power detector representative of the power remaining in said auxiliary power source; and a heat roller accommodating said heater.

25. A fixing device for fixing a toner image formed on a recording medium, comprising:

a heating device comprising:

a main power source;

an auxiliary power source comprising a chargeable capacitor;

a heater comprising a main heating element configured to heat when supplied with power from said main power source and an auxiliary heating element configured to heat when supplied with power from said auxiliary power source;

a charger for charging said capacitor of said auxiliary power source when supplied with power from said main power source;

a switch for selectively causing said auxiliary power source to be charged or to feed power to said auxiliary heating element;

a temperature sensor for sensing a temperature of said heater; and a controller for controlling power to be fed from said auxiliary power source to said auxiliary heating element in accordance with a temperature of said heater; and a heat roller accommodating said heater.

26. A fixing device for fixing a toner image formed on a recording medium, comprising:

a heating device comprising:

a main power source;

an auxiliary power source comprising a chargeable capacitor;

a heater comprising a main heating element configured to heat when supplied with power from said main power source and an auxiliary heating element configured to heat when supplied with power from said auxiliary power source;

a charger for charging said capacitor of said auxiliary power source when supplied with power from said main power source;

a switch for selectively causing said auxiliary power source to be charged or to feed power to said auxiliary heating element;

a switching device for selectively causing said auxiliary power source to be charged or to feed power to said auxiliary heating element; and a temperature controller for adjusting the power to be fed from said auxiliary power source to said auxiliary heating element in accordance with a variation of temperature of said heater; and a heat roller accommodating said heater.

27. In an image forming apparatus including a fixing device for fixing a toner image electrophotographically formed on a recording medium by melting said toner image, said fixing device comprising:

a heating device comprising:

a main power source;

an auxiliary power source comprising a chargeable capacitor;

a heater comprising a main heating element configured to heat when supplied with power from said main power source and an auxiliary heating element configured to heat when supplied with power from said auxiliary power source;

a charger for charging said capacitor of said auxiliary power source when supplied with power from said main power source;

a switch for selectively causing said auxiliary power source to be charged or to feed power to said auxiliary heating element; and a controller for adjusting the power to be fed from said auxiliary power source to said auxiliary heating element; and a heat roller accommodating said heater.

28. In an image forming apparatus including a fixing device for fixing a toner image electrophotographically formed on a recording medium by melting said toner image, said fixing device comprising:

a heating device comprising:

a main power source;

an auxiliary power source comprising a chargeable capacitor;

a heater comprising a main heating element configured to heat when supplied with power from said main power source and an auxiliary heating element configured to heat when supplied with power from said auxiliary power source;

a charger for charging said capacitor of said auxiliary power source when supplied with power from said main power source;

a switch for selectively causing said auxiliary power source to be charged or to feed power to said auxiliary heating element;

a residual power detector for detecting power remaining in said auxiliary power source; and a controller for adjusting power to be fed from said auxiliary power source to said auxiliary heating element in accordance with an output of said residual power detector representative of the power remaining in said auxiliary power source; and a heat roller accommodating said heater.

29. In an image forming apparatus including a fixing device for fixing a toner image electrophotographically formed on a recording medium by melting said toner image, said fixing device comprising:

a heating device comprising:

a main power source;

an auxiliary power source comprising a chargeable capacitor;

a heater comprising a main heating element configured to heat when supplied with power from said main power source and an auxiliary heating element configured to heat when supplied with power from said auxiliary power source;

a charger for charging said capacitor or said auxiliary power source when supplied with power from said main power source;

a switch for selectively causing said auxiliary power source to be charged or to feed power to said auxiliary heating element;

a temperature sensor for sensing a temperature of said heater; and a controller for controlling power to be fed from said auxiliary power source to said auxiliary heating element in accordance with a temperature of said heater; and a heat roller accommodating said heater.

30. In an image forming apparatus including a fixing device for fixing a toner image electrophotographically formed on a recording medium by melting said toner image, said fixing device comprising:

a heating device comprising:

a main power source;

an auxiliary power source comprising a chargeable capacitor;

a heater comprising a main heating element configured to heat when supplied with power from said main power source and an auxiliary heating element configured to heat when supplied with power from said auxiliary power source;

a charger for charging said capacitor of said auxiliary power source when supplied with power from said main power source;

a switching device for selectively causing said auxiliary power source to be charged or to feed power to said auxiliary heating element; and a temperature controller for adjusting the power to be fed from said auxiliary power source to said auxiliary heating element in accordance with a variation of temperature of said heater; and a heat roller accommodating said heater.

31. A fixing device for fixing a toner image formed on a sheet-like recording medium, comprising:

a heat source comprising at least two heating elements including a first heating element configured to receive power from a commercial power source and a second heating element configured to receive power from a chargeable storage;

at least one of a fixing member and a pressing member configured to be heated by said heat source; and drive means comprising said chargeable storage and a charger supplied with power from the commercial power source for charging said chargeable storage, wherein said storage comprises a capacitor having a capacity great enough to store total energy of 1 kJ or above.

32. The device as claimed in claim 31, wherein said capacitor comprises an electric double-layer capacitor.

33. The device as claimed in claim 31, wherein said storage has an energy capacity and a discharging characteristic that discharge 90% of total energy stored in said storage within a warm-up time of said device from a stand-by state.

34. The device as claimed in claim 31, wherein a warm-up time of said device from a stand-by state is a period of time necessary for the recording medium to arrive at said device.

35. The device as claimed in claim 31, wherein at least said second heating element comprises a planar heating resistor.

36. The device as claimed in claim 31, wherein at least said second heater itself constitutes said fixing member while said fixing member itself comprises a planar heating body.

37. The device as claimed in claim 31, wherein at least said second heater comprises a radiation heater made up of a glass tube and a filament disposed in said glass tube.

38. The device as claimed in claim 37, wherein said glass tube is filled with a gas whose major component is krypton.

39. The device as claimed in claim 37, wherein the filament has a color temperature of 2,500° K. or above in a steady state.

40. The device as claimed in claim 37, wherein the glass tube is filled with a gas whose full pressure is higher than 1 atmospheric pressure.

41. The device as claimed in claim 31, wherein assuming that a period of time necessary for said device to be heated from an atmospheric temperature to a fixable temperature is T seconds, that energy E1 (j) that heat storing means discharges for said T seconds is E2 (J), and that a second heat source stores energy of E2 (J) for said T seconds, then E1 is selected to be greater than E2.

42. The device as claimed in claim 31, wherein said first heating element comprises a glass tube and a filament sealed in said glass tube while said second heating element comprises a heating resistor contacting on an outer circumference of said glass tube, at a time of warm-up, said first heating element and said second heating element heat by being supplied with power from the commercial power source and said storage, respectively, and at a time of fixation after the time of warm-up, said first heating element heats by being supplied with power from the commercial power source.

43. The device as claimed in claim 31, wherein said second heating element comprises a planar heating body contacting an outer circumference of either one of said fixing member and said pressing member, at a time of warm-up, said first heating element and said second heating element heat by being supplied with power from the commercial power source and said storage, respectively, and at a time of fixation after the time of warm-up, said first heating element heats by being supplied with power from the commercial power source.

44. The device as claimed in claim 43, wherein part of either one or said fixing member and said pressing member that said second heating element contacts is formed of an electrically insulating material.

45. The device as claimed in claim 43, wherein part of either one of said fixing member and said pressing member that said second heating element contacts is formed of a thermally insulating material.

46. The device as claimed in claim 43, wherein said second heating element contacts said fixing member or said pressing member when said fixing member or said pressing member is in a halt, but does not contact said fixing member or said pressing member when said fixing member or said pressing member rotates.

47. The device as claimed in claim 43, wherein said second heating element contacts said fixing member or said pressing member when said fixing member or said pressing member is in a halt or is to be warmed up, but does not contact said fixing member or said pressing member when said fixing member or said pressing member rotates at a time of warm-up or fixation.

48. The device as claimed in claim 31, wherein said second heating element comprises a conductive material included in said fixing member or said pressing member, and a current is fed to the conductive material via an electrode contacting said fixing member or said pressing member.

49. The device as claimed in claim 48, wherein said electrode contacts said fixing member or said pressing member when said fixing member or said pressing member is in a halt, but does not contact said fixing member or said pressing member rotates.

50. The device as claimed in claim 48, wherein said electrode contacts said fixing member or said pressing member when said fixing member or said pressing member is in a halt or is to be warmed up, but does not contact said fixing member or said pressing member when said fixing member or said pressing member rotates at a time of warm-up or fixation.

51. A fixing device for fixing a toner image formed on a sheet with heat and pressure, comprising:

a plurality of heat sources configured to heat when supplied with power;

at least one of a fixing member and a pressing member configured to be heated by said plurality of heat sources;

a storage for storing power greater than an output of a commercial power source in a stand-by state of said fixing device and driving at least one of said plurality of heat sources with said power for a preselected period of time at a time of warm-up of said fixing device; and a charger for charging said storage with the output of the commercial power source;

wherein said storage and the commercial power source drive said plurality of heat sources at the same time or at different timings.

52. The device as claimed in claim 51, wherein said storage comprises a capacitor.

53. The device as claimed in claim 51, wherein the preselected period of time is six seconds or less.

54. The device as claimed in claim 51, wherein said plurality of heat sources comprises a fist and a second heat source driven by said storage and the commercial power source, respectively.

55. The device as claimed in claim 51, further comprising:

a switch for selectively connecting said storage to said charger or said first heat source; and a controller for controlling said switch to connect said storage to said charger in the stand-by state or connect said storage device to said first heat source when said device is used.

56. The device as claimed in claim 51, further comprising:

a switch for selectively connecting said storage to said charger or the commercial power source; and a controller for controlling said switch to connect said storage to said charger in the stand-by state or connect said storage device to said heat sources when said device is used.

57. The device as claimed in claim 51, wherein said charger comprises a proton polymer battery.

58. The device as claimed in claim 51, wherein said storage comprises a capacitor having a capacity of an order of farad or above.

59. The device as claimed in claim 51, wherein said storage comprises an electric double-layer capacitor.

60. The device as claimed in claim 51, wherein said storage comprises an electric double-layer capacitor using an aqueous solution.

61. The device as claimed in claim 51, further comprising:

a miniature heater configured to be driven by said storage at the time of warm-up; and a safety device adjoining said miniature heater for shutting off power source to said heat sources when a temperature excessively rises.

62. The device as claimed in claim 61, wherein said safety device stops the power source.

63. The device as claimed in claim 51, wherein power to be stored in said storage is varied in accordance with a fixing temperature in a stand-by state of said device.

64. The device as claimed in claim 63, further comprising a temperature sensor for sensing a surface temperature of said pressing member.

65. The device as claimed in claim 51, wherein power to be stored in said storage is varied in accordance with a duration of a stand-by state of said device.

66. The device as claimed in claim 51, wherein said storage comprises a storage battery, and a duration of discharge of said storage battery is varied in accordance with a fixing temperature in a stand-by state of said device.

67. In an image forming apparatus including a fixing device, said fixing device comprising:

a plurality of heat sources configured to heat when supplied with power;

at least one of a fixing member and a pressing member configured to be heated by said plurality of heat sources;

a storage for storing power greater than an output of a commercial power source in a stand-by state of said fixing device and driving at least one of said plurality of heat sources with said power for a preselected period of time at a time of warm-up of said fixing device; and a charger for charging said storage with the output of the commercial power source;

wherein said storage and the commercial power source drive said plurality of heat sources at the same time or at different timings.

68. An image forming apparatus comprising:

a fixing device; and first setting means for setting a first mode;

said fixing device comprising:

a plurality of heat sources configured to heat when supplied with power;

at least one of a fixing member and a pressing member configured to be heated by said plurality of heat sources;

a storage for storing power greater than an output or a commercial power source in a stand-by state of said fixing device and driving at least one of said plurality of heat sources with said power for a preselected period of time at a time of warm-up of said fixing device; and a charger for charging said storage with the output of the commercial power source;

wherein said storage and the commercial power source drive said plurality of heat sources at the same time or at different timings, and said first mode causes said storage to drive said plurality of heat sources and is selectable only in a copy mode.

69. The apparatus as claimed in claim 68, further comprising a sensor for sensing a human body standing around said apparatus, wherein when said sensor senses the human body, said first setting means automatically sets up said first mode.

70. The apparatus as claimed in claim 68, further comprising second setting means for allowing an image forming speed higher than a usual image forming speed to be selected, wherein when said second setting is operated to select said image forming speed higher than said usual image forming speed, said fist setting means automatically sets up said first mode.

71. The apparatus as claimed in claim 68, further comprising a detector for detecting an internal resistance of said storage, wherein when said detector determines that the internal resistance of said storage is doubled, a warning is displayed or said first mode is inhibited from being set or canceled.

72. The apparatus as claimed in claim 68, wherein a date of production of said storage is provided on said storage to thereby allow said storage to be collected and reused when said apparatus is discarded.

73. An image forming apparatus comprising:

a fixing device; and first setting means for setting a first mode;

said fixing device comprising:

a heat source configured to heat when supplied with power from a commercial power source;

at least one of a fixing member and a pressing member configured to be heated by said heat source;

a storage battery for driving an electric circuit of said image forming apparatus other than said heat source with power stored in said storage battery; and a charger for charging said storage battery with power output from a commercial power source;

wherein said first mode causes said storage to drive said heat source and is selectable only in a copier mode.

74. The apparatus as claimed in claim 73, further comprising a sensor for sensing a human body standing around said apparatus, wherein when said sensor senses the human body, said first setting means automatically sets up said first mode.

75. The apparatus as claimed in claim 73, further comprising second setting means for allowing an image forming speed higher than a usual image forming speed to be selected, wherein when said second setting is operated to select said image forming speed higher than said usual image forming speed, said fist setting means automatically sets up said first mode.

76. The apparatus as claimed in claim 73, further comprising a detector for detecting an internal resistance of said storage, wherein when said detector determines that the internal resistance of said storage is doubled, a warning is displayed or said first mode is inhibited from being set or canceled.

77. The apparatus as claimed in claim 73, wherein a date of production of said storage is provided on said storage to thereby allow said storage to be collected and reused when said apparatus is discarded.

78. An image forming apparatus comprising:

a fixing device; and setting means for setting a print mode in which image formation is effected at a speed higher than a usual image forming speed;

said fixing device comprising:

a plurality of heat sources configured to heat when supplied with power;

at least one of a fixing member and a pressing member configured to be heated by said plurality of heat sources;

a storage for storing power greater than an output of a commercial power source in a stand-by state of said fixing device and driving a least one of said plurality of heat sources with said power for a preselected period of time at a time of warm-up of said fixing device; and a charger for charging said storage with the output of the commercial power source;

wherein said storage and the commercial power source drive said plurality of heat sources at the same time or at different timings, and said storage drives said plurality of heat sources when the print mode is set up.

79. The apparatus as claimed in claim 78, wherein a date of production of said storage is provided on said storage to thereby allow said storage to be collected and reused when said apparatus is discarded.

80. An image forming apparatus comprising:

a fixing device; and setting means for setting a print mode in which image formation is effect at a speed higher than a usual speed;

said fixing device comprising:

a heat source configured to heat when supplied with power from a commercial power source;

at least one of a fixing member and a pressing member configured to be heated by said heat source;

a storage battery for driving an electric circuit of said image forming apparatus other than said heat source with power stored in said storage battery; and a charger for charging said storage battery with power output from a commercial power source;

wherein said storage drives said heat source when the print mode is set up.

81. The apparatus as claimed in claim 80, wherein a date of production of said storage is provided on said storage to thereby allow said storage to be collected and reused when said apparatus is discarded.

* * * * *